US007713185B2

(12) United States Patent
Baumann et al.

(10) Patent No.: US 7,713,185 B2
(45) Date of Patent: May 11, 2010

(54) IMPULSE CENTRIFUGE FOR THE PURIFICATION OF THE LUBRICATING OIL FROM AN INTERNAL COMBUSTION ENGINE

(75) Inventors: Dieter Baumann, Greven (DE); Karl Grosse Wiesmann, Nottuln (DE); Norbert Prinz, Greven (DE)

(73) Assignee: Hengst GmbH & Co., KG, Muenster (DE)

( * ) Notice: Subject to any disclaimer, the term of this patent is extended or adjusted under 35 U.S.C. 154(b) by 854 days.

(21) Appl. No.: 10/592,930

(22) PCT Filed: Mar. 16, 2005

(86) PCT No.: PCT/EP2005/002783

§ 371 (c)(1),
(2), (4) Date: Sep. 15, 2006

(87) PCT Pub. No.: WO2005/087383

PCT Pub. Date: Sep. 22, 2005

(65) Prior Publication Data

US 2009/0118111 A1 May 7, 2009

(51) Int. Cl.
*B04B 7/12* (2006.01)
*B04B 9/06* (2006.01)

(52) U.S. Cl. ..... 494/49; 494/60; 494/74; 494/83

(58) Field of Classification Search ..... 494/24, 494/36, 43, 49, 56, 64, 65, 67, 83, 84, 901, 494/60, 74, 79; 210/168, 171, 232, 360.1, 210/380.1, 416.5; 184/6.24
See application file for complete search history.

(56) References Cited

U.S. PATENT DOCUMENTS

| | | | | |
|---|---|---|---|---|
| 2,755,992 | A * | 7/1956 | Tait et al. | 494/49 |
| 3,784,092 | A | 1/1974 | Gibson | |
| 5,906,733 | A | 5/1999 | Purvey | |
| 6,224,531 | B1 * | 5/2001 | Frehland et al. | 494/49 |
| 6,454,694 | B1 * | 9/2002 | Herman et al. | 494/49 |

(Continued)

FOREIGN PATENT DOCUMENTS

DE 22 05 089 A1 8/1972

(Continued)

*Primary Examiner*—Charles E Cooley
(74) *Attorney, Agent, or Firm*—Greer Burns & Crain Ltd

(57) ABSTRACT

A free-jet centrifuge for the cleaning of lubricating oil comprising, a housing with a removable cover, a rotor rotatably arranged in the housing and with channels for feeding and removing the lubricating oil. The rotor is of split design with a drive part and a dirt trapping part which can each be flowed through by their own partial lubricating oil flow and which are designed with a torque transmission device which is engageable and disengageable. The dirt trapping part is separable from the drive part. A device is provided to prevent or restrict the axial mobility of the dirt trapping part relative to the drive part, which is ineffective or detachable when the cover is removed. The drive part extends from the bottom towards the top into the dirt trapping part or entirely through it. The drive part comprises all parts serving for the rotatable bearing of the rotor and the drive part is securely positioned against axial removal with an opened cover.

76 Claims, 35 Drawing Sheets

U.S. PATENT DOCUMENTS

| | | | | |
|---|---|---|---|---|
| 6,530,872 | B2 * | 3/2003 | Frehland et al. | 494/49 |
| 6,821,241 | B2 * | 11/2004 | Herman et al. | 494/5 |
| 6,974,408 | B2 * | 12/2005 | Grosse-Wiesmann | 494/5 |
| 7,182,724 | B2 * | 2/2007 | South | 494/49 |
| 7,377,893 | B2 * | 5/2008 | Herman et al. | 494/49 |
| 7,393,317 | B2 * | 7/2008 | Herman | 494/49 |
| 7,396,325 | B2 * | 7/2008 | Meinig et al. | 494/49 |
| 7,553,271 | B2 * | 6/2009 | Wiesmann | 494/49 |
| 2006/0240965 | A1 * | 10/2006 | Herman et al. | 494/49 |
| 2008/0051278 | A1 * | 2/2008 | Meinig et al. | 494/56 |
| 2009/0118111 | A1 * | 5/2009 | Baumann et al. | 494/49 |
| 2009/0272680 | A1 * | 11/2009 | Wiesmann et al. | 210/167.02 |

FOREIGN PATENT DOCUMENTS

| | | | |
|---|---|---|---|
| DE | 27 12 839 | | 10/1977 |
| DE | 1 340 547 | A | 9/2003 |
| DE | 10 2004 005920 | A1 | 8/2004 |
| EP | 1782888 | A1 * | 10/2006 |
| WO | 2005/087383 | A1 * | 9/2005 |

* cited by examiner

IMPULSE CENTRIFUGE FOR THE PURIFICATION OF THE LUBRICATING OIL FROM AN INTERNAL COMBUSTION ENGINE

BACKGROUND OF THE INVENTION

This invention relates to a free-jet centrifuge for cleaning the lubricating oil of an internal combustion engine, with a housing closed by a removable cover, with a rotor rotatably arranged in the housing and with channels for feeding the pressurized lubricating oil to be cleaned and for removing the cleaned pressureless lubricating oil, the rotor being of split design with, on the one hand, a drive part having at least one recoil nozzle and, on the other hand, a dirt trapping part having a dirt collection area, with the drive part able to be flowed through by a first partial lubricating oil flow and the dirt trapping part by a second partial lubricating oil flow, with the drive part and the dirt trapping part being designed with positive-interaction torque transmission means which are engageable by axially slipping on the dirt trapping part onto the drive part and disengageable by axially pulling off the dirt trapping part from the drive part, with the dirt trapping part being separable from the drive part for disposal or cleaning, and with means provided or applied in the centrifuge which, in centrifuge operation, serve to prevent or restrict the axial mobility of the dirt trapping part relative to the drive part and which are ineffective or detachable when the cover is removed.

A first free-jet centrifuge is known from DE 200 10 612 U1. With this centrifuge, the rotor housing comprises two parts which are detachably connectable with each other, the drive part comprising first connecting means and the dirt trapping part comprising second, corresponding connecting means. In a concrete embodiment, these connecting means consist of a bayonet lock which can be engaged and disengaged by the limited twisting of the two parts of the rotor against each other.

With this known free-jet centrifuge, it proved to be unfavorable that—for separating the dirt trapping part of the rotor from its drive part—the complete rotor must first be removed from the housing of the free-jet centrifuge and that the two parts of the rotor must then be twisted against each other by applying a certain torque which is required for releasing the bayonet lock. Since the rotor of the free-jet centrifuge in its operation will also be wetted by oil splashes on its outer surface, it is frequently difficult to manually apply the required torque for making and breaking the connection between the two rotor parts. This will require that—especially prior to a separation of the two rotor parts from each other—the exterior surface of the rotor must first be cleaned of adhering oil to then be able to apply the required torque for loosening the bayonet lock. Alternatively, the use of tools is conceivable for which the two rotor parts would then, however, have to be provided, on the one hand, with suitable shoulder areas for one tool each and for which, on the other hand, fitting special tools must be kept available which are engageable with one of the two rotor parts each. In any event, the result will be a time-consuming and complicated handling of the rotor when said rotor is to be separated into its two parts which will be required for every maintenance of the free-jet centrifuge. Moreover, it is considered unfavorable that a sturdy and pressure-proof rotor is here required because the full hydraulic pressure of the lubricating oil to be cleaned prevails on the inside of the rotor since the entire oil stream passed through the centrifuge first flows through the interior of the rotor and is then passed to the recoil nozzles in the drive part.

From DE 43 11 906 A1, a device is known for the ventilation of the crankcase of an internal combustion engine wherein the device comprises a separating device for oil particles entrained with the crankcase gases, the device being connected with a suction line leading to the intake tract. An oil centrifuge provided for the lubricating oil cleaning of the internal combustion engine here serves as the separating device. The rotor of the oil centrifuge comprises two parts which are closely connected with each other in the operation of the centrifuge. The mentioned document does not state anything about the separability of the two rotor parts so that it is assumed that although the rotor parts are manufactured as individual parts, they will be subsequently permanently connected. Accordingly, this document does not disclose a separate disposability of only the dirt trapping part with the dirt deposited therein. With this centrifuge as well, the rotor is under the hydraulic pressure of the lubricating oil to be cleaned, with this hydraulic pressure being specifically used to lift the rotor, in operation, from its lower bearing and press it against an axial bearing provided on the upper side of the rotor and the underside of the housing cover of the centrifuge. For this reason, the rotor must here as well be of a sturdy and pressure-proof design.

From DE 1 012 776 B, another free-jet centrifuge is known in which the rotor is of a two-part design. In this known design, the two parts of the rotor comprise an overlapping area radially on the bottom and outside, in which they are tightly and detachably connected by means of several screws. Thus, a separate disposal or cleaning of only the dirt trapping part of the rotor will actually be possible; yet, the disassembly of the rotor into the dirt trapping part and the drive part is complicated and time-consuming due to the connecting screws which must be individually loosened; the same applies for the subsequent assembly. Moreover, here again a sturdy and pressure-proof rotor is required because the full hydraulic pressure of the lubricating oil to be cleaned prevails on the inside of the rotor since, here again, the lubricating oil first flows through the interior of the rotor and is then passed to the recoil nozzles in the drive part.

From WO 98/46 361 A1, a rotor for a free-jet centrifuge is known, said rotor comprising at least one guiding element which extends from an inner wall to the outer wall of the rotor interior. Due to this guiding element or several such guiding elements, the rotor is to be stiffened such that it will be possible to manufacture it of a plastic material. In accordance with a described embodiment, the rotor is here manufactured of two parts which are connected with each other to the complete rotor, here clipped together. The clip connection means are here designed such that—after the connection has once been made—a non-destructive separation of the two rotor parts will no longer be possible. Such separation is not intended either since the complete rotor being made of a plastic material is to be so inexpensive that it can be completely disposed of after its use without any cost disadvantage. With this known rotor as well, the full hydraulic lubricating oil pressure prevails during operation in its interior because the lubricating oil first flows through the interior of the rotor and is subsequently passed to the recoil nozzles for the drive of the rotor. Thus, here again, a sturdy construction of the rotor is necessary to achieve the required pressure resistance.

DE 1 105 351 B discloses a free-jet centrifuge which—in deviation from the usual arrangement—has the characteristic feature that the drive part with the recoil nozzles forms an upper part of the rotor and that the dirt trapping part of the rotor forms its lower part. The two rotor parts are connected with each other in a sealing and detachable manner by means of several connecting screws. Here again, there is the disadvantage that—for a disassembly of the rotor—the latter must first be completely removed from the housing and that, thereafter, several screws must be removed before the dirt trapping part can be separated from the drive part. The assembly requires the same great expenditure so that simple and fast maintenance of the centrifuge will not be possible. Moreover, the rotor must here again be of a sturdy and pressure-proof design since it is subject to the full lubricating oil pressure because, here too, the lubricating oil first flows through the interior of the rotor and subsequently through the recoil nozzles.

WO 00/23 194 A1 shows a centrifuge comprising a split rotor. The two parts of the rotor can be either screwed together, thus enabling subsequent separation, or they can be permanently fused or welded with each other. In the separable design, a separation of the rotor is used for the installation of a rotor insert and later, after a certain operating period, for the inspection and replacement of the rotor insert, as needed. With this known centrifuge, the drive is provided spatially at a distance from the rotor and consists either of a turbine or an electrical motor. Both drives are very complicated—compared with recoil nozzles on the rotor—and will not only result in higher manufacturing costs but also in a larger installation space for the centrifuge. This is in contradiction to the generally desired compact construction and low-cost manufacturability.

The prior DE 10 2004 005 920 A1 without prior publication shows a rotor assembly to be used as part of a centrifuge for the separation of particle-like material from a fluid. The rotor assembly comprises a collection chamber, housing a particle separation device, as well as a drive chamber with a Heroturbine. The drive chamber can be assembled with the collection chamber and is separable from it. The fit between the drive chamber and the collection chamber transmits any rotary movement of the drive chamber caused by the Heroturbine directly to the collection chamber for particle separation. Due to the drive chamber being separable from the collection chamber, the collection chamber can be disposed of with the sludge accumulated in it.

It is considered detrimental with this known rotor assembly that the drive chamber is completely outside, here underneath, the collection chamber. This brings about that—aside from two bearings provided in the area of the drive chamber—a third bearing will always be required at the end of the collection chamber away from the drive chamber, here the top end, to ensure adequate bearing with good true running of the collection chamber. This third bearing results in increased manufacturing and installation expenditures and in additional weight. Furthermore, it is considered detrimental that—with every removal and installation of the collection chamber—the upper, third bearing will be under mechanical stress which is unfavorable for its lifetime. Thus, there is the risk that the third bearing—in time—will have an increased coefficient of friction which will result in a reduction of the otherwise achievable speed of the rotor. Finally, it should be mentioned as a disadvantage that—upon a removal of the collection chamber from the housing of the centrifuge—it will not be ensured that the drive chamber will safely remain within the centrifuge. Much rather, it might inadvertently happen that, upon removal of the collection chamber, the drive chamber will also be removed, whereby the two bearings of the drive chamber will be exposed to undesirable mechanical stress. Here again, any damage of the bearings will result in an increased bearing friction and a reduction of the achievable speed of the rotor at a specified drive power.

SUMMARY OF THE INVENTION

Accordingly, this invention has the objective of creating a free-jet centrifuge of the initially mentioned type which avoids the above described disadvantages and in which, in particular, a light and compact construction is achieved, in which permanently smooth running at a high speed will be ensured, in which a simple separate removal and disposal of the dirt trapping part of the rotor will be possible and in which the required maintenance work can be performed quickly and easily. With it, high efficiency, high operational reliability and low-cost manufacture are to be achieved.

This problem is solved according to the invention with a free-jet centrifuge of the initially mentioned type characterized in that

- the drive part extends, from the bottom towards the top, into the dirt trapping part or entirely through it;
- the drive part comprises all parts serving for the rotatable bearing of the rotor; and
- the drive part is securely positioned against axial removal with opened cover.

This invention creates a free-jet centrifuge comprising, on the one hand, a simple and thus low-cost construction with a compact and relatively light-weight design and, on the other hand, being reliable in operation, and for which fast and simple maintenance is possible, wherein only the dirt trapping part with the dirt deposited therein is removed from the housing. Since regular maintenance is performed for internal combustion engines, usually in connection with an oil change and an oil filter change, the centrifuge is expediently designed such that the dirt trapping part of its rotor has a dirt collection capacity which is adequately dimensioned for a defined maintenance interval. A major advantage of the free-jet centrifuge according to the invention is the fact that the drive part as a lifetime component can remain in the centrifuge over the entire service period of the centrifuge. This avoids the unnecessary replacement of the drive part upon maintenance of the centrifuge which thus saves costs. Since the drive part comprises all parts required for the rotatable bearing of the rotor—i.e. in particular the bearings required for it—the bearings will not be separated and again joined together upon changing the dirt trapping part which is of benefit for the quality and lifetime of the bearings and ensures a high rotor speed over the long run. Due to the fact that the drive part extends, from the bottom towards the top, into the dirt trapping part—thus into its interior—or extends entirely through the dirt trapping part, the bearings can be advantageously spaced far apart from each other in the axial direction of the rotor. Thus, an additional, third bearing outside of the drive part—e.g. on the upper end of the dirt trapping part—will not be required for the rotatable bearing of the rotor and good true running of the rotor will be ensured nonetheless. The bearing of the drive part being secured against axial removal with opened cover will reliably prevent an unintentional removal of the drive part together with the dirt trapping part and thus reliably ensures that the drive part will always remain in the centrifuge and that the bearings do not suffer any damage.

Moreover, the free-jet centrifuge according to the invention has the property that the drive part and the dirt trapping part can each be flowed through by its own partial lubricating oil flow. Thus will be achieved that, in the operation of the centrifuge, only the drive part must be under the full hydraulic pressure of the lubricating oil to be cleaned, said pressure generated by a feeding lubricating oil pump while, in contrast, the interior of the rotor is no longer burdened by the hydraulic pressure of the lubricating oil to be cleaned. This can e.g. be simply achieved by an oil channel leading the lubricating oil to be cleaned into the interior of the rotor, said channel having a cross-sectional constriction where the hydraulic pressure of the fed lubricating oil to be cleaned is throttled down prior to its entry into the interior of the rotor. Thus, the rotor only needs to absorb the forces resulting from its rotation and being caused by the centrifugal force which will achieve a significant release of the rotor. This allows the use of simpler and/or fewer seals and of less sturdy materials or the reduction of the wall thicknesses of the rotor.

To be able, on the one hand, to separate the two rotor parts from each other as easily as possible and connect them with each other and to ensure, at the same time, that the dirt trapping part cooperates in a slip-free manner in the rotation of the drive unit, it is furthermore provided that the drive part and the dirt trapping part are designed with positive-interaction torque transmission means which are engageable and disengageable by simple axial slip-on and axial pulling apart. Thus, a simple movement in only one direction—i.e. in axial direction—will be sufficient to connect the dirt trapping part with the drive part or to separate these parts from each other. Rotary movements with the application of torque—such as required e.g. with a bayonet lock—or the loosening and fastening of several individual screws will not be required here.

To ensure that the dirt trapping part, after axial plug-on, will maintain its position relative to the drive part, means are provided or attached in the centrifuge which—in the centrifuge operation—serve to prevent or restrict the axial mobility of the dirt trapping part relative to the drive part. At the same time, these means are designed such that they are ineffective or detachable when the cover is removed. Thus will be ensured that—during operation of the free-jet centrifuge—the dirt trapping part maintains its defined position relative to the drive part, thus ensuring the required tightness between the two parts of the rotor and the required transmission of the driving torque from the drive part to the dirt trapping part.

Another embodiment of the free-jet centrifuge according to the invention provides that the drive part comprises a central tubular body forming a lubricating oil channel and at least one nozzle bearing body radially extending outward from the tubular body with at least one oil branch channel leading to the recoil nozzle/nozzles. A favorable design of the drive part is thus obtained, with the tubular body expediently being used for bearing the rotor and for feeding the oil to the interior of the rotor and the nozzle bearing body being used for holding the nozzles and for feeding the pressurized oil to the nozzles. Preferably, the nozzle bearing body is provided on the bottom of the tubular body; alternatively, the nozzle bearing body can also be provided at the top of the tubular body.

A first development of the above indicated embodiment of the free-jet centrifuge provides that the nozzle bearing body has the form of a double bottom in the interspace of which the oil branch channels are formed. In this development, the interspace between the two bottoms of the nozzle bearing body is used for feeding the pressurized oil to the nozzles, the two bottoms being, of course, appropriately pressure-proof in design.

One alternative proposes that the nozzle bearing body has the shape of a disk in which the oil branch channels are formed. A disk is a geometrically advantageously simple component which can be designed sufficiently pressure-proof without any problem.

In another alternative, the nozzle bearing body is designed in the form of one or several tubular arms with an oil branch channel running through the/each arm. In this embodiment of the centrifuge, the nozzle bearing body has a particularly simple form which needs little space, especially if only one or two arms with one recoil nozzle is/are provided which generally is entirely sufficient. The space remaining adjacent to the tubular arm or between the tubular arms seen in circumferential direction can then also be used advantageously for the rotor of the centrifuge. This allows for a larger volume of the interior of the rotor, at a specified installation space for the centrifuge.

The rotatable bearing of the rotor can be effected in various ways. A first embodiment proposes with regard to this bearing that the rotor is positioned on an axis forming one part of the housing and being rigidly or articulatedly attached on the remaining housing, said axis penetrating the rotor and being detachably supported and centered with its upper end in the cover placed on. This solution presents a particularly sturdy and load-bearable construction. Here, the axis can normally remain as a lifetime component in the centrifuge.

Alternatively thereto, the rotor can be arranged on bearings on an axis forming a rigid part of the housing, said axis extending into the rotor and ending with its upper end at a distance to the cover placed on. In this case, the axis can end already in the rotor or only above it. The rotor and/or the cover can here be simpler in design. Here again, the axis can normally remain as a lifetime component in the centrifuge.

A third variant of the rotor bearing proposes that the rotor is on bearings at the bottom and the top by means of one axis stub each, with the axis stubs being parts of the rotor or parts of the housing and its cover. Here, the interior of the rotor advantageously remains free of bearing means.

For low-friction bearing of the rotor, friction bearings and/or rolling bearings can be used—as is known per se.

The dirt trapping part can be designed in different ways and manners. A first embodiment provides that the dirt trapping part is formed by an entirely or partly open hollow body each axially on the bottom and axially on the top, with a radially outer peripheral wall, wherein, axially on the bottom, the nozzle bearing body—in the assembled condition of the rotor—forms a bottom delimiting the interior of the rotor at least partly towards the bottom and with the hollow body, axially on the top, being closed by a separate dirt trapping part cover being permanently or detachably mounted.

Alternatively, a second embodiment provides that the dirt trapping part is formed by a cup-shaped hollow body axially open on the top, with a radially outer peripheral wall, with the hollow body, axially on the top, being closed by a separate dirt trapping part cover being permanently or detachably mounted.

A third embodiment proposes as another alternative that the dirt trapping part is formed by a bell-shaped hollow body being entirely or partly open axially on the bottom, with a radially outer peripheral wall, with the nozzle bearing body, axially on the bottom, forming—in the assembled condition of the rotor—a bottom at least partly delimiting the interior of the rotor towards the bottom.

A fourth embodiment consists of the dirt trapping part being formed by a can-shaped hollow body closed axially on the bottom and axially on the top, with a radially outer peripheral wall.

In each of the four above specified embodiments of the dirt trapping part, the hollow body forming this dirt trapping part can additionally comprise a radially inner tubular wall which serves, in particular, to stiffen the dirt trapping part.

The torque transmission means can be provided at different points of the rotor. A first preferred embodiment proposes that the interacting torque transmission means of drive part and dirt trapping part of the rotor are arranged in its radially inner, axially upper area. This arrangement of the torque transmission means offers in particular the advantage that the torque transmission means are visible for the maintenance personnel when setting the dirt trapping part onto the drive part which contributes to keep the assembly very simple and avoid assembly errors.

Alternatively or additionally to the above mentioned embodiment, the interacting torque transmission means of drive part and dirt trapping part of the rotor can be provided in its axially lower area. This arrangement of the torque transmission means can be employed not only for the embodiment of the dirt trapping part which is axially open on the bottom but also for that which is axially closed on the bottom. If, in this embodiment, the torque transmission means are located radially outside, smaller forces acting in the circumferential direction of the drive part and the dirt trapping part will occur with the transmission of a defined torque which allows a simpler design of the torque transmission means.

For the embodiment of the drive part with arms, it is preferably provided that the dirt trapping part on the underside has a contour axially overreaching the arms of the drive part and forming, with these arms, the interacting torque transmission means of the drive part and the dirt trapping part of the rotor. Advantageously, the drive part does not need any separate torque transmission means here; and, on the dirt trapping part, the torque transmission means used there can be very simple in design.

As a supplement, the contour of the underside of the dirt trapping part can be additionally designed as a latching connection axially engageable and disengageable with the arms of the drive part. In a simple manner, the dirt trapping part on the drive part can thus be adequately secured against axial displacement.

To make the oil to be cleaned located inside the rotor rotate as efficiently as possible when the rotor is made to rotate, it is furthermore provided that the dirt trapping part comprises in its interior radially or predominantly radially running guide and stiffener walls. Moreover, mechanical stiffening of the dirt trapping part will thus be enabled which allows the use of lighter or thinner-walled material for the dirt trapping part and/or operation at a higher speed.

A further development of the above mentioned last embodiment of the free-jet centrifuge proposes that the radially inner end of the guide and stiffener walls forms a part of the torque transmission means on the side of the dirt trapping part, and that the interacting torque transmission means of the drive part and the dirt trapping part of the rotor, in its radially interior area, are provided extending over at least one part of the axial length of the tubular body. In this embodiment, the guide and stiffener walls obtain an additional function which presents an advantageously high degree of functional integration.

Independent of the location of the torque transmission means on the rotor of the centrifuge, it is preferably provided that the interacting torque transmission means of the drive part and the dirt trapping part are formed by axially combinable and separable multi-edge contours or indentations or waviness or tongue-and-groove-arrangements, each seen in radial direction, with or without undercut. All specified embodiments of the torque transmission means are engageable and disengageable by a simple axial movement of the dirt trapping part relative to the drive part, with the torque transmission means—in engaged condition—reliably transmitting the torque generated by the drive part to the dirt trapping part. In the embodiment of the torque transmission means as e.g. tongue-and-groove arrangements with undercut, the torque transmission means can simultaneously also take up the forces acting in radial direction. For example, the above mentioned guide and stiffener walls can also be connected, by axially joining, with the central tubular body of the drive part such that radial forces from the guide and stiffener walls can be discharged to the central tubular body. This embodiment results in a particularly sturdy and heavy-duty rotor of low weight.

To make the work during the installation of the rotor as easy as possible for the maintenance personnel and to prevent installation errors as far as possible, it is furthermore suggested that the interacting torque transmission means of the drive part and the dirt trapping part are designed in a self-finding manner with lead-in slopes and/or lead-in points.

To achieve the most inexpensive manufacturability of the dirt trapping part, it is preferably provided that the hollow body forming the dirt trapping part of the rotor is a one-piece plastic injection molded part.

Alternatively, the hollow body forming the dirt trapping part of the rotor can be a plastic component joined together, preferably welded, of two injection molded parts. The two-piece design is, of course, somewhat more elaborate in its manufacture but it allows more complex forming of the dirt trapping part.

To sufficiently seal off the drive part and the dirt trapping part of the rotor against each other—in their joined together condition—against oil leakage, it is furthermore preferably provided that at least one separately attached or single-piece integrally molded seal is provided each in the contact areas between the drive part and the dirt trapping part of the rotor.

Independent of the above described embodiments of the free-jet centrifuge, it is preferably provided for it that, for the generation of the two partial lubricating oil flows, the lubricating oil flow being fed to the centrifuge can be divided in the centrifuge into two volume-adjusted partial flows, advantageously fed via two defined throttle points, with the one partial flow being feedable under pressure to the drive part and its recoil nozzles and the other partial flow being feedable without pressure to the dirt trapping part via at least one inlet. Due to the separation of the fed oil flow within the centrifuge, it can be avoided to provide means for the separation and volume adjustment of the oil flow outside of the centrifuge. This is another contribution to a compact design of the centrifuge. Moreover, due to the volume-adjusted separation of the oil flow to the partial flows, the volume ratio of the two partial flows to each other can be determined. On the one hand, the drive power of the rotor can thus be influenced which is generated by its drive part. On the other hand, it is possible to influence the dwell time of the oil inside the rotor in a desired manner. For the operation of the free-jet centrifuge, major parameters can thus be established in a simple manner and even changed in design, as needed.

Preferably, both throttle points are provided in the drive part of the centrifuge. This offers the special advantage that in case of an inadvertently missing dirt trapping part, no malfunction in the lubrication of the internal combustion engine can occur. The pressure of the lubricating oil is fully maintained because there will be no pressure drop in the dirt trapping part.

Furthermore, of the two throttle points, the one through which the partial lubricating oil flow can be fed to the dirt trapping part is formed by an upper bearing of the drive part with a defined gap measure. A separate component is not required here for the throttle point; at the same time, good bearing lubrication will be ensured. Additionally, a self-cleaning effect will advantageously result for the throttle point due to the movement of the two bearing parts rotating relatively to each other whereby this throttle point will be insensitive to contaminations.

Preferably, it is provided in a further embodiment that the partial flow fed to the drive part is larger by volume than the partial flow fed to the dirt trapping part. Due to this preferred separation, a fast start and a high speed of the rotor of the centrifuge will be ensured, and at the same time, a long dwell time of the partial flow flowing through the interior of the rotor and its dirt trapping part will be ensured. The quick start with a fast speed increase is due to the fact that, before the rotor starts to run, it initially does not contain any oil yet and is accordingly lighter. When oil is then supplied to the centrifuge, the larger partial flow thereof will immediately reach the drive nozzles and accelerates the still light-weight rotor fast, whereas the dirt trapping space is only filled with a delay. This embodiment contributes to the good efficiency of the centrifuge with regard to the separation of small dirt particles, particularly soot, from the lubricating oil to be cleaned.

To obtain the simplest possible construction in terms of running the lubricating oil within the centrifuge, a preferred embodiment of the free-jet centrifuge proposes that the supply of the lubricating oil to the centrifuge, for the drive part as well as for the dirt trapping part, is provided axially from the bottom through the axis or the lower axis stub. The supply of the lubricating oil to the axis or the axis stub can be provided—as is known per se—for example through a centrifuge base or through another component presenting, for example, one part of an oil filter device.

Alternatively, there is the possibility that the supply of lubricating oil to the centrifuge will be provided, for the drive part, axially from the bottom through the axis or the lower axis stub, and for the dirt trapping part, separately thereof axially from the top. With this additional embodiment, greater freedom of design is achieved which can contribute to a more advantageous solution in some applications of the free-jet centrifuge.

For all of the above indicated embodiments of the free-jet centrifuge, it is preferably provided in a further development that the partial lubricating oil flow for the dirt trapping part can be supplied into it axially on the top, radially from the inside to the outside, in the form of a revolving fan jet or several individual jets distributed in circumferential direction through at least one correspondingly formed inlet. This embodiment ensures that the lubricating oil—seen in the circumferential direction of the dirt trapping part—will be uniformly distributed when it is introduced into that part. At the same time, the lubricating oil is directed the farthest possible radially outside where the centrifugal forces are especially effective. Moreover, this achieves the longest possible flow path of the lubricating oil in axial direction through the rotor which also promotes the separation of dirt particles by the effect of the centrifugal force in the rotor.

If the inlet does not provide for a desired uniform distribution of the partial lubricating oil flow in circumferential direction of the rotor, at least one built-in part can be provided axially on the top in the dirt trapping part, for a uniform distribution of the inflowing lubricating oil in circumferential direction of the dirt trapping part.

In accordance with another further development, at least one lubricating oil outlet is provided axially on the bottom and radially inside on the rotor, said outlet having a cross-section which is larger than the cross-section of the inlet. The design of the outlet here indicated ensures that no hydraulic lubricating oil pressure can develop in the rotor, aside from the lubricating oil pressure generated by centrifugal force.

It is furthermore provided that, radially outside from the outlet, a deflecting rib arrangement or a shielding disk will be provided—on the underside of the rotor and/or on the upper side of a centrifugal housing area located under the rotor—which forces the pressureless partial lubricating oil flow coming from the outlet to a guided course separated from the rotor and from the oil jet coming out of every recoil nozzle. Thus will be ensured that the drive of the rotor will not be disturbed by the oil flow coming from the outlet and that it will not be reduced in its efficiency. The deflecting rib arrangement and/or the shielding disk provide for a spatial separation—in the area directly under the rotor—of the pressureless oil flow exiting from the rotor and that of the oil jets exiting from the recoil nozzles. Thus, full efficiency of the recoil drive of the rotor will always be ensured.

As already mentioned further above, the drive part is secured against removal towards the top. Preferably, this security is concretely provided by means of a safety latched or clamped or screwed onto the axis. Such a safety can be attached quickly and easily and fulfills its intended function with high reliability. Moreover, in a possibly occurring exceptional case, the possibility still exists to remove the drive part of the rotor from the centrifuge, as needed, if it must be unexpectedly cleaned or replaced.

As explained further above already, it is true that the torque transmission means actually transmit the torque generated by the drive part to the dirt trapping part; however, they are intentionally designed such that they can easily be joined and separated in axial direction, with separate means being provided to prevent or restrict the axial mobility of the dirt trapping part relative to the drive part. For a realization of these separate means, it is suggested that the dirt trapping part axially on the upper side and the cover axially on the underside each have a stop face which in their interaction prevent or restrict the axial mobility of the dirt trapping part relative to the drive part when the cover is placed on. This development has the advantage that the restriction of the axial mobility is inapplicable when the cover is removed and that the dirt trapping part can then be axially removed, without any further interventions, from the housing of the centrifuge which is opened due to the removal of the cover.

As an alternative to the above embodiment, it is proposed that a stop body—detachably connected axially at the top with the axis, projecting above the axis radially towards the outside—will have axially on the underside, and the dirt trapping part will have axially on the upper side, one stop face each which in their interaction prevent or restrict the axial mobility of the dirt trapping part relative to the drive part during operation of the centrifuge. In this embodiment, instead of the cover, a separate component—i.e. the stop body—will have the stop face, thus allowing a simpler design of the cover, e.g. a plastic cover without an insert of metal required for the stop face.

To keep the number of required individual parts small, it is advantageously provided that the safety and the stop body are combined to or in one component.

For embodiments of the centrifuge where forces will occur to an appreciable extent during operation and which will act on the rotor in axial direction towards the top, the invention preferably proposes that, between the axial upper side of the dirt trapping part and the axial underside of the cover, an additional bearing will be provided which prevents or restricts the axial mobility of the dirt trapping part relative to the drive part with the cover placed on, and which takes up the forces of the dirt trapping part which are directed axially towards the top without the rotor thereby being slowed down in operation.

An additional, especially maintenance-friendly embodiment of the free-jet centrifuge is characterized in that the dirt trapping part axially on the upper side and the cover axially on the underside comprise coupling means which are engageable and disengageable with each other, preferably latching means, which do not contact each other when the cover is placed on and which, when the cover is removed, will take along the dirt trapping part axially towards the top, by separating it from the drive part. In this embodiment, the dirt trapping part is simultaneously taken along with the removal of the cover of the housing of the centrifuge resulting in a particularly easy handling during the maintenance of the centrifuge. For the installation of a new dirt trapping part, the old dirt trapping part must then merely be separated from the cover and the new, clean dirt trapping part must be connected with the cover, preferably latched. By placing the cover onto the housing of the centrifuge, the dirt trapping part can simultaneously be thereafter connected again with the associated drive part to the complete rotor without any additional installation steps. The rotation of the rotor during operation of the centrifuge will not be impaired by the coupling means since these are designed and arranged such on the cover and on the dirt trapping part that the coupling means of the two parts do not contact each other when the cover is placed on. Thus, there will be no disturbing and wear-causing friction of the coupling means during the operation of the centrifuge. The coupling means only come into contact with each other when the cover is removed.

To be able to retrofit already existing internal combustion engines with a centrifuge according to the invention, it is additionally proposed that the drive part and the dirt trapping part, in view of their parts interacting with the housing, will comprise a forming and dimensioning which will allow the installation of the drive unit and the dirt trapping part into existing centrifuges, hitherto provided with a conventional rotor. Thus, the advantageous possibility exists of retrofitting at the lowest expenditure.

In view of an unproblematic disposal of the centrifuge's dirt trapping parts loaded with dirt particles, it is preferably provided that the dirt trapping part is free of metal and that the plastic forming the dirt trapping part will be unmixed, preferably a recycling plastic, and combustible without pollutant emissions or with low emissions.

In many applications, the free-jet centrifuge presents a cleaning device which is in an oil bypass flow; this is, for example, usually the case in the cleaning of the lubricating oil of internal combustion engines. For such applications of the free-jet centrifuge in a bypass flow, it is expediently provided that a minimum pressure starting valve is arranged in a channel feeding the lubricating oil to the centrifuge, said valve only releasing the oil supply to the centrifuge after a definable oil pressure on the inlet side is exceeded. This embodiment of the centrifuge ensures that oil will only flow through it when it is available in an adequate amount and with adequate pressure. For the internal combustion engine, it will thus be ensured that lubrication of all lubricating points of the internal combustion engine is provided before a partial flow of the lubricating oil is fed through the centrifuge.

Another contribution to a particularly compact construction and to the simplest possible initial installation of the centrifuge consists of it preferably being part of a module comprising at least one additional auxiliary unit—especially an oil filter and/or an oil cooler—of the internal combustion engine, said part being flangeable to the internal combustion engine by making the necessary flow connections.

Furthermore according to the invention, it is still provided for the free-jet centrifuge according to the invention being used as a lubricating oil centrifuge that the centrifuge is operated in a bypass flow to the oil filter lying in the main flow and that the bypass flow flowing through the centrifuge comprises a maximum of 10%, preferably 5%, of the volume flow of the main flow. The bypass flow which is taken away from the main flow and fed through the centrifuge is so small in this embodiment that the lubricating oil supply of the lubricating points of the associated internal combustion engine will not be impaired. On the other hand, however, this small volume bypass flow is sufficient for an efficient separation of small dirt particles, especially soot, within the centrifuge, thus ensuring a clean, low-particle condition of the lubricating oil of the internal combustion engine over the entire period of time between two services with oil change.

Another embodiment of the centrifuge according to the invention is characterized in that the centrifuge for the rotatable bearing of the rotor comprises a central axis which is hollow at least over one part of its length and forms a section of the oil feed channel; that, in this section, a valve body of a minimum pressure valve is axially movably provided, said valve body being pre-loaded in closing direction; that the valve body protrudes from the axis and a sealing head of the valve body is located outside of the axis; and that a valve seat interacting with the sealing head is formed on an axis-carrying centrifuge housing part through which the oil feed channel is running.

Due to the fact that the sealing head of the minimum pressure valve is located outside of the axis, an axis with a relatively small outside diameter can be used. This allows the use of a lower bearing of the centrifuge rotor with a correspondingly small diameter which provides for an advantageously low friction in this lower bearing and thus a high rotor speed at the specified drive power. At the same time, the minimum pressure valve does not need any additional structural space within the centrifuge so that a compact design will remain ensured.

Another embodiment of the above explained centrifuge provides that the valve body is composed of several individual parts which are connected with each other, in particular, the sealing head, a stem and a stem guide end piece. A relatively small diameter is sufficient for the stem which runs through the hollow part of the axis. The sealing head which needs a larger diameter for its function is located outside of the axis so that the dimension of the axis diameter will not be influenced by it. Due to the multipart design of the valve body, optimally suitable materials can be respectively used for the individual parts, thus realizing, in a simple manner, an optimized function of the minimum pressure valve.

As an alternative to this, the valve body can also be of a single-piece design. This embodiment will realize, in particular, the low-cost manufacturability of the valve body.

Another embodiment of the free-jet centrifuge is characterized in that the drive part comprises a central tubular body which—by forming a ring channel for the oil supply—surrounds at a distance a central axis on which the drive part is rotatably positioned and that—in an upper end area of the ring channel between an upper bearing of the drive part and an oil inlet of the dirt trapping part—a shielding ring is provided which is tied either radially inside to the axis or radially outside to the tubular body.

The shielding ring protects the associated bearing against an unfavorably large oil throughput which can result in overheating of the bearing. At the same time, however, adequate lubrication of the upper bearing will remain ensured since the shielding ring is tied either radially inside or radially outside so that, on the respectively opposite side, an oil passage remains free for an oil volume sufficient for the lubrication of the bearing. With the embodiment in which the shielding ring is tied radially outside to the tubular body, the advantage is additionally realized that a dirt trapping angle is formed which is provided radially outside and which keeps dirt particles away from the bearing above the shielding ring.

Another embodiment of the free-jet centrifuge is characterized in that the centrifuge comprises a central hollow axis whose hollow interior forms—in a first axial area—a section of the oil feed channel and—in a second axial area—an oil outlet channel; that in the hollow interior of the axis, a first valve body—preloaded in closing direction, interacting with a valve seat—of a minimum pressure valve is provided axially movably to a limited extent; that an oil passage is formed in the valve body; and that a second valve body—preloaded in closing direction—of an overpressure shutdown valve interacts with the oil passage.

In this embodiment, the free-jet centrifuge comprises a valve unit which—in a very compact design—combines the functions of a minimum pressure valve and an overpressure shutdown valve. Advantageously, only two movable valve bodies are here required which contributes to the compact design and simple installation, and also results in a reliable function. The design is advantageously so compact in this case that the entire valve arrangement can be accommodated in the hollow interior of the axis for the rotor of the centrifuge without the axis having to provide a particularly large outside diameter. The minimum pressure valve here ensures that oil will only flow through the centrifuge when a certain minimum oil pressure exists at the inlet of the centrifuge. If the oil pressure is below this minimum pressure, the minimum pressure valve will be closed and there will be no oil flow through the centrifuge. The overpressure shutdown valve ensures that—in case of an excessive pressure of the oil flowing to the centrifuge—at least a partial flow of the oil will be diverted on a short flow path through a relief channel which passes the drive part and the dirt trapping part of the rotor, thus achieving a fast pressure relief. As long as the pressure at which the overpressure shutdown valve will open is not reached, the overpressure shutdown valve remains closed. In its opened condition, the limited axially movable valve body of the minimum pressure valve ensures that, in this condition, the relief channel will also be closed.

In another embodiment of this free-jet centrifuge, it is provided that preloading of the first valve body and of the second valve body in their closing direction is effected by a single spring. This embodiment results in a particularly simple and space-saving construction.

Alternatively, preloading of the first valve body and of the second valve body in their closing direction can be effected by their own spring each. This embodiment provides for a greater variability with regard to the forces which are to act as a preload onto the two valve bodies.

In accordance with another development, a free-jet centrifuge is proposed which is characterized in that the centrifuge comprises a central hollow axis whose hollow interior, in a first axial area, forms a section of the oil feed channel for the drive part and for the dirt trapping part and, in a second axial area, a section of the oil feed channel only for the dirt trapping part; that, in the hollow interior of the axis, a valve body—preloaded in closing direction, interacting with a valve seat—of a minimum pressure valve is provided being axially movable to a limited extent; and that, in the valve body, an oil passage with a defined cross-section is formed whose orifice on the sealing seat side is located radially outside and downstream of the sealing contour of the valve body interacting with the sealing seat.

In this free-jet centrifuge, the valve body is advantageously used as a means for separating the oil flow supplied to the centrifuge into the two partial flows, with the one partial flow being fed to the drive part with the recoil nozzles and the other partial flow being fed to the dirt trapping part for cleaning. The oil passage through the valve body here forms a defined cross-section which guides a specifiable oil volume flow to the dirt trapping part.

If the valve body is in its closed position, it closes off entirely not only the partial oil flow to the drive part but also the partial oil flow to the dirt trapping part. This will prevent that—in the closed condition of the minimum pressure valve—an oil flow can flow through the dirt trapping part of the centrifuge and there possibly mobilize dirt particles and entrain them into the cleaned lubricating oil.

An alternative embodiment to the above described centrifuge proposes a centrifuge which is characterized in that the centrifuge comprises a central hollow axis whose hollow interior forms—in a first axial area—a section of the oil feed channel for the drive part and for the dirt trapping part and—in a second axial area—a section of the oil feed channel only for the dirt trapping part; that in the hollow interior of the axis, a valve body—preloaded in closing direction, interacting with a valve seat—of a minimum pressure valve is provided axially movably to a limited extent; and that, between the outer circumference of the valve body and the inner circumference of the hollow axis, an oil passage with a defined cross-section is formed whose orifice on the sealing seat side is located radially outside and downstream of the sealing contour of the valve body interacting with the sealing seat.

With this alternative solution, the same advantages are obtained as with the above described centrifuge—the difference merely being that, now, the partial oil flow which is supplied to the dirt trapping part will be fed—with opened minimum pressure valve—through a defined annular gap between the outer circumference of the valve body and the inner circumference of the hollow axis guiding the valve body. If the valve body is here in its closed position, it will entirely close off—in addition to the partial oil flow to the drive part—the partial oil flow to the dirt trapping part as well.

Another free-jet centrifuge according to the invention is characterized in that the bottom of the dirt trapping part is provided with openings distributed in radial and circumferential direction and under the perforated bottom in an axial distance from it and above the nozzles, a closed shielding disk is provided which is part of the drive part, or that in the dirt trapping part above its closed bottom, an intermediate bottom is provided which has openings distributed in radial and circumferential direction.

This free-jet centrifuge achieves that the rotor will fill with oil only in its radially exterior part—viewed radially from outside to inside—thus, the mass of the rotor including the oil included therein will be smaller than with a full rotor which results in a higher speed at a specified drive power. This higher speed provides for an accelerated separation of dirt particles from the lubricating oil by means of the centrifugal force. When the dirt particle cake which settles in the radially outer area of the interior of the rotor has grown so far radially towards the inside that it covers up a radially outermost rim of the openings, the lubricating oil will penetrate through the next following rim of openings radially towards the inside, which again results in only a limited amount of oil being contained in the rotor; however, the advantage gradually becoming smaller with the increasingly growing dirt particle cake.

A further development of the above described free-jet centrifuge provides that the bottom or the intermediate bottom provided with the openings is designed as a perforated plate or a screen plate.

Additionally, a layer of material, preferably of fleece or fabric, can be placed onto the bottom or the intermediate bottom, covering up its openings in an oil-permeable manner. Although this layer of material allows lubricating oil to pass, it prevents the penetration of larger parts of the dirt particles or parts of the dirt particle cake.

Another free-jet centrifuge is characterized in that two shielding disks are provided one over the other, radially outside of a clean oil outlet of the dirt trapping part, on the upper side of a centrifuge housing part located under the rotor, with the pressureless partial lubricating oil flow coming from the clean oil outlet flowing off between the lower shielding disk and the centrifuge housing part located thereunder, and with the fast flowing partial lubricating oil flow—exiting from the recoil nozzles of the drive part—being discharged between the lower shielding disk and the upper shielding disk.

With this centrifuge, the partial oil flow exiting from the recoil nozzles and the partial oil flow coming out of the dirt trapping part are kept separate from each other, and the oil flow exiting at high speed from the nozzles is kept away from the outer circumference of the rotating rotor, thus preventing an undesirable deceleration of the rotor due to the exiting lubricating oil.

Another free-jet centrifuge is characterized in that a central axis serving for the rotatable bearing of the rotor is designed as one single piece with a part of the centrifuge housing located under the rotor.

With this centrifuge, any assembly expenditures for a connection of the axis with a part of the centrifuge housing will be avoided, thus resulting in more favorable manufacturing costs for the centrifuge. Moreover, due to the single-piece embodiment, it is not possible that the axis is loosened from the part of the centrifuge housing carrying it, as can happen, for example, with a plug or screw connection in unfavorable circumstances.

Another free-jet centrifuge is characterized in that at least one bearing sleeve is set onto the outside of a central axis serving for the rotatable bearing of the rotor, the sleeve being of a material forming a favorable sliding fit with at least one bearing bush in the rotor.

This centrifuge provides the advantageous possibility to choose the material for the axis independent of the sliding properties with regard to the bearing bush in the rotor. Thus, for example, the use of a light metal—such as aluminum or magnesium—will be possible as the material for the axis, although light metal has unfavorable properties with regard to a friction bearing fit. Only the bearing sleeve set onto the axis must have the favorable properties for the sliding fit with the bearing bush of the rotor.

So that the above mentioned bearing sleeve has an exactly round outer circumference after being set down onto the axis, a further development of this centrifuge preferably provides that the bearing sleeve, after being set down onto the axis, will be finished on its outer circumference by grinding. This subsequent grinding will ensure that the bearing sleeve has an exactly round outer circumference form so that any possible deviations of the axis itself from an exactly round form will have no unfavorable consequences for the outer circumference of the bearing sleeve.

Another embodiment of the free-jet centrifuge is characterized in that the drive part of the rotor is designed with a central tubular body through which the lubricating oil to be cleaned can be fed to the dirt trapping part; that, in an upper end area of the tubular body, at least one opening running in radial direction is provided as an oil inlet to the dirt trapping part; that—by forming an annular gap space on the outer circumference of the upper end area of the tubular body—a sleeve-form collar is provided which is closed axially on the bottom and radially on the outside and opened axially on the top; and that the oil inlet discharges into the lower part of the annular gap space.

With the collar provided for this centrifuge, the partial oil flow introduced into the dirt trapping part will be uniformly distributed over the circumference of the dirt trapping part and slowed down in its speed. Thus will be achieved that a uniformly thick dirt particle cake will be formed in circumferential direction and that no flushing of dirt particles can occur from a dirt particle cake which already deposited on the inside of the dirt trapping part.

Another development of the free-jet centrifuge is characterized in that the drive part of the rotor is designed with a central tubular body which forms a shaft for the rotatable bearing of the rotor; that the tubular body is provided on bearings on the bottom and the top of housing parts of the centrifuge; that a friction bearing is provided as the lower bearing which is formed by a bearing bush inserted in the housing part located under the rotor and a bearing part inserted into the bearing bush provided on the bottom end of the tubular body; and that—as an upper bearing—a rolling bearing is provided which is arranged between the upper end of the tubular body and a housing part, especially cover, which is located above the rotor.

In this embodiment of the free-jet centrifuge, there is no stationary axis on which the rotor rotates but a shaft belonging to the rotor which is positioned in housing parts of the centrifuge housing. The bearing part inserted into the bottom end of the tubular body and the bearing bush inserted into the housing part located under the rotor are made of materials which provide a favorable sliding fit. The tubular body as such can thus be manufactured of another material, e.g. light metal, to obtain a drive part of the lowest possible weight.

A further development of the last described centrifuge proposes that the tubular body forming the shaft for the rotatable bearing of the rotor is provided with axial clearance and that the size of a lower front face of the tubular body or of the bearing part is dimensioned subject to the oil pressure prevailing during operation of the centrifuge such that an axial force caused by the oil pressure, acting on the rotor towards the top will be essentially equivalent to the axial weight force of the rotor acting towards the bottom. This development of the centrifuge achieves that during operation—i.e. with rotating rotor—the weight force of the rotor acting on the lower bearing will be reduced or even entirely neutralized. This will accordingly also reduce the axial forces acting in the lower bearing which will result in a higher rotor speed and a longer bearing service life at the specified drive power.

An alternative development of the above described centrifuge proposes that the drive part of the rotor is designed with a central tubular body which forms a shaft for the rotatable bearing of the rotor, and that the tubular body is run on bearings only on the bottom on a centrifuge housing part located under the rotor, by means of two bearings axially spaced from each other.

With this centrifuge, bearing of the rotor is exclusively provided on its underside so that an upper housing part of the centrifuge, especially its cover, need not be used for the bearing of the rotor. The required transverse stability of the bearing will be adequately ensured by the axial spacing of the two bearings provided under the rotor.

In a further development of the above explained centrifuge, it is proposed that the lower bearing is provided as a friction bearing which is formed by a bearing bush inserted into the housing part located under the rotor and by a bearing part provided on the lower end of the tubular body and inserted into the bearing bush; and that a rolling bearing is provided as an upper bearing which, seen in radial direction, is arranged between the bearing part of the tubular body and the housing part located under the rotor.

With this development of the bearing, all axial and radial forces occurring in the operation of the centrifuge can be absorbed reliably and with low friction and low wear. At the same time, a very compact design is here maintained as well.

Another embodiment of the free-jet centrifuge provides that the centrifuge is designed with a housing-stationary central axis, and the drive part of the rotor with a central tubular body surrounding the axis at a distance; that—through a ring channel between axis and tubular body—the lubricating oil to be cleaned can be fed to the dirt trapping part; and that—on the inner circumference of the tubular body—ribs running in axial direction are arranged, extending radially towards the inside into the annular gap space.

This centrifuge advantageously realizes that the partial oil flow which is supplied to the dirt trapping part of the rotor will be made to effectively rotate already on its way through the ring channel so that this partial oil flow—upon its passing over into the dirt trapping part—performs a rotation which conforms with the rotation of the rotor. In this manner, uniform charging of the dirt trapping part of the rotor will be achieved in circumferential direction. Especially in an embodiment of the dirt trapping part with these subdividing radial walls, uniform charging of the different chambers of the dirt trapping part between the individual radial walls will thus be ensured.

Another development of the free-jet centrifuge according to the invention proposes that the centrifuge is designed with a housing-stationary central axis, and the drive part of the rotor with a central tubular body surrounding the axis at a distance; that the lubricating oil can be fed to the centrifuge through a hollow lower section of the central axis; that—through a ring channel between axis and tubular body—a partial flow forming the lubricating oil to be cleaned can be fed to the dirt trapping part; that a friction bearing bush provided at the lower end of the tubular body is run on bearings on the hollow lower section of the central axis and that the upwardly directed front face of the bearing bush is designed as a valve seat for a valve body—axially movable in the tubular body, preloaded in closing direction—of a minimum pressure valve.

This centrifuge realizes a particularly compact arrangement of lower friction bearing and minimum pressure valve which is a contribution to a very compact design. In opened condition of the minimum pressure valve, its valve body is lifted off from the friction bearing bush so that its rotation together with the rotor will not be obstructed. When an associated internal combustion engine whose lubricating oil is cleaned in the free-jet centrifuge will be shut off, the oil flow through the centrifuge will end and the minimum pressure valve changes to its closed position. The valve body then comes to rest against the initially still rotating friction bearing bush and has a decelerating effect on it. This results in an advantageously short after-running period of the centrifuge rotor, thus avoiding the noise emissions connected with its rotation after shutting off the associated internal combustion engine.

An alternative embodiment of the free-jet centrifuge to the above described embodiment is characterized in that the centrifuge is designed with a housing-stationary central axis, and the drive part of the rotor with a central tubular body surrounding the axis at a distance; that the lubricating oil can be fed to the centrifuge through a hollow lower section of the central axis; that—through a ring channel between axis and tubular body—a partial flow forming the lubricating oil to be cleaned can be fed to the dirt trapping part; that a friction bearing bush provided at the lower end of the tubular body is run on bearings on the hollow lower section of the central axis; that the axis at the level of the upper end of the bearing bush comprises a radially outwardly projecting step; and that the upwardly directed front faces of the bearing bush and of the step are jointly designed as a valve seat for a valve body—axially movable in the tubular body, preloaded in closing direction—of a minimum pressure valve, with the valve body in its closed position sealingly covering a bearing gap between the axis and the bearing bush.

With this centrifuge, the function and the effect of the minimum pressure valve and its valve body are largely identical with the above described embodiment. Additionally, this alternative embodiment still has the advantage that, in closed condition of the minimum pressure valve, its valve body also seals tightly—aside from the oil flow paths to the drive part and to the dirt trapping part—the bearing gap between the friction bearing bush and the part of the axis bearing it. This will prevent that—with the closed minimum pressure valve—an oil flow will flow through the bearing gap if there is no need for lubrication there.

A further development of the two above described embodiments of the free-jet centrifuge provides that the valve body is hollow and carried on the axis; that the axis—in its area carrying the valve body—comprises a section of a larger outer diameter and above that a section of a smaller outer diameter, and that the valve body on its inner circumference comprises a sealing contour or a seal which seals off against the section of the larger outer diameter and has a radial distance to the section of the smaller outer diameter. In this development of the centrifuge, the valve body of the minimum pressure valve will seal off in its closed position against the bearing bush as well as against the axis. In its opened position, the valve body then releases a sufficiently large cross-section for the passage of the oil through the minimum pressure valve, with the oil being able to flow via a first flow path radially outside past the valve body and via a second flow path radially inside all through the valve body.

In accordance with a further development, a free-jet centrifuge is proposed which is characterized in that the means provided or applied in the centrifuge—which, in centrifuge operation, serve to prevent or restrict the axial mobility of the dirt trapping part relative to the drive part and which are detachable when the cover is removed—are formed by latching tongues with latching noses arranged on the dirt trapping part or on the drive part which are interacting with latching recesses provided on the drive part or on the dirt trapping part.

This latching connection between the dirt trapping part and the drive part provides in latched condition for the desired secure fixation of the two parts against each other in axial direction; however, it can be easily loosened, as needed, to separate the dirt trapping part from the drive part.

In this regard, a preferred further development provides that the latching tongues are provided on the top and radially inside, as well as downwardly directed on the dirt trapping part and the latching recesses being provided on the top and radially inside on the drive part. Openings which are here, for example, anyway provided in the drive part as an oil inlet into the dirt trapping part can simultaneously be used as latching recesses, thus resulting in an advantageous double function without additional components.

To preclude definitely that the above described latching connection is inadvertently loosened on its own, a further development proposes that the latching tongues are swiveling about a swivel axis; that the latching tongues are formed with an upwardly directed and protruding activation end; and that by swiveling the activation end radially towards the inside, the respectively associated latching tongue is swiveling with its latching nose radially outwardly and thus disengageable with its latching recess. Loosening of the latching connection is here possible only through the active actuation of the activation end of the latching tongues so that the intentional intervention by an operator will be required. As long as no forces are exerted on the activation end of the latching tongues, the connection between the dirt trapping part and the drive part will be securely maintained.

With all of the above described centrifuges, the dirt trapping part is separable from the drive part—to dispose of the dirt trapping part as such after a specified service period together with the dirt particle cake deposited therein. The dirt trapping part thus is a disposal part, whereas the drive part is a lifetime component of the centrifuge. To take this difference into account in the service period, it is preferably provided that the drive part consists of a metal, preferably of a light metal, such as aluminum or magnesium, and that the dirt trapping part consists of a plastic, preferably a thermoplastic, such as polyamide or polyethylene.

For an effective dirt separation from the lubricating oil, it is essential that the lubricating oil flows through the dirt trapping part radially the farthest outside because, there, the effective centrifugal forces are the greatest. However, it must be ensured at the same time that with the dirt particle cake increasingly growing radially from the outside to the inside, the flow of the lubricating oil into the dirt trapping part will not be affected by the dirt particle cake. In view thereof, it is proposed that in an upper area of the dirt trapping part from its center, upon rotation of the rotor in radial direction, outwardly pointing flexible hose arms or articulated tubular arms are provided as an oil inlet.

In a fresh dirt trapping part in which no dirt particle cake has deposited as yet or only a thin cake, the hose arms or tubular arms assume an essentially radial orientation upon rotation of the rotor due to the acting centrifugal force. Thus, the lubricating oil introduced through the hose or tubular arms flows relatively far outside radially out of the hose or tubular arms and into the dirt trapping part. With an increasingly radially inwardly growing dirt particle cake, the outer ends of the hose or tubular arms are moved inwardly in radial direction together with the inner surface of the dirt particle cake, with the inlet of the lubricating oil correspondingly moving along inwardly in radial direction into the interior of the dirt trapping part. Thus, the lubricating oil to be cleaned is always introduced into the dirt trapping part in the radially most outwardly possible position depending on the current dirt cake thickness.

An alternative solution to the above described centrifuge proposes a free-jet centrifuge which is characterized in that in an upper area of the dirt trapping part, from its center, outwardly extending rigid tubular arms are provided, with holes as an oil inlet provided over their length.

With this centrifuge, the tubular arms maintain their position and orientation independent of the rotation or standstill of the rotor and independent of the extent of the deposited dirt particle cake. However, due to the resulting centrifugal forces, the introduction of the major part of the lubricating oil to be cleaned preferably takes place through the respectively still free radially outermost opening of the tubular arms so that a similar effect is achieved as with the centrifuge described before.

BRIEF DESCRIPTION OF THE DRAWINGS

In the following, embodiments of the invention will be explained by means of drawings. The figures show.

DETAILED DESCRIPTION OF THE PREFERRED EMBODIMENTS

Figure 1:
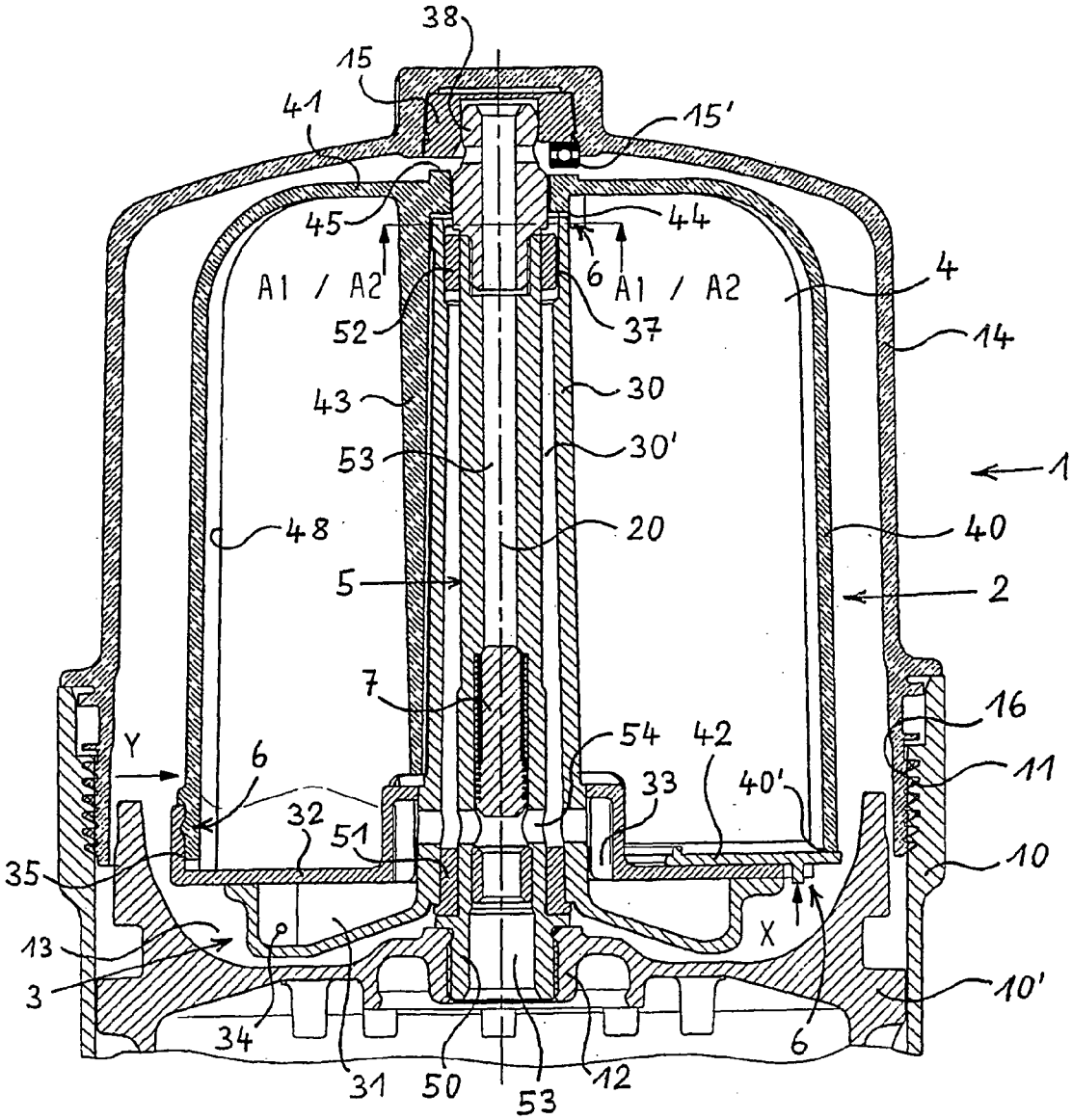
FIG. 1 a free-jet centrifuge in vertical section, with the left half of FIG. 1 showing a first embodiment and the right half of FIG. 2 showing a second embodiment.

The free-jet centrifuge 1 shown in FIG. 1 comprises a housing 10 which is closed on the upper side with a screwed cover 14. In housing 10, a housing part 10' is provided and fixed which carries an axis 5. On the axis 5, a rotor 2 is rotatably provided on bearings. For the detachable connection between housing 10 and cover 14, the housing 10 has an internal thread 11 and the cover 14 an external thread 16.

The housing part 10' provided in housing 10 has in its center an axis receiver 12 with an internal thread into which one threaded end 50 of the axis 5 is screwed in. The axis 5 extends upwardly through the entire rotor 2 up to the inside of cover 14. In its interior, axis 5 is hollow in design and comprises a central channel 53 there. Through channel 53, the lubricating oil to be cleaned is fed to the rotor 2. From the lower area of the central channel 53, two radial channels 54 branch off which lead via branching channels 33 within a nozzle bearing body 31 to two nozzles 34. Upon charging with pressurized lubricating oil, the nozzles 34 will drive rotor 2 by means of an ejected oil jet according to the recoil principle, with the rotor turning on axis 5 about the rotary axis 20.

The nozzle bearing body 31 is part of a drive part 3 of rotor 2. With the embodiment shown in FIG. 1, the drive part 3 furthermore comprises a bottom 32 which limits the nozzle bearing body 31 towards the top. Running around axis 5, the drive part 3 comprises a tubular body 30 which is positioned top and bottom on the axis 5 with the intermediate layer of two friction bearings 51, 52.

Between the inner circumference of the tubular body 30 and the outer circumference of axis 5, a ring channel 30' is formed through which lubricating oil is introducible into a dirt trapping part 4 of the rotor 2. At the upper end of the ring channel 30'—in the area of the upper friction bearing 52—a throttle point 37 is provided which ensures the feeding of a certain amount of oil at a specified pressure. The oil fed through arrives without pressure via an inlet 44 in the upper end area of the dirt trapping part 4. Alternatively, the inlet 44—instead of friction bearing 52—can form the throttle point 37.

After flowing through the dirt trapping part 4 from top to bottom, the lubricating oil exits through at least one outlet, not visible in FIG. 1, located axially on the bottom and radially inside, from the dirt trapping part 4 into an oil drain area 13 underneath the rotor 2. From the oil drain area 13, the centrifuged oil from the dirt trapping part 4 as well as the oil exiting from the nozzles 34 will flow off by the force of gravity, preferably into the oil pan of the associated internal combustion engine.

The rotor 2 is designed such that, with unscrewed cover 14, the dirt trapping part 4 with the dirt deposited therein can be removed from housing 10 by separating it from drive part 3. For this, drive part 3 is secured against axial pulling off towards the top by means of the safety 38 which is screwed into the upper end of the axis 5 and forms a part of axis 5. By a simple axial movement, the dirt trapping part 4 is separable from drive part 3 and, vice versa, connectable with drive part 3.

Figure 2A:
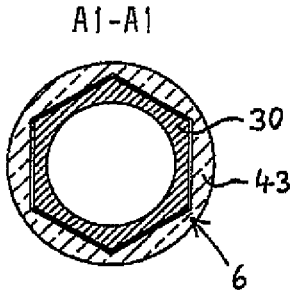
FIG. 2*a* and FIG. 2*b* two differently designed torque transmission means.
Figure 2B:
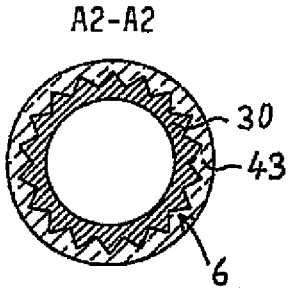

To transmit a rotary movement of the drive part 3 reliably onto the dirt trapping part 4, torque transmission means 6 are provided between these two parts 3 and 4. As needed, these torque transmission means 6 can be provided as single or multiple means and at different points as well. On the top of FIG. 1, in the contact area between the tubular body 30 and the dirt trapping part 4, first torque transmission means 6 are provided which can here have a multi-edge contour, as shown in FIG. 2*a*, or an indentation contour, as shown in FIG. 2*b* by way of example, or another suitable keyed contour.

Figure 3A:
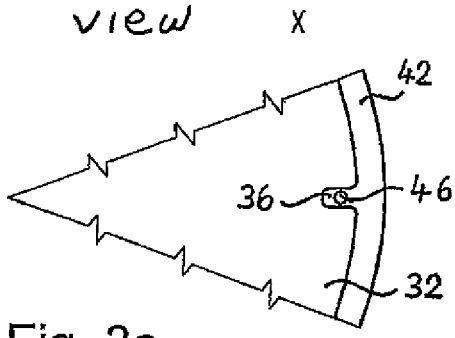
FIG. 3*a* and FIG. 3*b* two additional, modified torque transmission means.

On the bottom right of FIG. 1, second torque transmission means 6 are presented which are shown in FIG. 3*a* in a partial bottom view. Here, the torque transmission means 6 consist of a pin 46 extending downward from a bottom 42 of the dirt trapping part 4 and of a recess 36—receiving this pin 46—in the bottom 32 of the drive part 3.

Figure 3B:
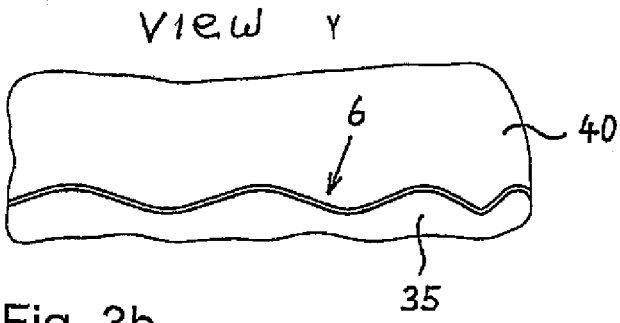

Another embodiment of torque transmission means 6 is shown on the bottom left in FIG. 1. Here, the lower end area of a radially outer peripheral wall 40 of the dirt trapping part 4 overlaps with a radially outer, upward directed marginal area 35 of the bottom 32 of the drive part 3. As FIG. 3*b* illustrates, the torque transmission means 6 are here formed by a wave contour as shown in FIG. 3*b* in a side view.

With the free-jet centrifuge according to FIG. 1, the axis, extended by safety 38 towards the top beyond the rotor 2, passes up into the cover whereby the axis is centered. In cover 14, the upper end of safety 38 is held by means of a metallic insert 15.

The left half of FIG. 1 presents the dirt trapping part 4 in a first embodiment. In this embodiment, the dirt trapping part 4 comprises the radially outer peripheral wall 40 as well as in a single piece therewith one upper wall 41 and one radially inner wall 43. The dirt trapping part 4 is here open towards the bottom. In the assembled condition of rotor 2, the dirt trapping part 4 is closed below by the bottom 32 of drive part 3.

In the embodiment of dirt trapping part 4 according to the right half of FIG. 1, it comprises—in a single piece with the radially outer peripheral wall 40—the upper wall 41 as well as a bottom 42 welded together with the lower front face of the peripheral wall 40. The weld seam between these two parts is designated by the reference number 40'.

In the operation of centrifuge 1, forces can occur which result in a movement of the rotor 2 towards the top. To take up these forces harmlessly, FIG. 1 presents on the top two different measures in the left half and in the right half. In the left half, the dirt trapping part 4 comprises axially on the top and radially inside a stop face 45 which—upon movement of the rotor 2—goes upward into sliding attachment to the underside of insert 15 in the cover 14.

As an alternative solution to the same problem, the right half of FIG. 1 presents an additional axial rolling bearing 15' which is applied on the underside of the cover 14 or on the insert 15 therein provided. Upon a movement of the rotor 2 towards the top, it attaches against the insert 15 or the rolling bearing 15' whereby axial forces can be discharged with low friction to the cover 14 and thereby to the housing 10.

Figure 2C:
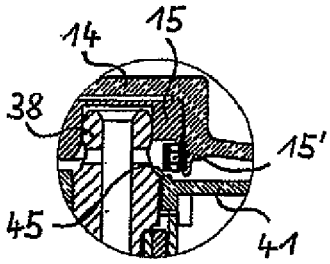
FIG. 2*c* a partial vertical section through the upper central end area of the centrifuge in a modification versus FIG. 1.

FIG. 2*c* presents, as a third solution to the same problem, an additional radial rolling bearing 15' also designed to take up axial forces, said bearing being attached on the underside of the cover 14 or on the insert 15 provided therein. Upon a movement of the rotor 2 towards the top, the upper wall 41 of the dirt trapping part 4 attaches with its upper side stop face 45 against the radially inner bearing ring of the radial rolling bearing 15' whereby axial forces can be discharged with low friction to the cover 14 and thereby to the housing 10.

As is shown now again in FIG. 1, guide and stiffener walls 48 are provided running in radial direction in the dirt trapping part 4 to make the oil in rotor 2 rotate without slip when the rotor 2 is accelerated and/or to take up the axial forces generated in the operation of the rotor 2.

Finally, the free-jet centrifuge 1 according to FIG. 1 also comprises in the axis 5 a minimum pressure starting valve 7 which is shown in its opening position in FIG. 1. Valve 7 assumes this opening position when a sufficiently high lubricating oil pressure is applied. Below a specifiable oil pressure, the valve assumes its closed position, and lubricating oil will not flow through the centrifuge 1 to ensure priority lubrication of the bearings of the internal combustion engine.

In opened condition of the valve 7, the lubricating oil passes from the bottom through the central channel 53 entirely through valve 7 and is thereafter divided into two partial flows. A first partial flow flows through the branch channels 33 to the nozzles 34 and thus drives the rotor 2 via its drive part 3. A second partial flow flows through the ring channel 30' in axial direction towards the top and arrives via the throttle point 37 under a pressure drop in the dirt trapping part 4. Thus, the dirt trapping part 4 is no longer under the high oil pressure generated by a feeding oil pump but must only take up the forces generated by the rotation which will relieve the rotor 2.

Figure 4A:
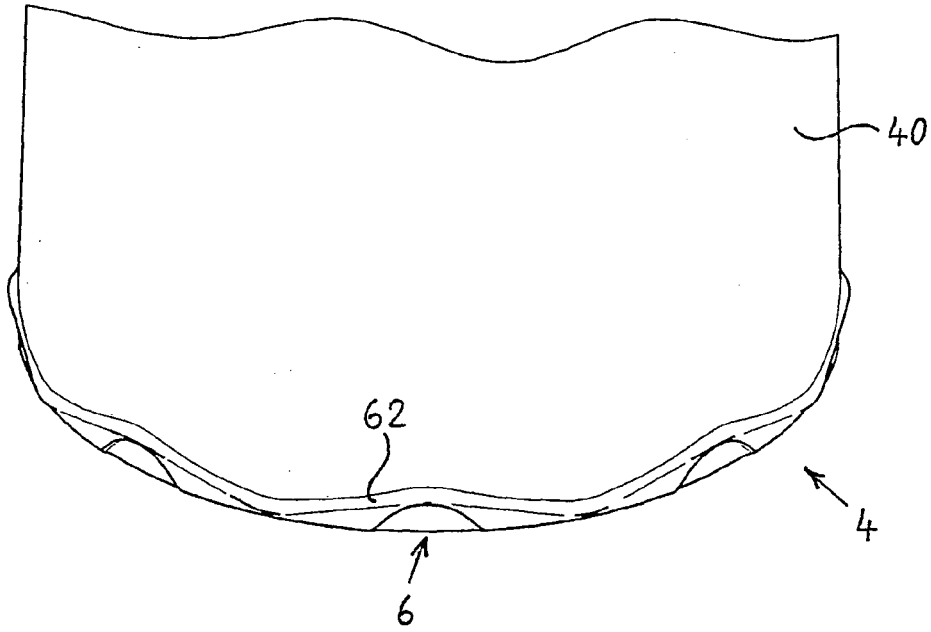
FIG. 4*a* a drive part and a dirt trapping part of the centrifuge before their connection with each other, in a perspective view.

FIG. 4*a* shows in a perspective view drive part 3 on the bottom and, on the top, a part of the dirt trapping part 4 before their assembly.

The drive part 3 consists of the upwardly extending tubular body 30 and the nozzle bearing body 31 which, in this embodiment, is formed on the upper side by the one-piece bottom 32. On the radially outer rim of the nozzle bearing body 31, the rim edging 35 of the bottom 32 is provided with its wave contour, forming the torque transmission means 6.

Of the dirt trapping part 4 in FIG. 4*a*, only its lower part is visible with one part of the peripheral wall 40. On the axially lower end of the peripheral wall, a waviness is integrally molded which fits with the waviness of the drive part 3 whereby the torque transmission means 6 are formed on the side of the dirt trapping part 4. For sealing between the drive part 3 and the dirt trapping part 4, a circumferential seal 62 is furthermore provided on the latter.

Figure 4A:
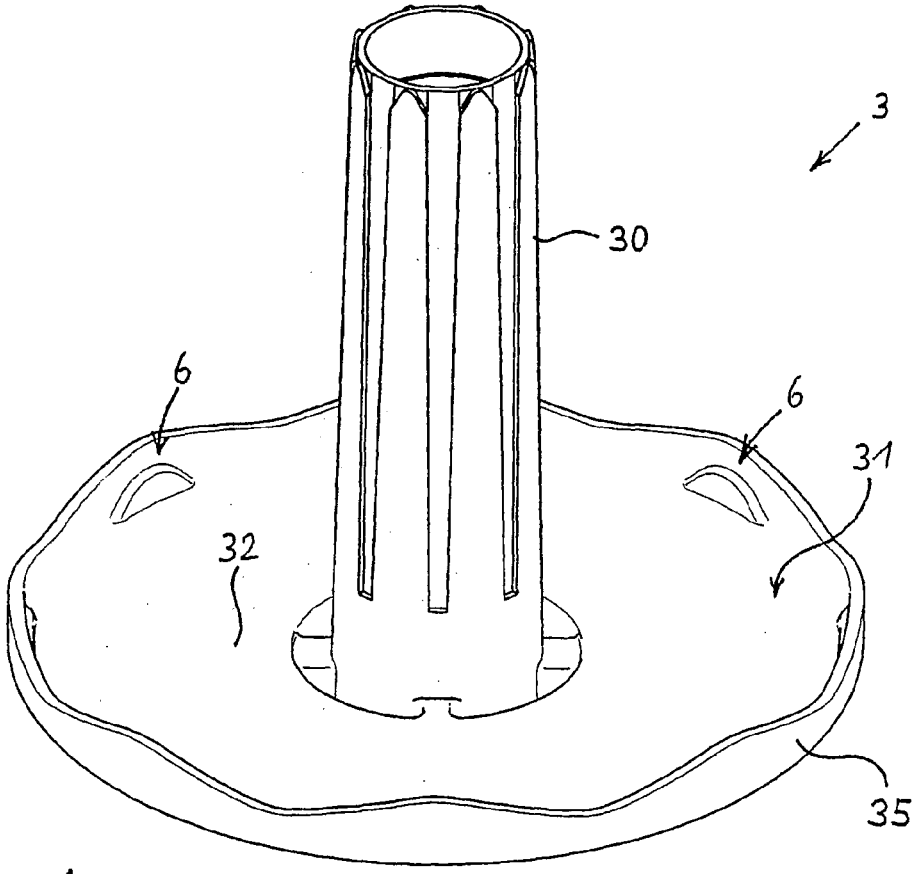
Figure 4B:
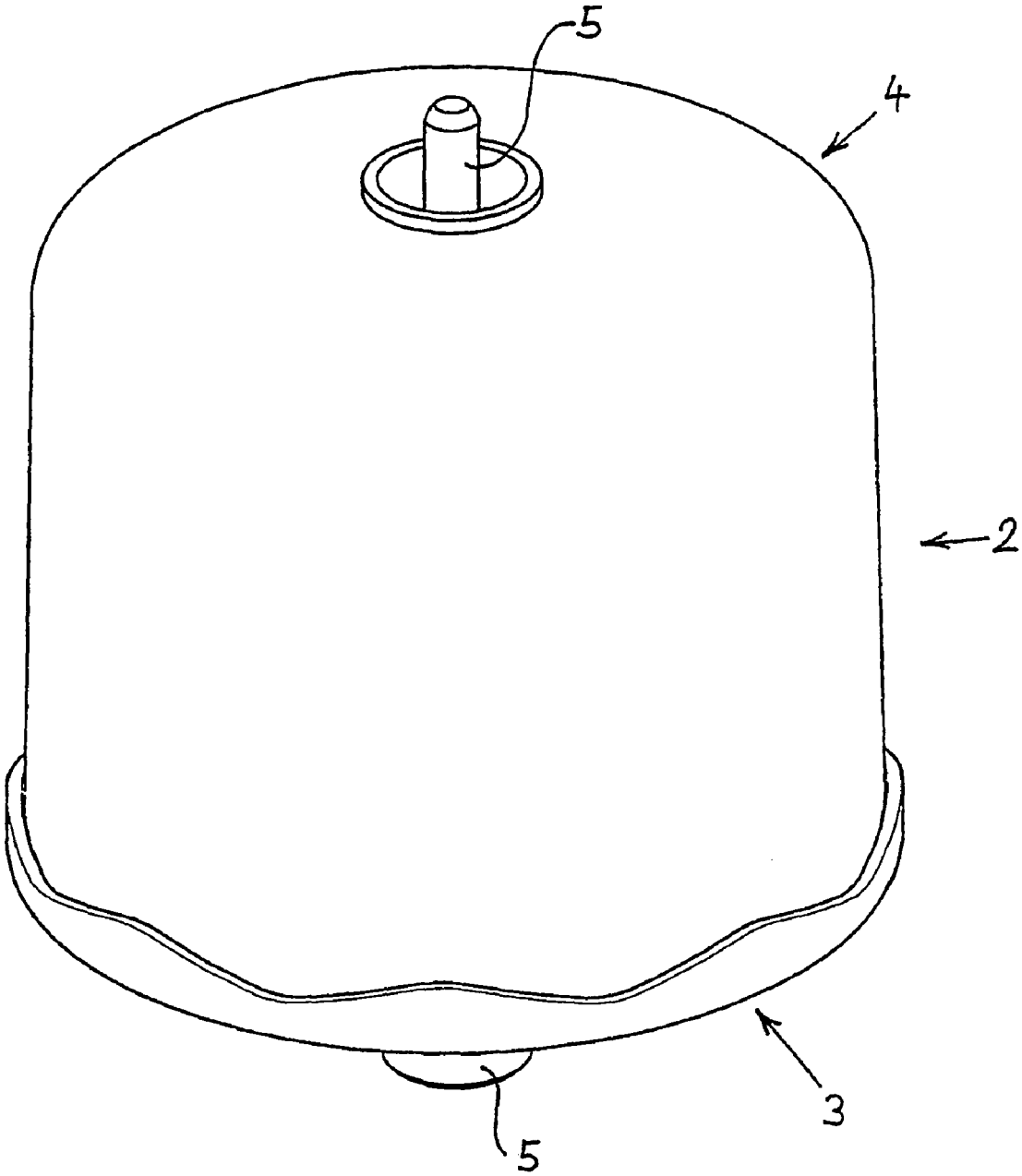
FIG. 4*b* the drive part and the dirt trapping part after their connection with each other to one complete rotor.

FIG. 4*b* shows the drive part 3 and the dirt trapping part 4 in their assembled condition to form the complete rotor 2. The now no longer visible torque transmission means 6 are engaged with each other; this engagement being achieved by simple axial joining of the drive part 3 and the dirt trapping part 4. At the very top and at the very bottom in FIG. 4*b*, one part each of the axis 5 is still visible.

Figure 5:
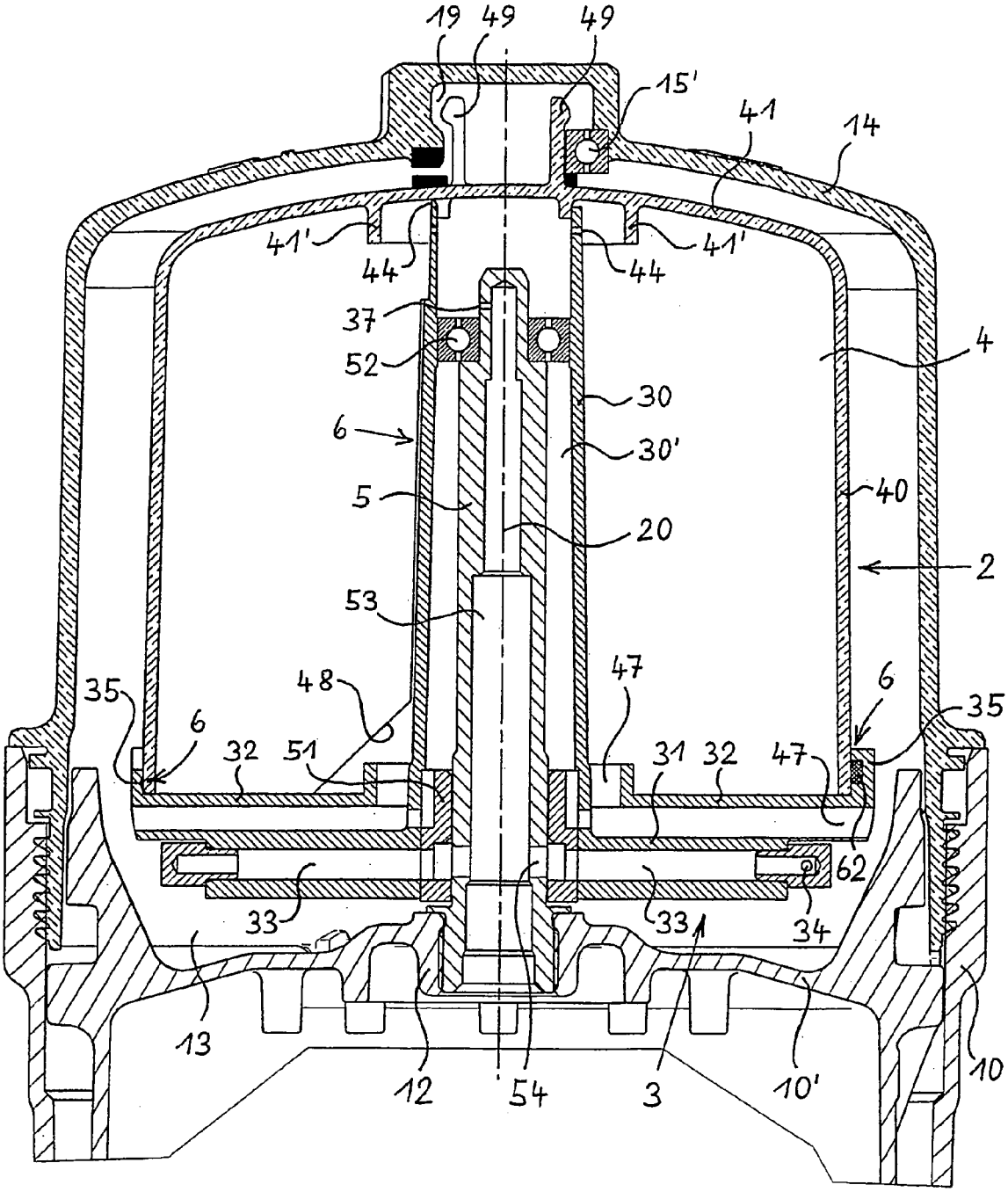
FIG. 5 another free-jet centrifuge in a vertical section, here too with one embodiment in the left half and another embodiment in the right half of the Figure.

FIG. 5 shows a free-jet centrifuge 1 in further embodiments; different embodiments being presented in the left and, respectively, right half of FIG. 5.

Here, the drive part 3 has the uniformly shape of a disk through which different channels are running. On the top of drive part 3, the dirt trapping part 4 is, here too, detachably set on; here again, a simple axial movement relative to each other being sufficient for engaging and disengaging the drive part 3 and the dirt trapping part 4.

Two branch channels 33 are running on the bottom through drive part 3 in opposite radial directions and leading at their end to one recoil nozzle 34 each which are used to drive the rotor 2 for the purpose of rotation around the rotary axis 20. Via the branch channels 33, additional channels are running through the drive part 3 predominantly in radial direction, said channels forming an outlet 47 for the centrifuged lubricating oil coming from the dirt trapping part 4. Towards the top, the nozzle bearing body 31 comprising the branch channels 33 and the channels for the outlet 47 is limited by a bottom 32. Moreover, here too, the tubular body 30 extends axially upward from the nozzle bearing body 31.

Here, the dirt trapping part 4 has the form of a bell open on the bottom with a radially outer peripheral wall 40 and an upper wall 41 here being closed.

For transmission of the driving torque from the drive part 3 to the dirt trapping part 4, torque transmission means 6 are here provided as well which may be arranged at different points. Similar to that already explained on the basis of the preceding FIGS. 4*a* and 4*b*, corresponding torque transmission means 6 can be provided in the axially lower, radially outer overlapping area between the peripheral wall 40 and the rim edging 35 of the bottom 32. If needed, a seal 62 can also be provided there. Another alternative for the torque transmission means 6 consists of guide and stiffener walls being provided within the dirt trapping part 4 to be used for the torque transmission. On their radially inner end, these walls 48 can form, with the outside of the tubular body 30, an engagement which transmits torques, said engagement being provided by axially sliding the dirt trapping part 4 onto the drive part 3 and the disengagement provided by a reverse axial movement.

In the examples according to FIG. 5, the free-jet centrifuge 1 comprises a housing 10 with a housing part 10' arranged therein. This housing part 10' comprises in its center an axis receiver 12 into which the axis 5 for rotor 2 is inserted with a bottom threaded end 50.

In this embodiment, the axis 5, running freely upward, extends through the major part of the height of the tubular body 30, with the axis 5 ending, however, within the rotor.

The dirt trapping part 4 can therefore also be designed with a closed upper wall 41, as mentioned before.

For bearing the drive part 3 on the axis 5, a friction bearing 51 is here used on the bottom and a rolling bearing 52 on the top.

For feeding the lubricating oil, a central channel 53 in the axis 5 is here used again. In the lower area of the channel 53, the radial channels 54 branch off from it which form a connection to the branch channels 33 in the nozzle bearing body 31 and feed the pressurized lubricating oil to the nozzles 34.

The channel 53 runs in the axis 5 towards the top, further up close to its upper end. There, a relatively small radial bore is located which forms a throttle point 37. Through this throttle point 37, a specifiable partial flow of lubricating oil arrives under pressure reduction at the inlets 44 and through these into the interior of the dirt trapping part 4 to be centrifuged there.

A small fraction of this partial flow flows from the area behind the throttle point 37, under the force of gravity, all through the rolling bearing 52 into the ring channel 30' and in it towards the bottom. On its lower end, the ring channel 30' is here in connection with the lubricating oil outlet 47 of the dirt trapping part 4, whereby the oil from the ring channel 30' and the oil from the dirt trapping part 4 will be jointly carried off into the oil area 13.

On the underside of the upper wall 41 of the dirt trapping part 4, a downwardly projecting collar 41' is integrally molded which is radially outside of the inlets 44. The collar 41' provides for a uniform distribution of the oil flow entering the dirt trapping part 4 in circumferential direction, to ensure the uniform depositing of dirt in the dirt trapping part 4 in its circumferential direction.

To take up the forces acting towards the top, two different measures are presented in the left and the right half of FIG. 5. On the left, two interacting stop faces are provided, with the stop face 45 being part of the upper wall 41 of the dirt trapping part 4 and the other stop face being part of a metallic insert 15 in the cover 14. As an alternative, the right half of FIG. 5 presents an additional rolling bearing 15' which is fastened, on the one hand, on the cover 14 and, on the other hand, is adjacent to the dirt trapping part 4 in the assembled condition of the centrifuge 1.

Finally, at the very top in its center, FIG. 5 also shows coupling means 49, here in the form of flexible snap hooks. Upon unscrewing of the cover 14, these coupling means 49 serve to also move the dirt trapping part 4 towards the top at the same time and to thus separate the dirt trapping part 4 from the drive part 3 without further measures. This achieves a particularly simple and clean handling.

Underneath the drive part 3, an oil drain area 13 is provided, here too, from which the lubricating oil exiting from the nozzles 34 and the lubricating oil coming from the outlet 47 flows off—without pressure and under the force of gravity—to the oil pan of the associated internal combustion engine.

Figure 6:
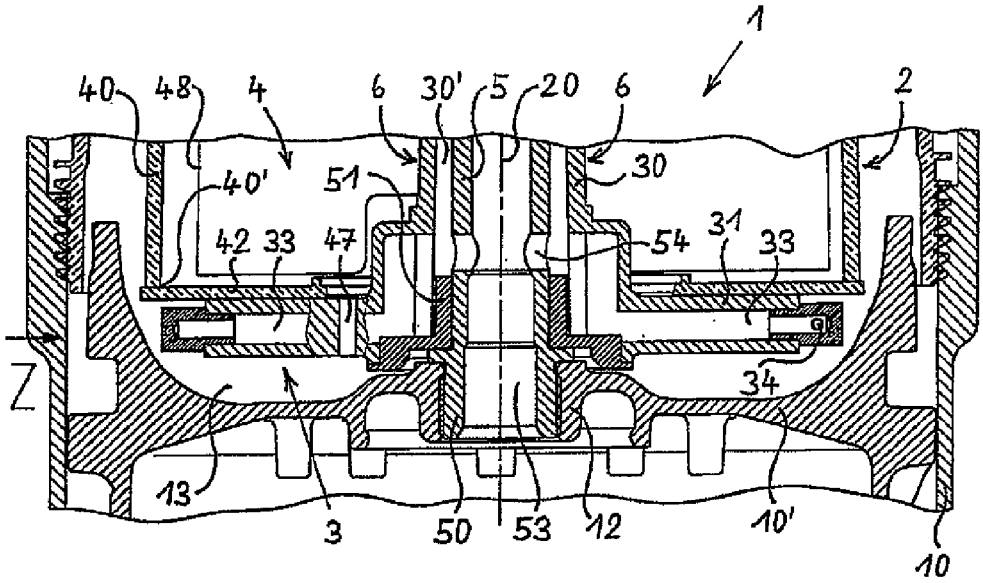
FIG. 6 a centrifuge in a partial vertical section through the area of its drive part.

FIG. 6 shows a modification of the free-jet centrifuge 1 of FIG. 5, which relates to the drive part 3. With the embodiment according to FIG. 6, the drive part 3 is flatter in design and now only comprises in its nozzle bearing body 31 the branch channels 33 for the supply of the nozzles 34. The outlet 47 for the centrifuged lubricating oil from the dirt trapping part 4 is here moved from the radial direction of the nozzle bearing body 31 into an axially more proximal course, with a greater height for the dirt trapping part 4 thus being available. Here, outlet 47 preferably comprises several parallel channels which are arranged in a distributed manner in circumferential direction, with FIG. 6 only showing one of them. Otherwise, the centrifuge 1 of which a segment is presented in FIG. 6 is identical with the embodiment according to FIG. 5.

Figure 7:
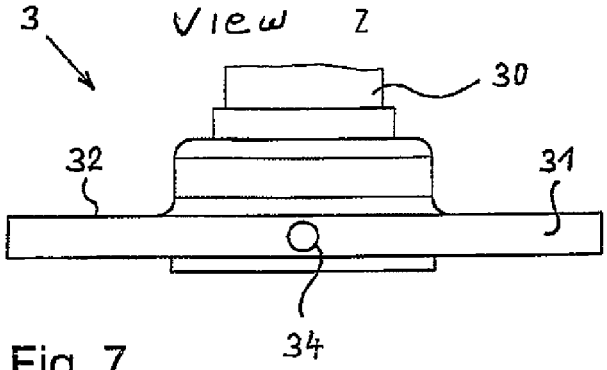
FIG. 7 the drive part of FIG. 6 in a side view.

FIG. 7 shows the drive part 3 of the centrifuge 1 of FIG. 6 in a view according to the line of vision Z in FIG. 6. On the bottom of FIG. 7, the nozzle bearing body 31 can be seen with the nozzle 34 facing the viewer. Towards the top, the nozzle bearing body 31 is limited by the flat bottom 32. From the nozzle bearing body 31, the tubular body 30 extends centrally towards the top, of which only a small part is presented here.

FIG. 8 again shows in a vertical section another free-jet centrifuge 1 with the characteristic that it has no stationary continuous axis. Much rather, the bearing of rotor 2 is here effected by means of two axis stubs which are connected with the drive part 3.

Here too, the drive part 3 comprises a nozzle bearing body 31 which now has the form of two radially outwardly and obliquely downwardly extending tubular arms. Through each arm, one of the branch channels 33 runs to one nozzle 34 each at the end of the arms. Here, the nozzle bearing body 31 is made of one piece or connected, e.g. welded with an upwardly extending tubular body 30. At the lower end of the tubular body 30, a first axis stub 5' is provided which is here formed by a pressed-in rotary part. On the upper end of the tubular body 30, an upper axis stub 5" is inserted.

The lower axis stub 5' is located in a lower friction bearing 51, with its axial mobility towards the top being restricted by a radially outwardly projecting shoulder arranged on the bottom, on the lower axis stub 5'. This accordingly restricts the axial mobility of the drive part 3 as a whole.

The upper axis stub 5" projects into an upper rolling bearing 52 which, in turn, is attached on cover 14 of the housing 10 of the centrifuge 1.

Here too, the dirt trapping part 4 is detachably connected with the drive part 3, connecting and detaching here again being effected simply by means of axial movements.

Here, the dirt trapping part 4 forms a hollow body consisting of two parts separately manufactured beforehand, with the two parts being permanently connected along a weld seam 40', e.g. by means of butt welding. The dirt trapping part 4 here comprises a radially outer peripheral wall 40, an upper wall 41 and a bottom 42. Radially inside, the dirt trapping part 4 is here designed without its own wall.

For transmitting the torque generated by the drive part 3 to the dirt trapping part 4, a special contour of the underside of the bottom 42 of dirt trapping part 4 is used. The bottom 42 is formed such that, seen in circumferential direction, it overreaches the arms of the nozzle bearing body 31.

Figure 8:
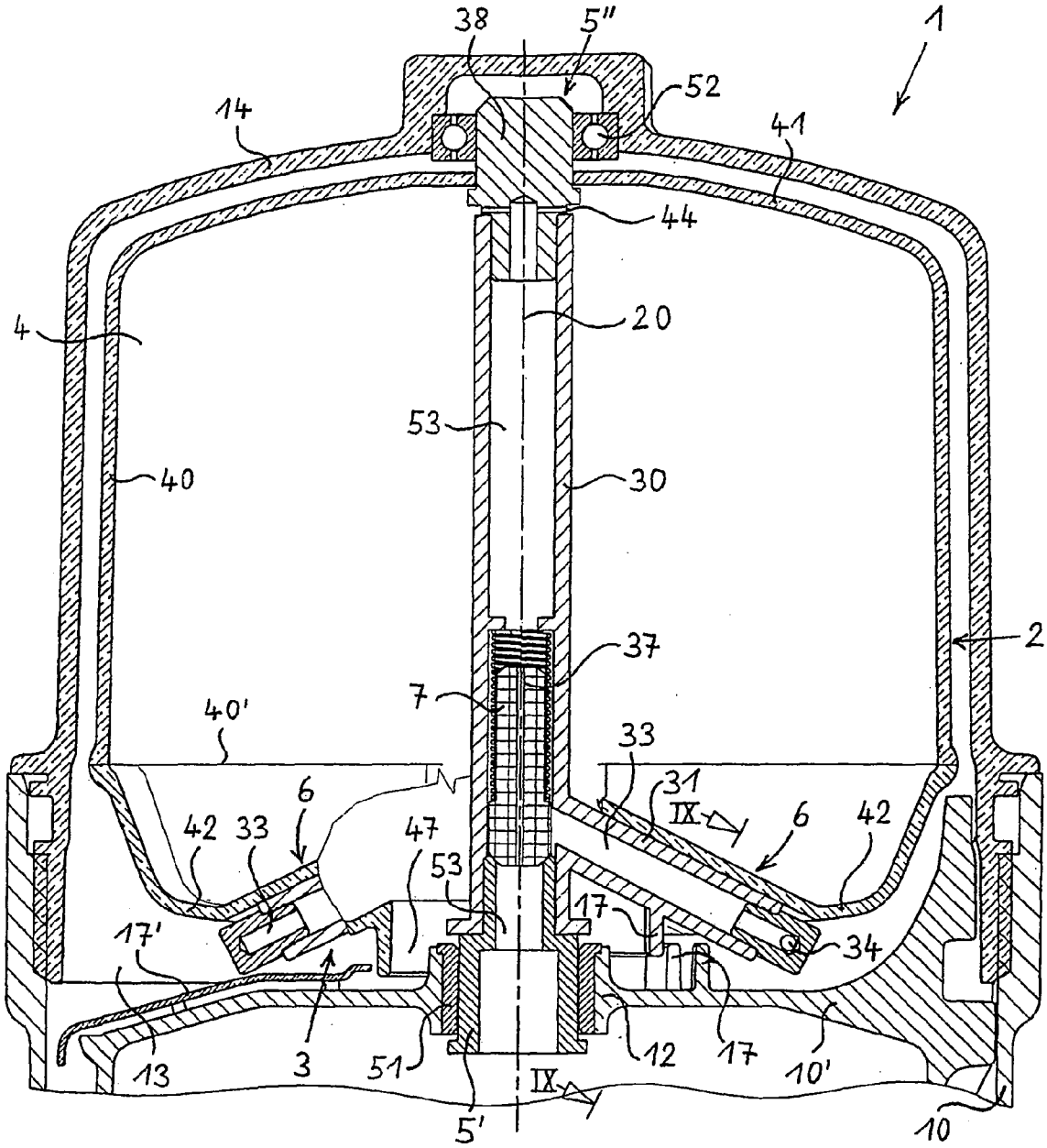
FIG. 8 another free-jet centrifuge in a vertical section.
Figure 9:
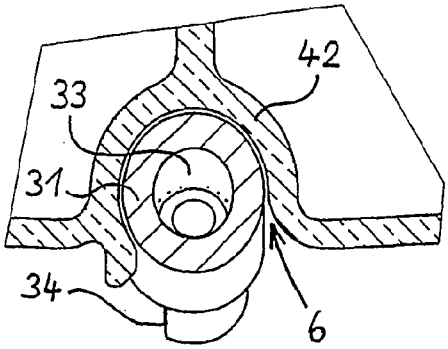
FIG. 9 a section through the centrifuge along line IX-IX in FIG. 8.

This forming and the interaction of the contours is evident in FIG. 9 which shows a partial section according to line IX-IX in FIG. 8. With the embodiment according to FIG. 9, a slight latching effect is additionally achieved, the dirt trapping part 4 thus being prevented from making an automatic movement towards the top, away from the drive part 3. At the same time, however, this latching connection remains very easily detachable by manual exertion of an axial tension force for the purpose of separating the dirt trapping part 4 from the drive part 3.

As now again shown in FIG. 8, the lubricating oil to be cleaned is supplied, here too, from the bottom through the central channel 53 which runs first through the lower axis stub 5'. Towards the top, following the axis stub 5', there is the minimum pressure starting valve 7 which is here shown in its closed position. In the open position, the lower area of the central channel 53 is connected with the branch channels 33 leading to the nozzles 34.

Through a valve body which forms the valve 7, a small channel is running in axial direction, the channel forming a throttle point 37 for the partial lubricating oil flow which is supplied to the dirt trapping part 4. After flowing through the throttle point 37, the lubricating oil to be centrifuged flows without pressure through the upper part of the channel 53 in the tubular body 30 towards the top and, from there, passes through inlets 44 into the upper area of the dirt trapping part 4.

The centrifuged lubricating oil leaves the dirt trapping part 4 radially inside and axially on the bottom through the outlet 47. In the right half of FIG. 8, in the area of the outlet 47, deflecting ribs 17 are presented, on the one hand, on drive part 3 and, on the other hand, on the housing part 10'. These ribs 17 take care that the oil flow coming from the outlet 47 is made more uniform so that the drive is not hampered by the oil jets exiting from the nozzles 43.

An alternative embodiment is presented on the bottom in the left half of FIG. 8. Here, a shielding disk 17' is built in—instead of the ribs 17—which runs parallel with the surface of the housing part 10' at a distance from its upper side. The centrifuged partial oil flow coming from the outlet 47 flows off below the shielding disk 17'; the oil jets exiting from the nozzles 34 impinge on the upper side of the shielding disk 17'; radially further outside and axially further down, the two oil flows then meet again and, combined, will be discharged from the oil drain area 13 to the oil pan of the associated internal combustion engine.

Figure 10:
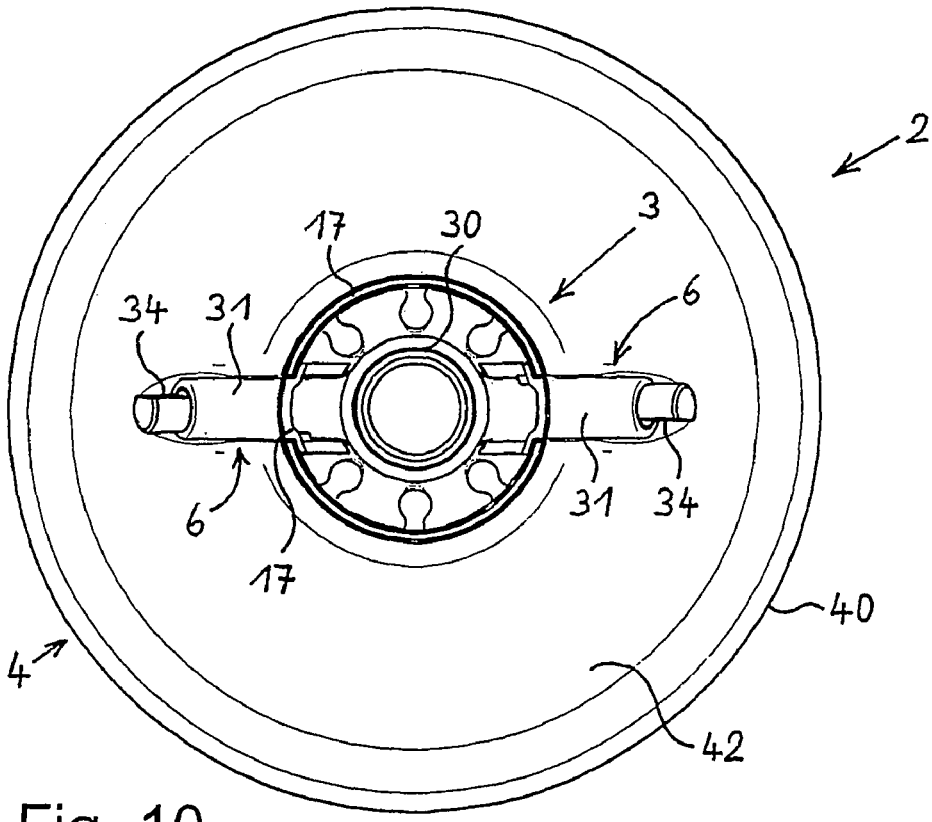
FIG. 10 the rotor of the free-jet centrifuge of FIG. 14 in a bottom view.
Figure 14:
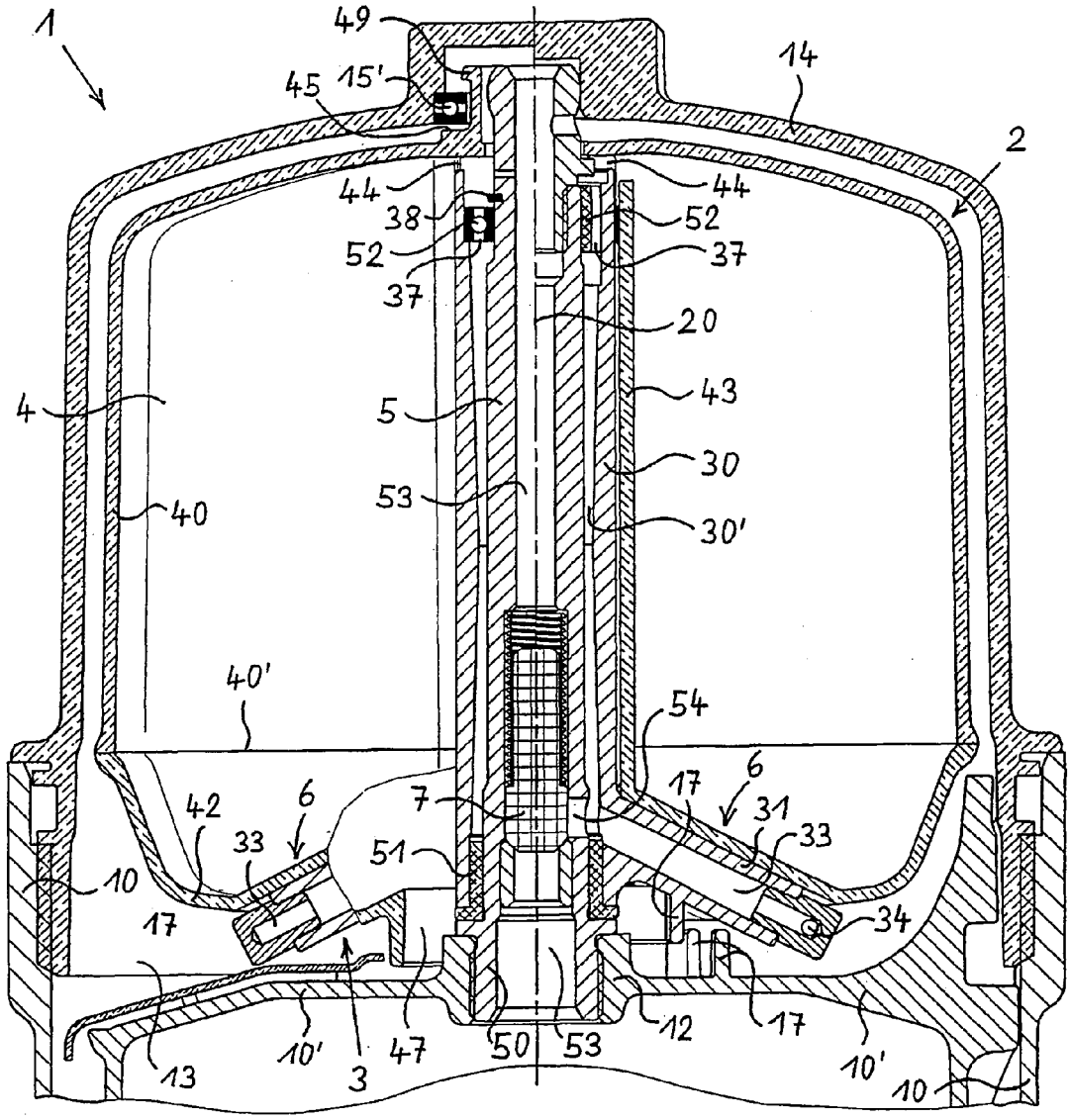
FIG. 14 a free-jet centrifuge again in vertical section and in two different embodiments in the left and in the right half of the Figure.

FIG. 10 shows the rotor 2 of FIG. 14 in a bottom view. Radially outside is the dirt trapping part 4 with its peripheral wall 40 and its bottom 42 now facing the viewer.

Farther inside, the drive part 3 can be seen. It comprises the tubular body 30 and leading out from it, the nozzle bearing body 31 in the form of two arms, with the recoil nozzles 34. The deflecting ribs 17 are running concentrically to the central tubular body.

The torque transmission means 6 are here formed—between the underside of the bottom 42 facing the viewer and the nozzle bearing body 31—by mutually overreaching contours which are engageable and disengageable through movement in axial direction relative to each other.

Figure 11:
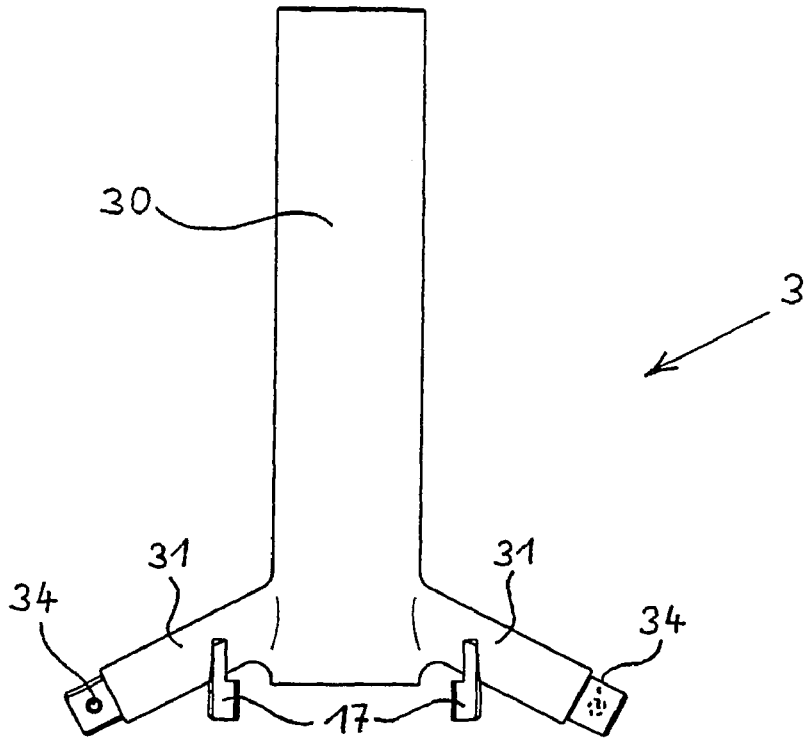
FIG. 11 the drive part of the rotor of FIG. 10 in a side view.

FIG. 11 shows the drive part 3 from FIG. 8 and FIG. 10 now by itself in a side view. The central part of the drive part 3 is formed by the upwardly extending tubular body 30. On the bottom, two arms extend from it towards the left and the right which are forming the nozzle bearing body 31. On the radially outer end of the nozzle bearing body 31, the two recoil nozzles 34 are visible. Furthermore, from the nozzle bearing body 31, a short section each of the deflecting ribs 17 extends towards the bottom. In the assembled condition of drive part 3 and dirt trapping part 4, the deflecting ribs 17 on the drive part 3 are complemented with the deflecting ribs 17 on the bottom 42 of the dirt trapping part 4 to the closed rim of deflecting ribs 17 visible in FIG. 10. To avoid leakages in the contact area, the rib contours are there overlapping in design.

Figure 12:
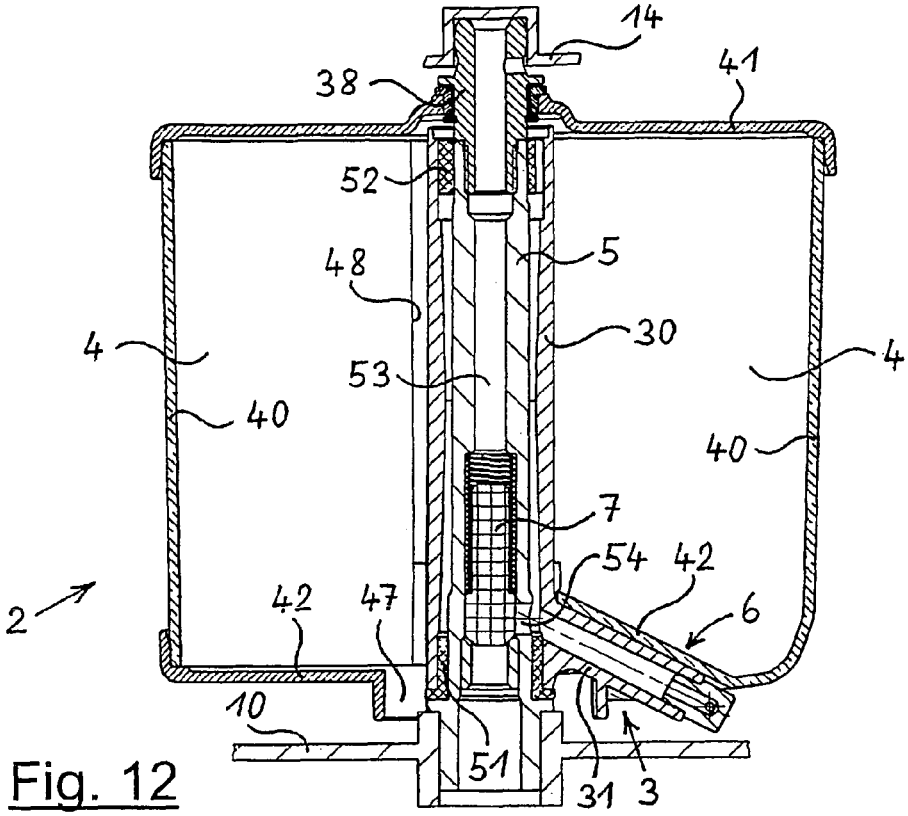
FIG. 12 a free-jet centrifuge in vertical section, with two differently designed dirt trapping parts which are shown in the left half and in the right half of the Figure.

FIG. 12 shows a rotor with two differently designed dirt trapping parts which are each presented in the left and, respectively, the right half of FIG. 12. In the left half of FIG. 12, the dirt trapping part 4 comprises a radially outer peripheral wall 40. On top, the dirt trapping part 4 is closed by an own cover 41 which overreaches the peripheral wall 40 radially outside. In a similar manner, the dirt trapping part 4 is closed, on the bottom, by a separate bottom 42; here radially inside, the outlet 47 for the centrifuged lubricating oil is kept open. On the inside of the dirt trapping part 4, radially extending guide and stiffener walls 48 are provided which are, for example, connected with the peripheral wall 40 or are of one piece. Radially inside, the dirt trapping part 4 has no own wall.

In the right half of FIG. 12, the dirt trapping part 4 again comprises a radially outer peripheral wall 40 which is here, however, designed of one piece with the bottom 42. On the upper side, the dirt trapping part 4 is closed, here too, by its own cover 41.

With an intermediate layer of two friction bearings 51, 52, the drive part 3 here sits on a permanently mounted axis 5 which passes the entire rotor 2. The drive part 3 is again combined of the tubular body 30 and a nozzle bearing body 31, here in the form of two outwardly extending arms of which only one arm is shown in FIG. 12.

The torque transmission means 6 can here be designed as already described on the basis of FIGS. 8 and 9.

In the axis 5, a minimum pressure starting valve 7 is provided here as well which allows an oil flow through the rotor 2 only at a certain minimum pressure. The oil flow is blocked in the closed position of valve 7 shown in FIG. 12.

On the very bottom of FIG. 12, a small part of the housing 10 is visible which carries the axis 5. On the very top of FIG. 12, a small segment of the cover 14 is presented in which the upper end of axis 5 is centered.

Figure 13:
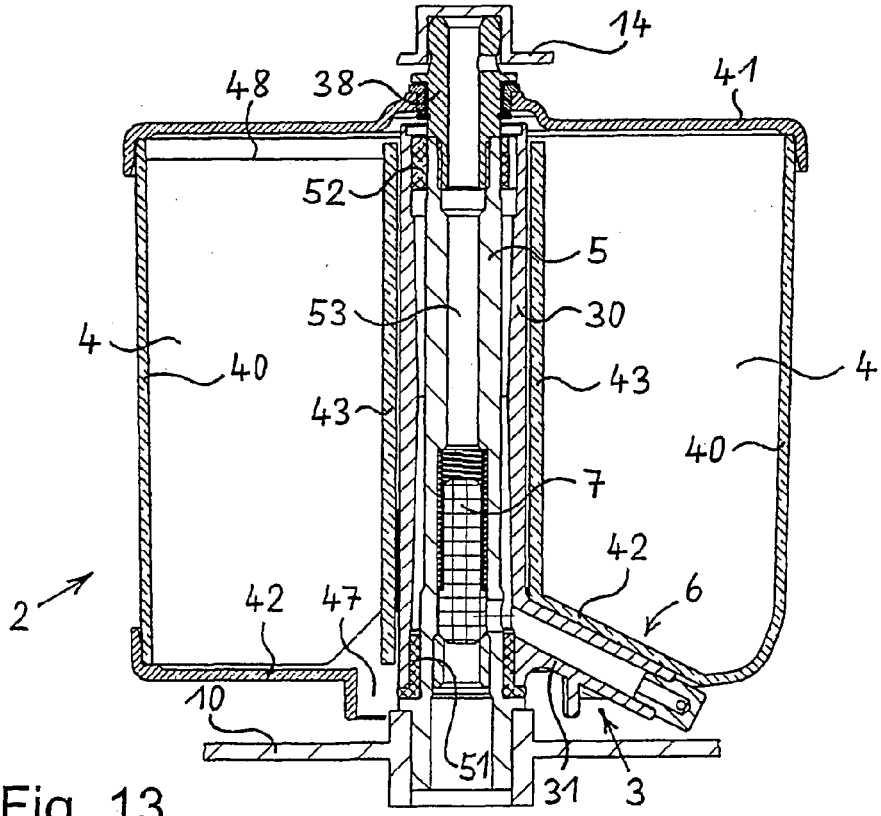
FIG. 13 a free-jet centrifuge also in vertical section, with two other differently designed dirt trapping parts in the left and the right half of the Figure.

In the same presentation as in FIG. 12, FIG. 13 shows two further embodiments of the dirt trapping part 4. Here, the dirt trapping parts 4—shown in the left and the right half of FIG. 13—essentially correspond with the dirt trapping parts 4 shown in the left and the right half of FIG. 12, with the difference that, in the embodiments according to FIG. 13, the dirt trapping part 4 each comprises still its own radially inner wall 43.

The embodiment of the dirt trapping part 4, shown in the left half of FIG. 13, comprises the radially inner wall 43 as well—in addition to the radially outer peripheral wall and the upper cover 41 and the bottom 42. Walls 40 and 43 are connected with each other via the radially extending guide and stiffener walls 48.

The embodiment of the dirt trapping part 4, presented in the right half of FIG. 13, comprises a peripheral wall 40 and, in one piece therewith, a bottom 42 and the radially inner wall 43. Here too, a separate cover 41 is provided on the top.

The torque transmission means 6 are here again designed according to the embodiment in accordance with FIGS. 8 and 9.

In all embodiments which are shown in FIGS. 12 and 13, the bearing of the rotor 2 is provided by means of one lower friction bearing 51 and upper friction bearing 52 each which are provided each between axis 5 and drive part 3.

Also in all embodiments according to FIGS. 12 and 13, after removal of the screwed cover 14—here only outlined—and after loosening a safety connected with the upper end of the axis 5, the dirt trapping part 4 is separable towards the top from the drive part 3 by an axial movement for the purpose of disposal.

In its left and right half, FIG. 14 shows two further embodiments of the free-jet centrifuge 1 which partly correspond with the embodiment according to FIG. 8. The major difference consists of another bearing of the rotor 2 which is provided in FIG. 14 on a continuous axis 5 which extends entirely through the rotor 2 to the cover 14 of the housing 10. Here, the axis 5 is retained with a lower threaded end 50 in a central axis receiver 12 in the housing part 10' of the housing 10.

Here again, the drive part 3 comprises a central, upwardly extending tubular body 30 and a nozzle bearing body 31 having the form of two arms with branch channels 33 and nozzles 34. The drive part 3 is provided on the axis 5 on the bottom by means of a friction bearing 51 and on the top alternatively either by means of an upper friction bearing 52 or an upper rolling bearing 52.

The dirt trapping part 4 is here again formed of two individual parts welded together along a weld seam 40', preferably injection molded parts of plastic, the dirt trapping part 4 in the left half of FIG. 14 being formed without a radially inner wall and in the right half of FIG. 14 with a radially inner wall 43.

In the central channel 53 of the axis 5, a minimum pressure starting valve 7 is here again provided which is shown in FIG. 14 in closed position. In the open position, lubricating oil passes—through the lower area of the central channel 53, past valve 7, through the radial channel 54, on the one hand—into the branch channels 33 to the nozzles 34 and, on the other hand, into the ring channel 30' between the inner circumference of the tubular body 30 and the outer circumference of the axis 5. This second partial flow flowing through the ring channel 30' arrives, past the upper bearing 52 through the upper inlet 44 throttled, in the interior of the dirt trapping part 4 and is centrifuged there. Since the hydraulic pressure of the partial flow is already relieved on the way to the dirt trapping part 4, here again, the dirt trapping part 4 is only subject to the forces generated by the centrifugal force during the rotation.

On the very top in FIG. 14, the right half presents a simple centering of the upper end of the axis 5 in the cover 14.

The left half of FIG. 14 shows on the very top an embodiment which provides coupling means 49 to separate the dirt trapping part 4 from the drive part 3 and also move it along towards the top, without further measures, upon loosening the screwed cover 14.

To accept upwardly directed forces acting upon the rotor 2, an additional rolling bearing 15' is provided in the left half of FIG. 14 on the top between the cover 14 and the upper wall 41 of the dirt trapping part 4.

Below the drive part 3, FIG. 14 alternatively shows, on the right, deflecting ribs 17 and, on the left, a shielding disk 17' which were already explained by means of FIG. 8.

Figure 15:
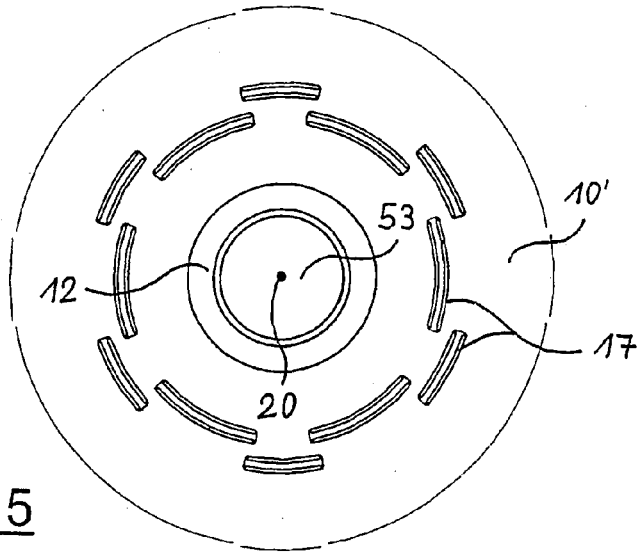
FIG. 15 a housing part, located under the rotor, of the free-jet centrifuge of FIG. 14 in a top view.

FIG. 15 shows a top view onto the central area of the housing part 10' from the right half of FIG. 14 which is located under the rotor 2. Here, the arrangement of the deflecting ribs 17 on the housing part 10' is especially evident. In the center of FIG. 15, the central channel 53 is visible which is surrounded by the axis receiver 12 into which the axis 5 is here not inserted.

Figure 16:
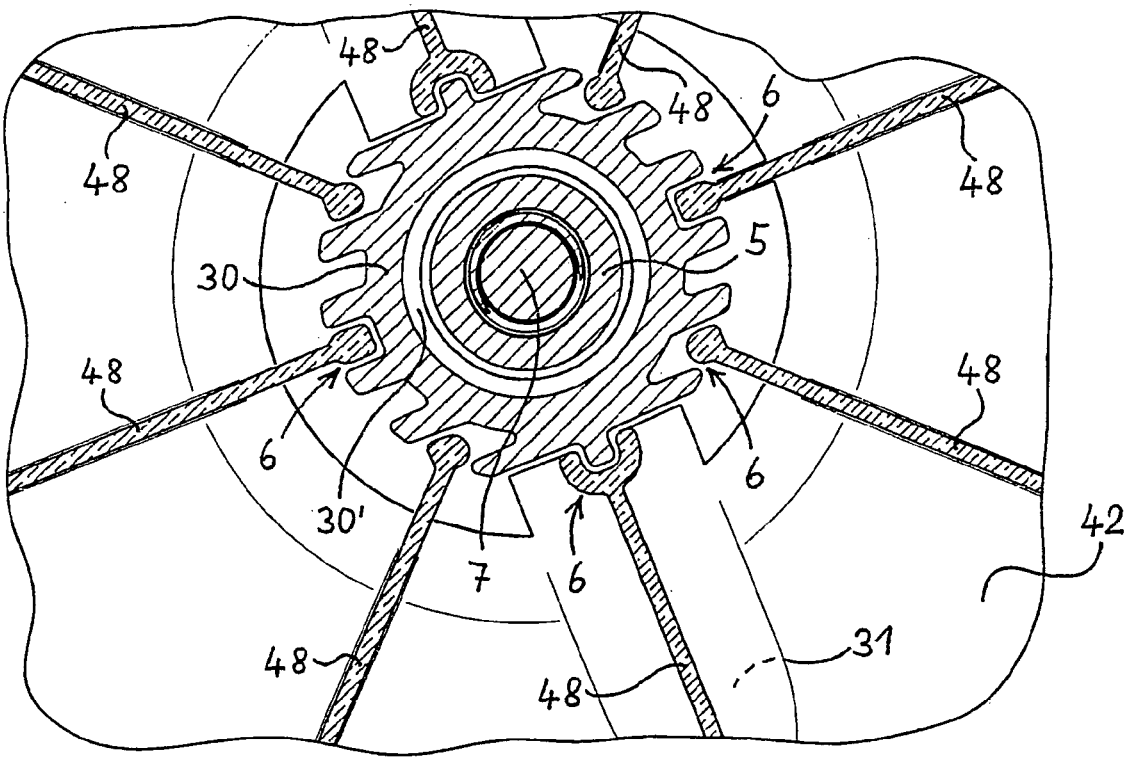
FIG. 16 a partial horizontal section through a free-jet centrifuge.

FIG. 16 shows a first example for the arrangement and the design of the torque transmission means 6 radially inside between the tubular body 30 and the radially extending guide and stiffener walls 48 of the dirt trapping part 4. For this, the tubular body 30 is designed with outwardly open grooves which each accept in themselves the radial inner end of the walls 48. Thus, a torque generated by the drive part 3 can be transmitted by the tubular body 30, via the walls 48 engaged with it, to the dirt trapping part 4. At the same time, FIG. 16 illustrates that, here too, engaging and disengaging between the tubular body 30 and the walls 48 can simply be effected by an axial movement of the dirt trapping part 4 relative to the drive part 3. Here, the tubular body 30 can simply be deformed, if manufactured as a die cast part, on its outer circumference in two opposite radial directions.

In the very center of FIG. 16, the axis 5 is still visible with the valve 7 provided therein. Between the outer circumference of the axis 5 and the inner circumference of the tubular body 30, the ring channel 30' is provided for the supply of lubricating oil to the dirt trapping part 4.

The background of FIG. 16 shows the bottom 42 of the dirt trapping part 4. The nozzle bearing body 31 is provided under this bottom 42.

Figure 17:
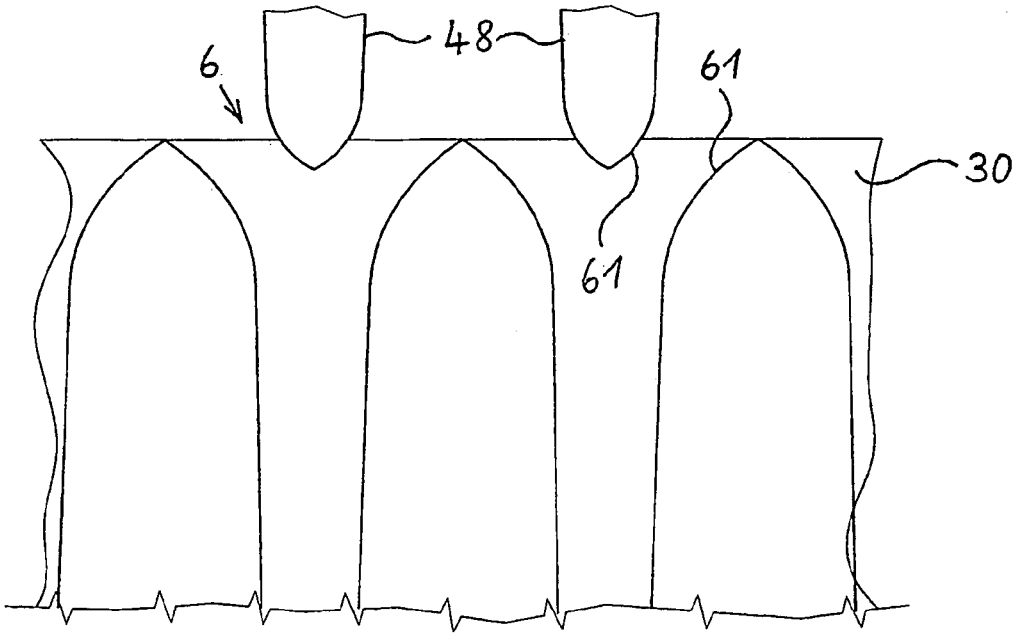
FIG. 17 a segment of a developed view of the torque transmission means of FIG. 18.

On the basis of a partially developed view, FIG. 17 shows the torque transmission means 6 of FIG. 16. It is here particularly evident that the torque transmission means 6 are each designed with lead-in points and/or lead-in slopes 61 whereby the torque transmission means are self-finding when they are being joined.

Figure 18:
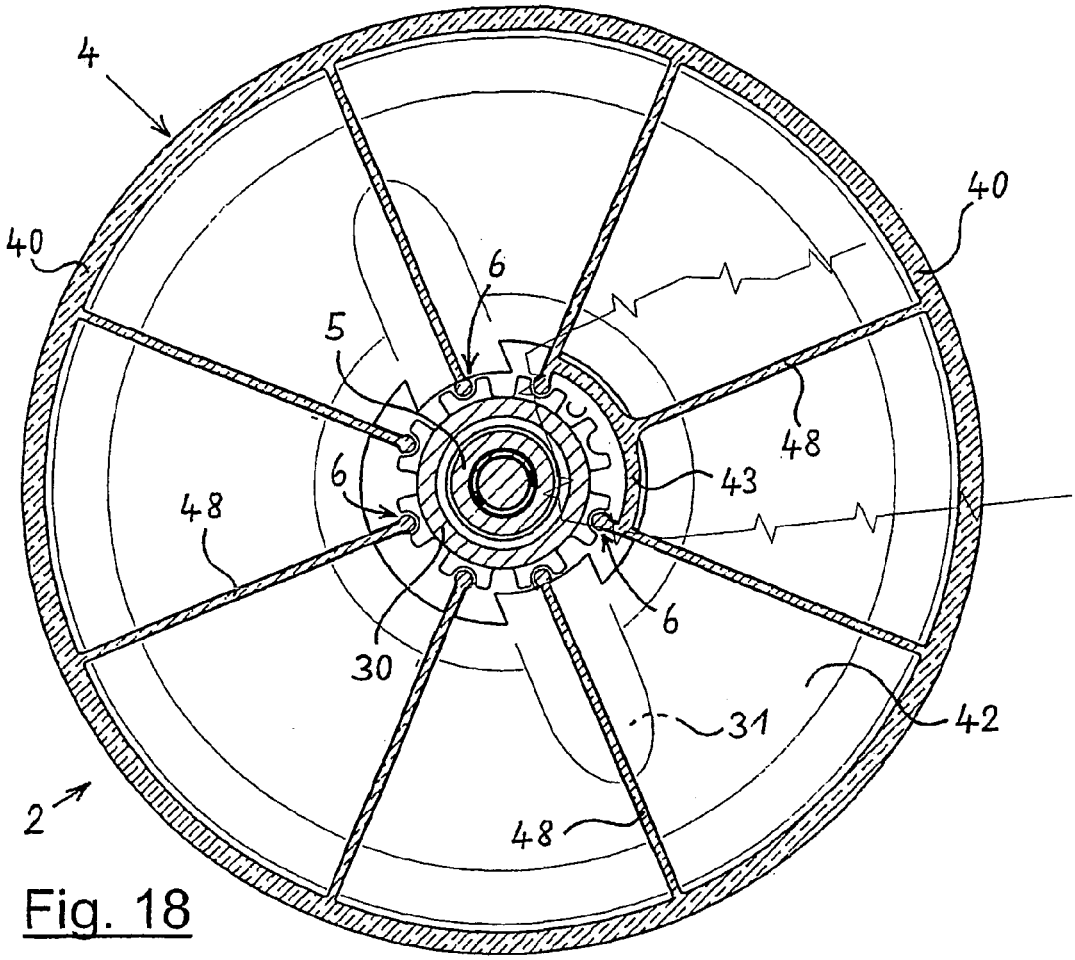
FIG. 18 a free-jet centrifuge in a horizontal section, with two differently designed dirt trapping parts and torque transmission means.

FIG. 18 shows two alternative further developments for the embodiment according to FIG. 16. In the left part of FIG. 18, the dirt trapping part 4 is designed with a radially outer peripheral wall 40 and with radially extending guide and stiffener walls 48. Together with the grooves provided on the tubular body 30, the radially inner end of the walls 48 will each form the torque transmission means 6.

In a broken-off segment on the right in FIG. 18, the dirt trapping part 4 is additionally designed with a radially inner wall 43 which is connected via the radially extending walls 48 with the radially outer peripheral wall 40. In this embodiment, every second radially extending wall 48 projects radially inwardly beyond the radially inner wall 43 and is there engaged with axial grooves on the tubular body 30 to form the torque transmission means 6.

In the two embodiments according to FIG. 18, the torque transmission means 6 can also be engaged and disengaged by a simple axial movement of the dirt trapping part 4 relative to the drive part 3.

Figure 19:
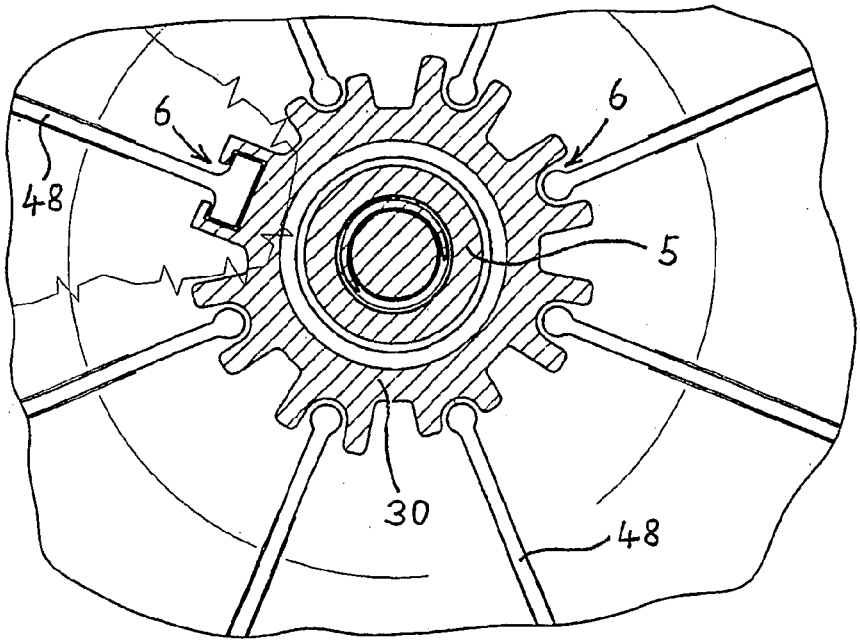
FIG. 19 a free-jet centrifuge in a horizontal section with a modified embodiment of the torque transmission means.

FIG. 19 shows yet another modification of the torque transmission means 6 according to FIGS. 16 and 18. The modification according to FIG. 19 is shown broken-out in the top left of this Figure. Here, the torque transmission means 6 are designed in the form of tongue-and-groove with an undercut. In this embodiment, forces acting from the inside to the outside in radial direction can be discharged from the walls 48 to the tubular body 30. At the same time, it remains possible to engage and disengage the torque transmission means 6 by axial movement of the dirt trapping part 4 relative to the drive part 3.

Figure 20:
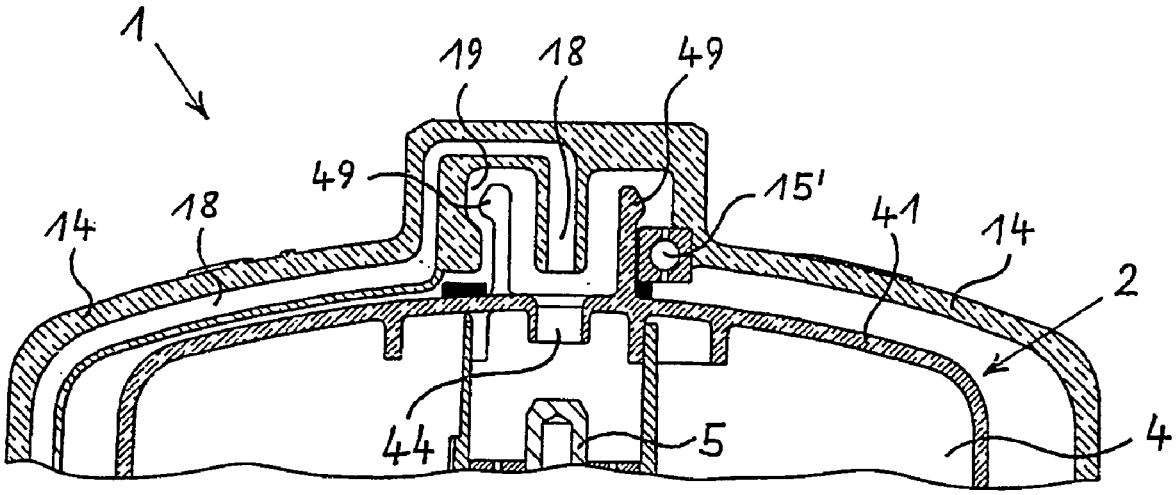
FIG. 20 a partial vertical section through the upper end area of a free-jet centrifuge, with two different embodiments in the left and the right half of the Figure.

In a partial vertical section through the upper area of centrifuge 1, FIG. 20 shows a modification of the centrifuge 1 of FIG. 5. The modification consists of providing the supply of the partial lubricating oil flow to be centrifuged from the top, with the centrifuge 1 according to FIG. 20. For this, a feed channel 18 is formed in the screwed cover 14 which, coming from the bottom, runs parallel to the surface of the cover 14 and, in the center of the cover 14, discharges in downward direction towards the dirt trapping part 4.

The dirt trapping part 4 here comprises a radially outer peripheral wall 40 as well as an upper wall 41 which comprises in its center an inlet 44 which, seen in axial direction, is exactly opposite the discharge of channel 18. With the supply of the lubricating oil to be centrifuged through the channel 18, the lubricating oil flows from the cover-side end of the channel 18 in vertical direction from the top to the bottom through the inlet 44 into the interior of the dirt trapping part 4.

In the other visible parts in FIG. 20, the centrifuge 1 is identical with the embodiment according to FIG. 5.

Figure 21:
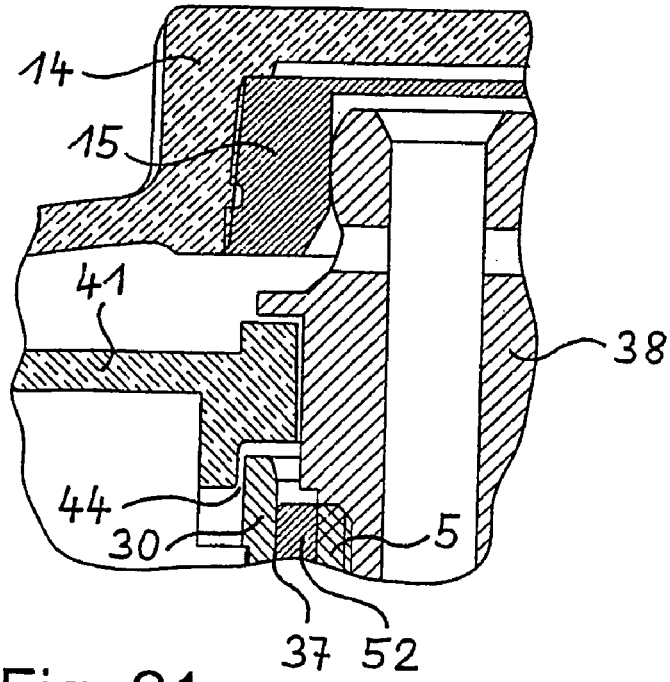
FIG. 21 a partial vertical section through another embodiment of the free-jet centrifuge in the area of its upper central end area.

In an enlarged sectional presentation, FIG. 21 shows a segment from the upper area of a centrifuge. On the right in FIG. 21, the safety 38 is visible which is screwed, as a separate component, into the upper end of the axis 5. The safety 38 ensures that the dirt trapping part 4 of which only its upper wall 41 is visible here cannot move towards the top relative to the drive part 3 during the operation of the centrifuge.

Of the drive part 3, FIG. 21 shows only the upper end area of the tubular body 30. Between it and the axis 5, the upper friction bearing 52 is provided. The friction bearing 52 has—in relation to the tubular body 30—such a gap measure that the bearing gap forms the desired throttle point 37 for the oil flow to the dirt trapping part. In throttle point 37, the oil pressure of the partial oil flow is relieved which flows to the dirt trapping part 4. Thereafter, the oil flows without pressure through the inlet 44 into the interior of the dirt trapping part 4.

For centering the axis 5, an upper end area of the safety 38 is provided centered in an insert 15 of metal which, in turn, is centrically inserted into the screwed cover 14 made of plastic.

Aside from the screwed cover 14, the dirt trapping part 4 with its individual parts is also preferably made of plastic to be able to manufacture the dirt trapping part 4 inexpensively and to dispose of it in an environmentally acceptable manner, preferably by combustion.

Figure 22:
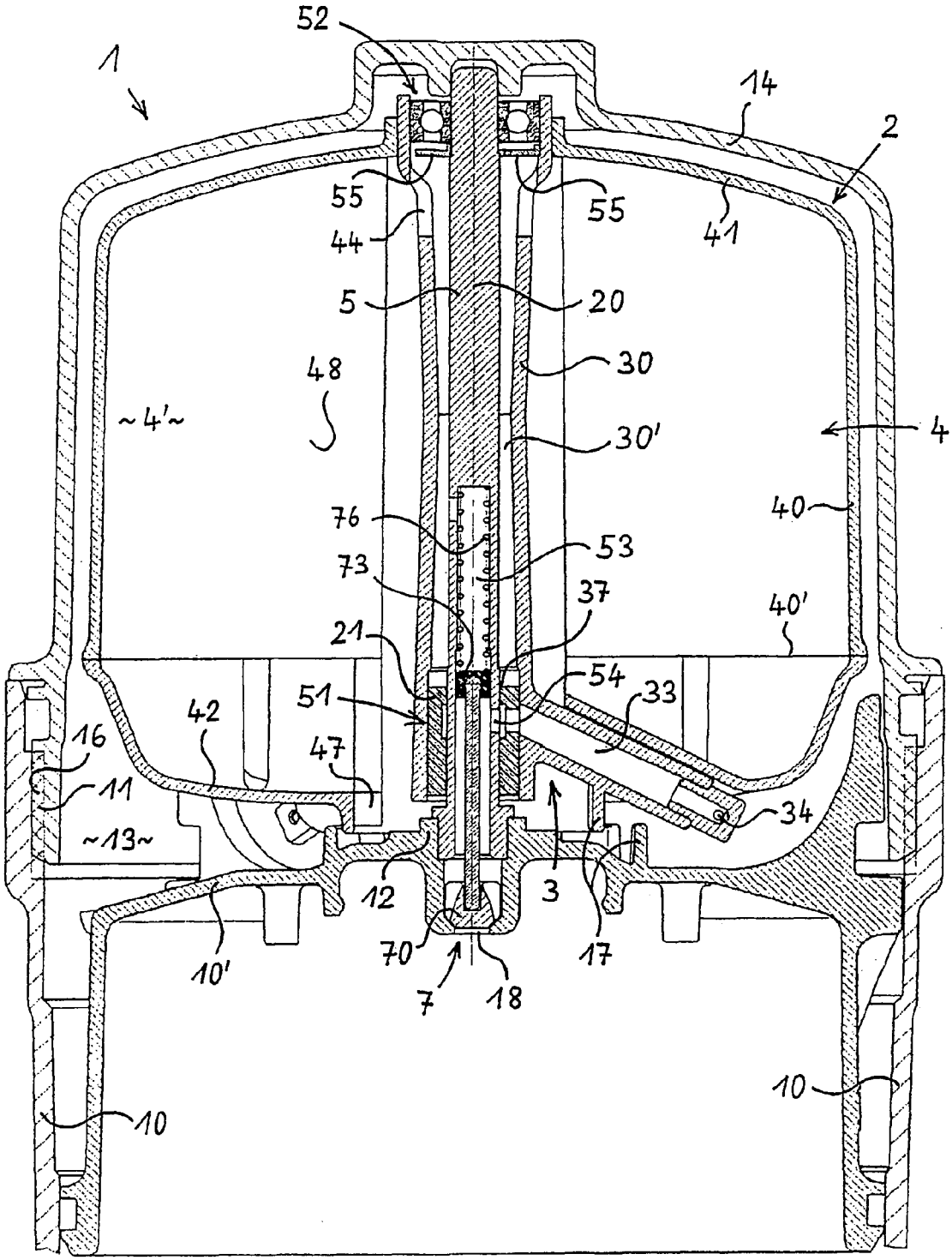
FIG. 22 a free-jet centrifuge with a minimum pressure valve, in longitudinal section.

FIG. 22 shows another centrifuge 1 in a longitudinal section which serves to clean the lubricating oil of an internal combustion engine. The centrifuge 1 comprises a housing 10 which is closed on the upper side with a screwed cover 14. For this, the housing 10 comprises an internal thread 11 and the cover 14 an external thread 16 which are in a screwed connection with each other.

In the lower part of the centrifuge 1, housing 10 is provided with a housing part 10' which is here pushed, as an insert, from the top into the housing 10.

The upper part of the centrifuge 1 comprises a rotor 2 which is rotatably provided on an axis 5. With its lower end, the axis 5 is inserted, for example screwed or pressed, into a centrical axis receiver 12 on the upper side of the housing part 10'.

The rotor 2 of the centrifuge 1 is of a two-piece design and comprises a drive part 3 and a dirt trapping part 4.

The drive part 3 of the rotor 2 comprises a central tubular body 30 and two arms extending from it through which one branch channel 33 each will lead to a recoil nozzle 34. The drive part 3 is provided on bearings on the axis 5, by means of a lower friction bearing 51 and an upper rolling bearing 52.

The dirt trapping part 4 consists of a peripheral wall 40, an upper wall 41 and a bottom 42, with a weld seam 40' between the peripheral wall 40 and the bottom 42 being circumferentially provided for connecting the parts with each other. With the cover 14 removed from the housing 10, the dirt trapping part 4 can be separated from the drive part 3 by pulling it off towards the top to be disposed of separately. In a reverse direction, a new dirt trapping part 4 can then be pushed from the top onto the drive part 3 to make the centrifuge 1 complete again.

The lubricating oil to be cleaned in the centrifuge 1 is supplied from the bottom through a central oil inlet 18 which is provided in the center of the housing part 10'. From there, the flow path of the inflowing lubricating oil continues through a hollow section 53 of the axis 5 and branches from there into two partial flows, i.e. a first partial flow through the branch channels 33 to the nozzles 34 and a second partial flow through a throttle point 37 in the friction bearing 51, through a ring channel 30' between the tubular body 30 and the axis 5 and through an inlet 44 in the upper area of the dirt trapping part 4. In the dirt trapping part 4, the radially outer part of its interior forms a dirt collection area 4' in which dirt particles from the lubricating oil separated by centrifugal force will deposit as dirt particle cake.

In the area of the oil inlet 18 and in the hollow section 53 of the axis 5, a minimum pressure valve 7 is provided which serves to allow an oil flow through the centrifuge 1 only if there is a certain minimum oil pressure at the oil inlet 18. The minimum pressure valve 7 here comprises a valve body 70 which is axially movable in the hollow section 53 of the axis 5 and preloaded by a helical spring 76 in closing direction, thus in downward direction. FIG. 22 shows the minimum pressure valve 7 in its closed position. With an increase of the oil pressure at the oil inlet 18, the valve body 70 is pushed upward against the force of the spring 76 whereby the lubricating oil passes—through the oil inlet 18—into the hollow section 53 of the axis 5 and from there distributes itself to the two partial flows, as described above.

Here, the lower bearing 51 of the rotor 2 is a friction bearing with a bearing bush 21 belonging to the rotor 2, sitting on a correspondingly machined outer circumferential surface of the lower part of the axis 5.

The upper bearing 52 is a rolling bearing here, more precisely a deep-groove ball bearing which is arranged between the upper end of the axis 5 and the upper end of the tubular body 30 belonging to the drive part 3.

Below the upper bearing 52, a shielding ring 55 is provided which is presented in a first embodiment in the left half of FIG. 22 and in a second embodiment in the right half of FIG. 22.

In the left half of FIG. 22, the shielding ring 55 is bound to the axis 5, preferably slipped on in a close sliding fit. Radially outside between the shielding ring 55 and the inner circumference of the upper end of the tubular body 30, there is a gap through which a small amount of oil can pass to provide the bearing 52 adequately, but not excessively, with lubricating oil.

In the right half of FIG. 22, the shielding ring 55 is bound to the inner circumference of the upper end of the tubular body 30, for example pressed in—here again—in a close sliding fit. In this embodiment, radially inside between the shielding ring 55 and the upper end of the axis 5, a gap is kept free which serves as a passage for a smaller amount of oil for lubrication of the bearing 52. In the corner area between the underside of the shielding ring 55 and the inner circumference of the tubular body 30, dirt particles can settle which are moved towards the outside by centrifugal force, without the risk of the dirt particles passing into the bearing 52 in a damaging manner.

The lubricating oil which passed through the inlet 44 into the upper area of the dirt trapping part 4 flows through the interior of the dirt trapping part 4 from top to bottom, with dirt particles depositing—by centrifugal force due to a rotation of the rotor 2—radially outside in the interior of the dirt trapping part 4, i.e. in its dirt collection area 4'. The cleaned lubricating oil leaves the dirt trapping part 4 radially inside and on the bottom through an oil outlet 47 from where the lubricating oil passes into a pressureless area 13 in the interior of the housing 10. From there, the lubricating oil can flow back, for example, into the oil pan of an associated internal combustion engine.

To slow down the oil flow exiting from the oil outlet 47 and to make it more uniform, intermittent deflecting ribs 17 are provided on the underside of the drive part 3 and on the upper side of the housing part 10' in circumferential direction.

The lubricating oil flow exiting from the nozzles 34 passes radially outside from the deflecting ribs 17 also into the pressureless area 13 and from there back to the oil pan of the associated internal combustion engine.

Figure 23:
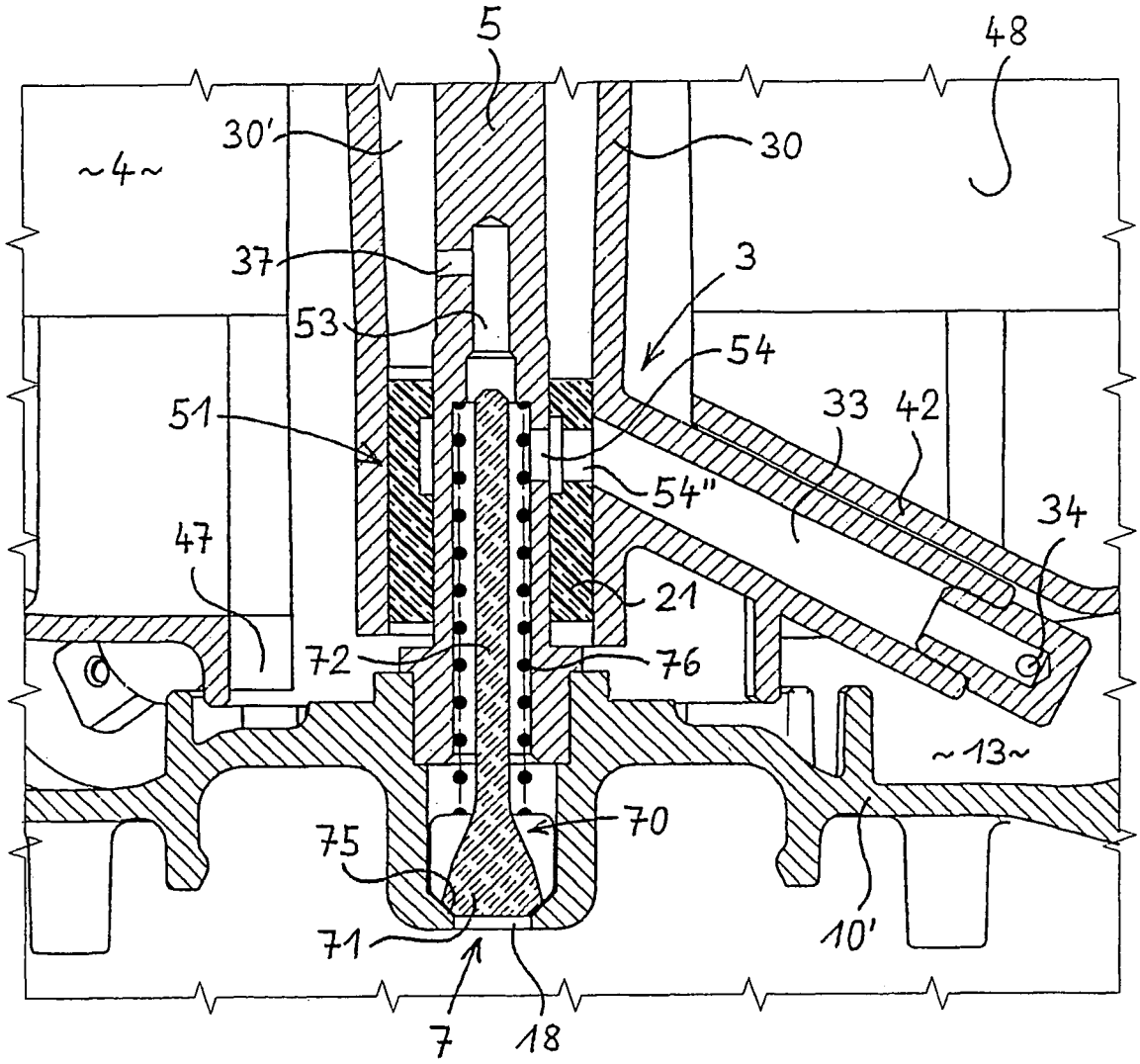
FIG. 23 a segment of the centrifuge according to FIG. 22 with a changed minimum pressure valve, also in longitudinal section.

FIG. 23 shows a segment of the centrifuge 1 according to FIG. 22 with a modified minimum pressure valve 7. In this embodiment, the hollow section 53 of the axis 5 is designed shorter in the axial direction, and the spring 76 preloading the valve body 70 in closing direction is arranged around a shaft 72 of the valve body 70 in the hollow section 53. An axially compact construction is thus achieved.

The sealing head 71 of the valve body 70 is provided, here too, together with the oil inlet 18 in the housing part 10' located underneath the rotor 2. In the area of the oil inlet 18, a valve seat 75 is designed against which the sealing head 71 can be placed in a sealing manner. From the sealing head 71, the shaft 72 of the valve body 70 extends towards the top. Around the shaft 72, the valve spring 76 is arranged whose upper end rests on a step in the hollow section 53 of the axis 5 and whose lower end rests on the sealing head 71.

At the level of the upper part of shaft 72, the lower bearing 51 with bearing bush 21 is provided on the axis 5. Through the lower area of axis 5, starting from its hollow section 53, a radial opening 54 extends towards the outside. Another radial opening 54" penetrates the bearing bush 21. This provides a flow path for the lubricating oil with opened minimum pressure valve 7 from the oil inlet 18 through the hollow section 53 of axis 5 in the branch channels 33 to the nozzles 34, by means of which the first partial lubricating oil flow for drive part 3 is passed.

The second partial lubricating oil flow to the dirt trapping part 4 flows here coming from oil inlet 18 through the hollow section 53 of axis 5 and through a throttle point 37 into the ring channel 30' and through this towards the top to inlet 44—no longer visible in FIG. 23—of the dirt trapping part 4.

With regard to the other visible individual parts and reference numbers in FIG. 23, reference is made to the description of FIG. 22.

Figure 24:
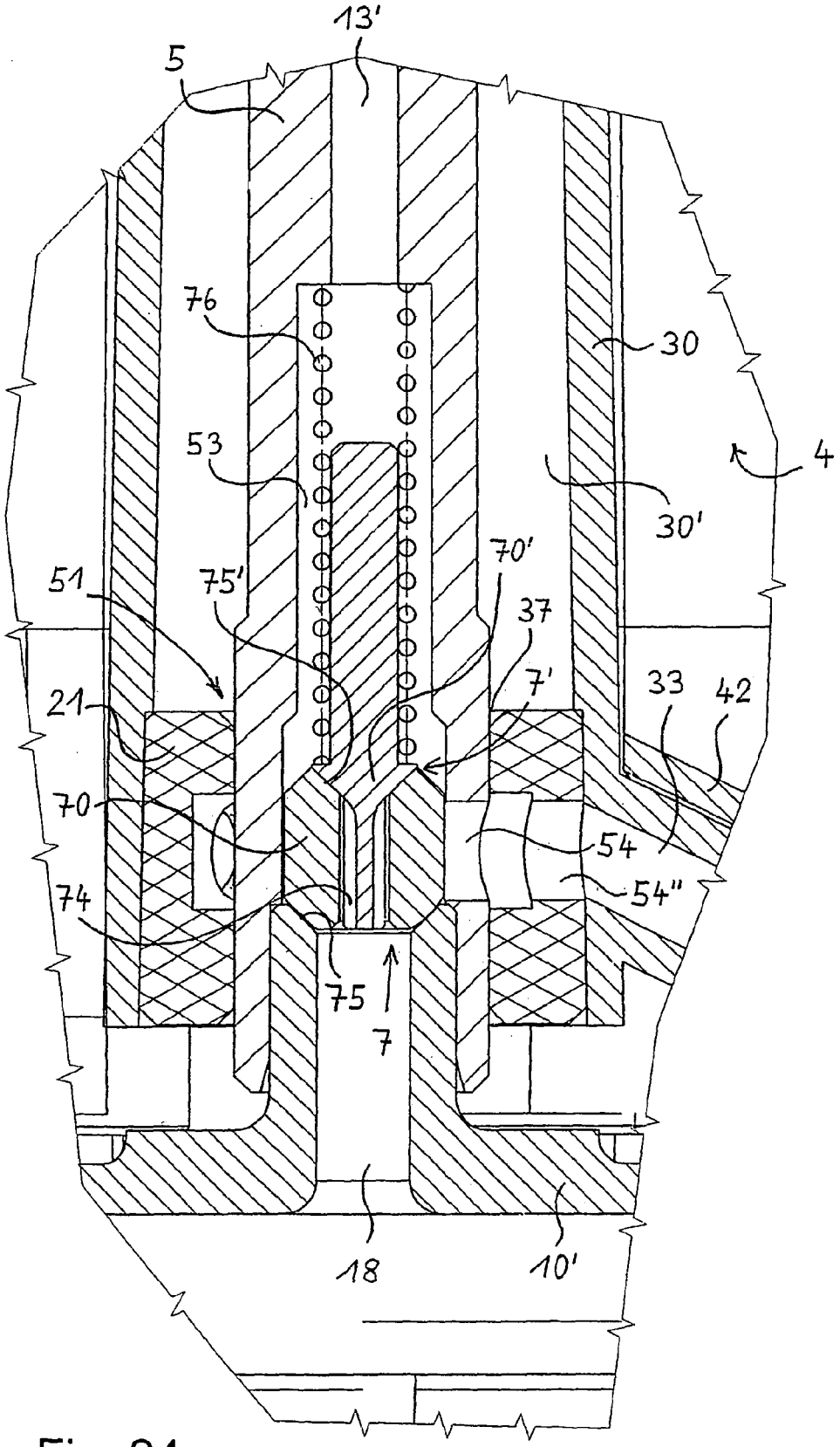
FIG. 24 a combined minimum pressure valve and overpressure shutdown valve as part of a centrifuge, in closed condition of both valves, in longitudinal section.

FIG. 24 also shows in a longitudinal section another embodiment of the centrifuge, here being essential that a combined minimum pressure valve 7 and overpressure shutdown valve 7' is built in.

On the bottom of FIG. 24, the central area of housing part 10' is visible in the center of which the oil inlet 18 is located. The oil inlet 18 here has the form of an upward directed stub whose upper side is designed as a valve seat 75 with which the valve body 70 of the minimum pressure valve 7 interacts.

In its center, the valve body 70 comprises an oil passage 74 whose upper side is designed as a second valve seat 75'. With this second valve seat 75', a second valve body 70' interacts as part of the overpressure shutdown valve 7'. In FIG. 24, both valves 7 and 7' are closed. The closed position of both valves 7 and 7' is effected by a joint valve spring 76 which rests on the second valve body 70' and on a step in the hollow section 53 of axis 5.

Figure 25:
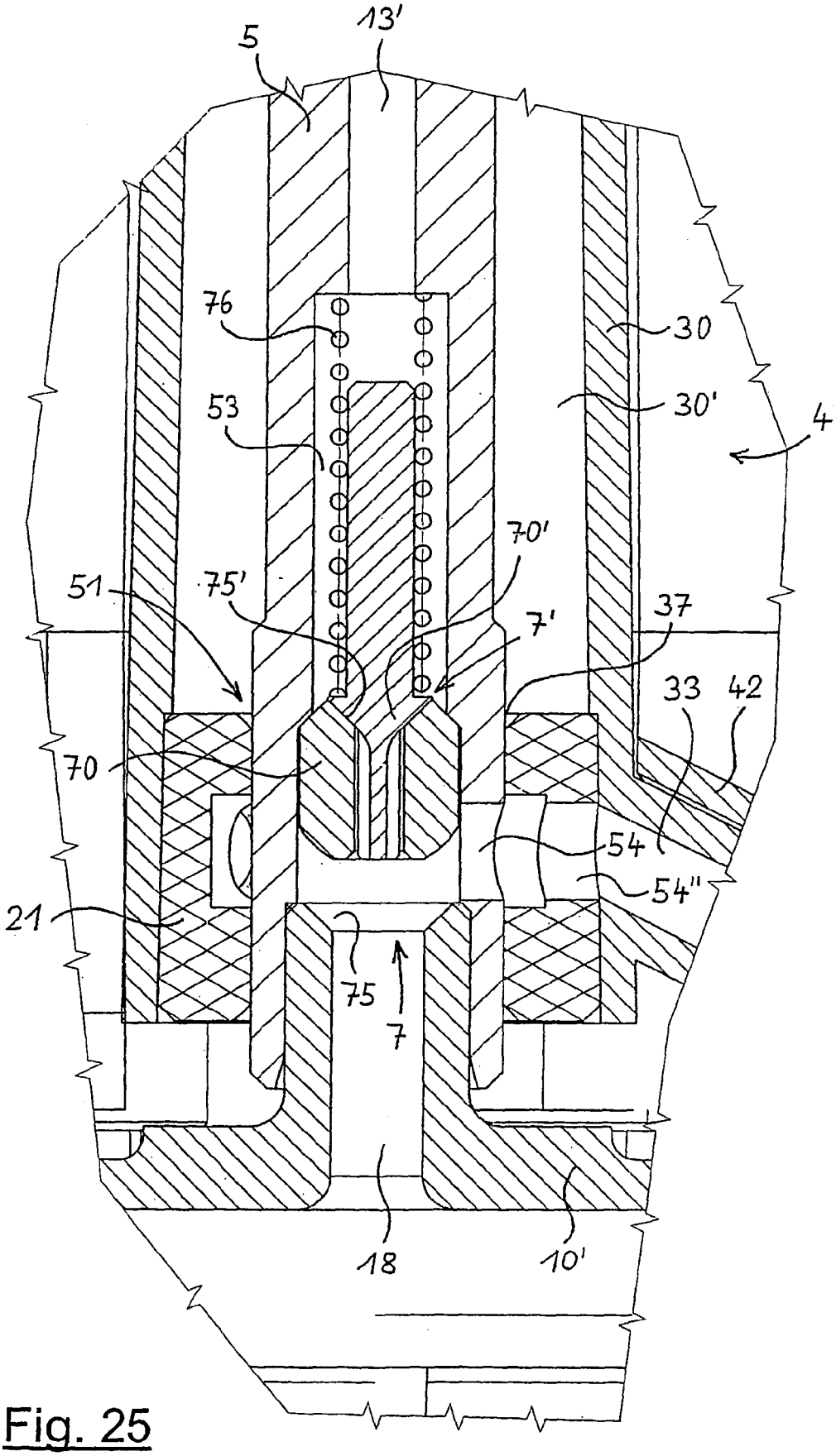
FIG. 25 the minimum pressure valve and overpressure shutdown valve according to FIG. 24, now in opened condition of the minimum pressure valve, again in longitudinal section.

FIG. 25 of the drawing shows the combination of minimum pressure valve 7 and overpressure shutdown valve 7' from FIG. 24 in an opened condition of the minimum pressure valve 7 and the continuing closed condition of the overpressure shutdown valve 7'. Through the increasing oil pressure at the oil inlet 18, the two valve bodies 70 and 70' are here jointly shifted toward the top against the force of spring 76 until valve 70 comes to rest at a stop in the hollow section 53 of axis 5, as can be seen in FIG. 4. In this position, the lubricating oil can flow from the oil inlet 18, past the valve body 70, radially outward through the radial channels 54, 54", for one part, into the branch channels 33 and, for the other part, into the ring channel 30'. A bearing gap between bearing bush 21 and axis 5 here forms a throttle point 37 for the partial lubricating oil flow which flows into ring channel 30' and to dirt trapping part 4.

Figure 26:
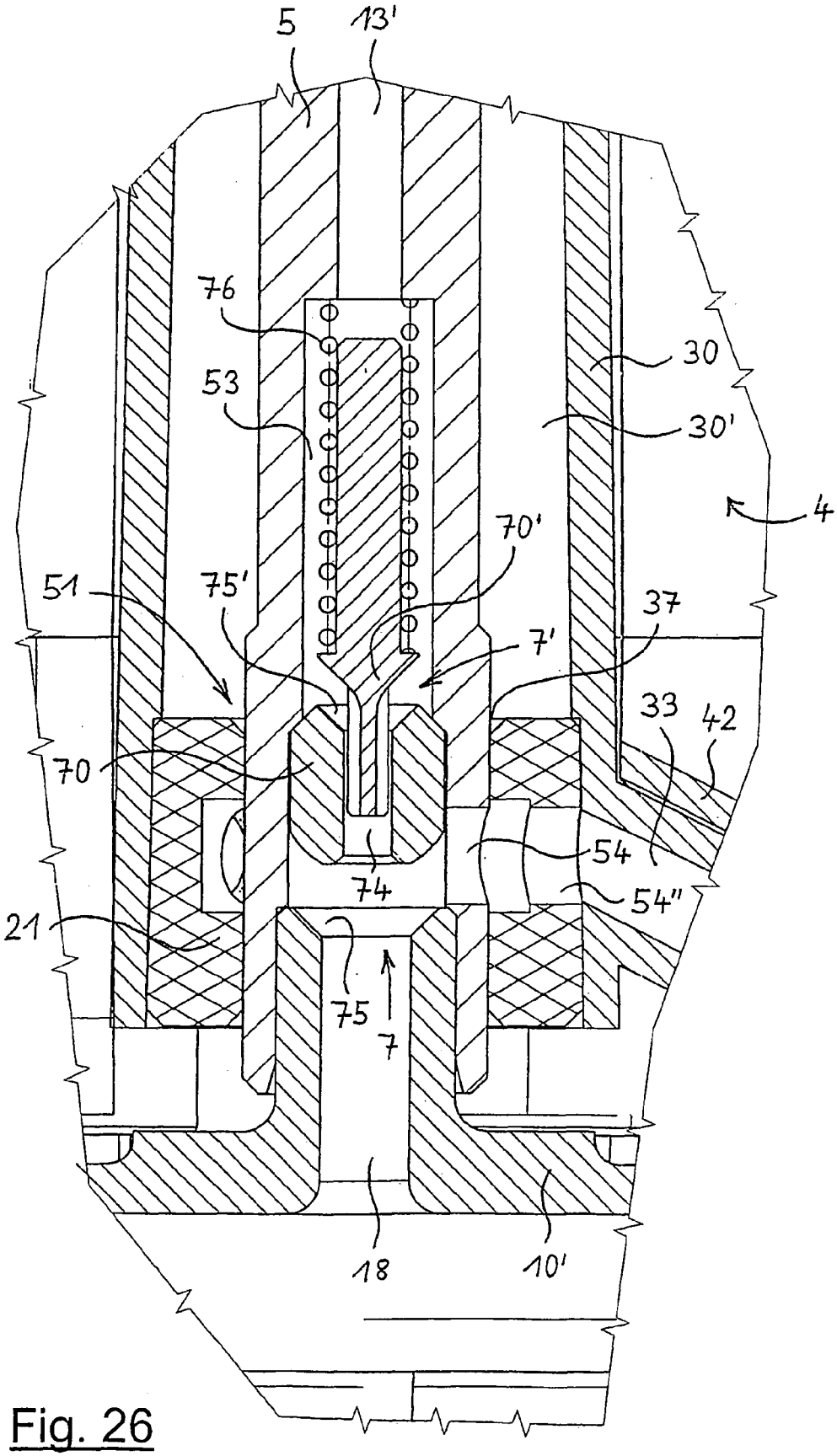
FIG. 26 the minimum pressure valve and overpressure shutdown valve according to FIGS. 24 and 25, now in opened condition of both valves, again in longitudinal section.

In FIG. 26, the overpressure shutdown valve 7' is now also opened after a further pressure increase of the lubricating oil at the oil inlet 18. In this case, due to the further increased oil pressure, only the second valve body 70' is pushed against the force of spring 76 still further to the top due to which the second valve body 70' is lifted from its associated valve seat 75' on the first valve body 70. This releases a flow path through the oil passage 74 in a relief channel 13' running through the upper part of axis 5, through which oil is removed into a pressureless area of centrifuge 1.

Figure 27:
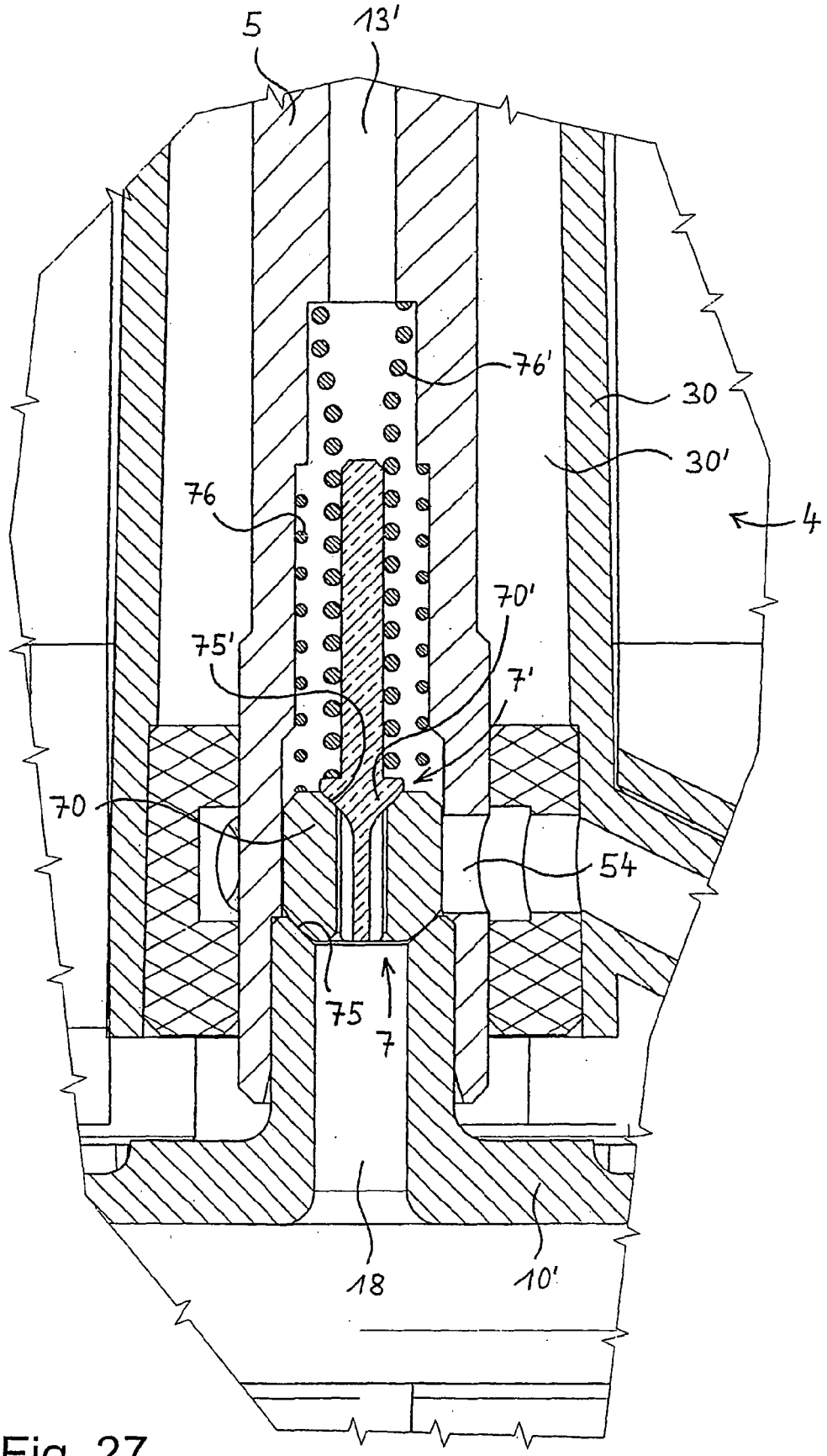
FIG. 27 the minimum pressure valve and overpressure shutdown valve according to FIG. 24 in a modified embodiment, in longitudinal section.

FIG. 27 shows a modified embodiment of the combination of minimum pressure valve 7 and overpressure shutdown valve 7'. The difference is that, with the embodiment according to FIG. 27, two separate valve springs 76 and 76' are provided. The first valve spring 76 loads only the first valve body 70 of the minimum pressure valve 7. The second valve spring 76' loads only the second valve body 70' of the overpressure shutdown valve 7'. Thus, the forces can be individually specified by means of which the two valve bodies 70 and 70' will be preloaded in closing direction. Otherwise, the embodiment according to FIG. 27 is equivalent to the above described embodiment according to the FIGS. 24 to 26.

Figure 28:
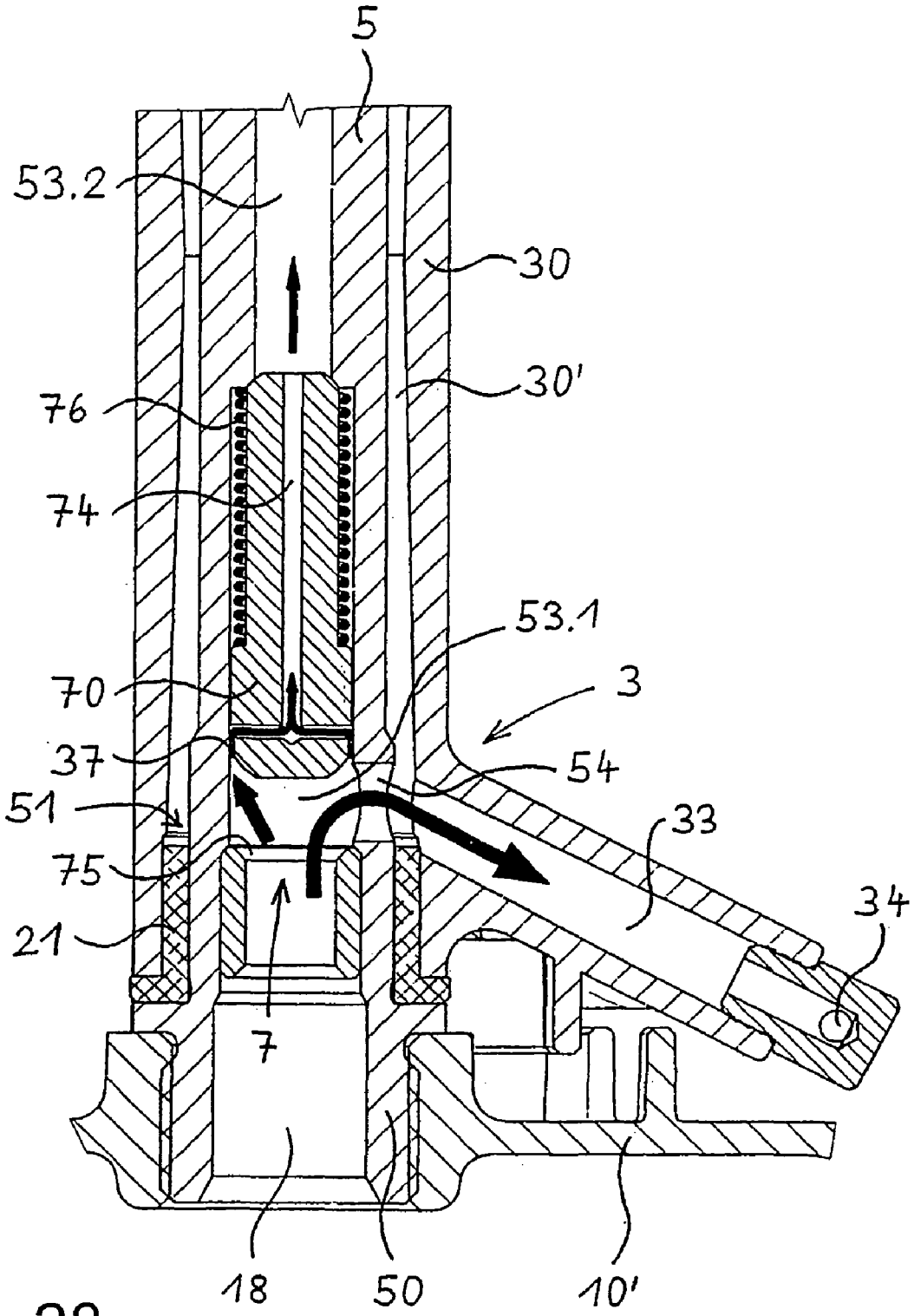
FIG. 28 a modified minimum pressure valve as part of the centrifuge, in longitudinal section.

In a longitudinal section, FIG. 28 shows a segment of a centrifuge with a changed minimum pressure valve 7. Here again, the minimum pressure valve 7 is provided in axis 5. On its bottom end 50, axis 5 is provided with a thread which is screwed into a corresponding threaded hole in the center of housing part 10'. On the outer circumference of axis 5, a bearing bush 21 sits above its lower threaded end 50 as part of a lower friction bearing 51. On the outside of bearing bush 21 sits the lower end of the tubular body 30 of drive part 3.

A lower hollow section 53.1 of axis 5 forms the oil inlet 18. Moreover, from the bottom, a sleeve-shaped metallic body is inserted into section 53.1, said body forming a valve seat 75 for a valve body 70 of the minimum pressure valve 7.

The valve body 70 is arranged above valve seat 75 and axially movably provided in the hollow section 53.1 of axis 5. The valve body 70 is preloaded in closing direction by means of spring 76.

FIG. 28 shows the minimum pressure valve 7 in its opening position in which the valve body 70 is pushed upwardly through the pressure of the lubricating oil present at the oil inlet 18 against the force of spring 76. In this position, the valve body 70 is lifted off its valve seat 75 and releases a radial channel 54 which leads from the hollow section 53.1 of axis 5 to the branch channels 33 for recoil nozzles 34. A first, larger partial lubricating oil flow will flow, via this flow path, to drive part 3, more precisely to its recoil nozzles 34.

A second partial lubricating oil flow flows towards the top in a second hollow section 53.2 in axis 5 and via this flow path to the dirt trapping part 4 not shown here. A section of this flow path leads all through the valve body 70 which is provided for this in its upper, major part of its axial length with a central oil passage 74 in the form of a longitudinal bore. Close to the lower front face of valve body 70, the central oil passage 74 goes over into two radial bores running out at the outer circumference of valve body 70. Between the outer circumference of valve body 70 and the inner circumference of hollow section 53.1, a throttle point 37 is thus formed which provides a defined throughput of lubricating oil towards the upper hollow section 53.2 and the dirt trapping part 4 of centrifuge 1.

With a lack of lubricating oil pressure at the inlet 18, spring 76 pushes the valve body 70 into its closed position in which it rests in a sealing manner on valve seat 75. In this position, both flow paths are sealed closed for the first partial lubricating oil flow to drive part 3 and for the second partial lubricating oil flow to dirt trapping part 4.

Figure 29:
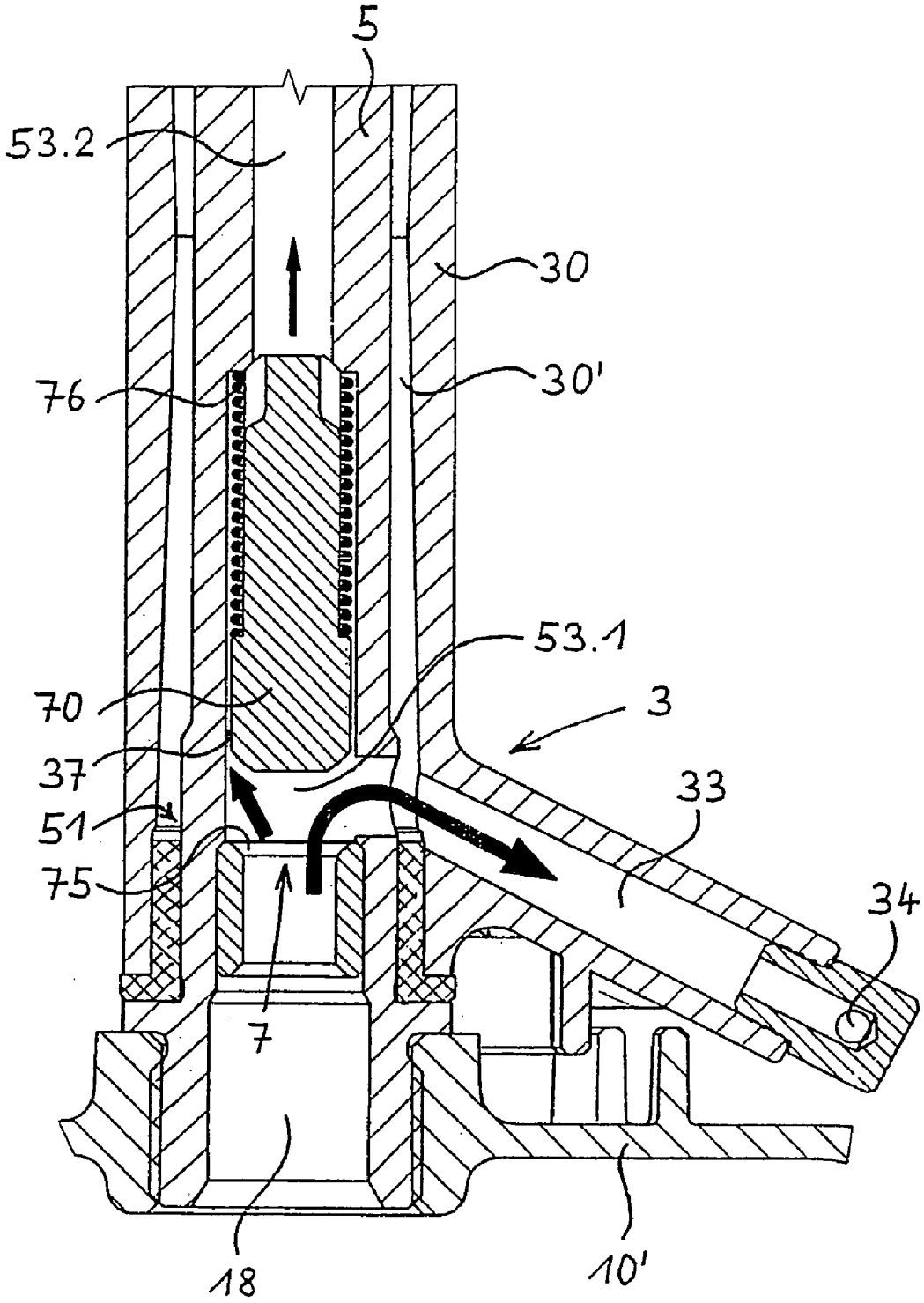
FIG. 29 a modification of the minimum pressure valve from FIG. 28, also in longitudinal section.

FIG. 29 shows a modification of the minimum pressure valve 7 of FIG. 28 with the difference, that in the minimum pressure valve 7 according to FIG. 29, its valve body 70 has no oil passage. Much rather, it is here provided that—between the outer circumference of valve body 70 and the inner circumference of hollow section 53.1—a defined annular gap exists which forms a throttle point 37 for the partial lubricating oil flow fed to the dirt trapping part 4, and for a defined oil flow and thus a desired distribution of the inflowing lubricating oil into the two partial lubricating oil flows to drive part 3 and to dirt trapping part 4 here again not shown. In its other details and functions, the embodiment according to FIG. 29 is equivalent to the embodiment according to FIG. 28.

Figure 30:
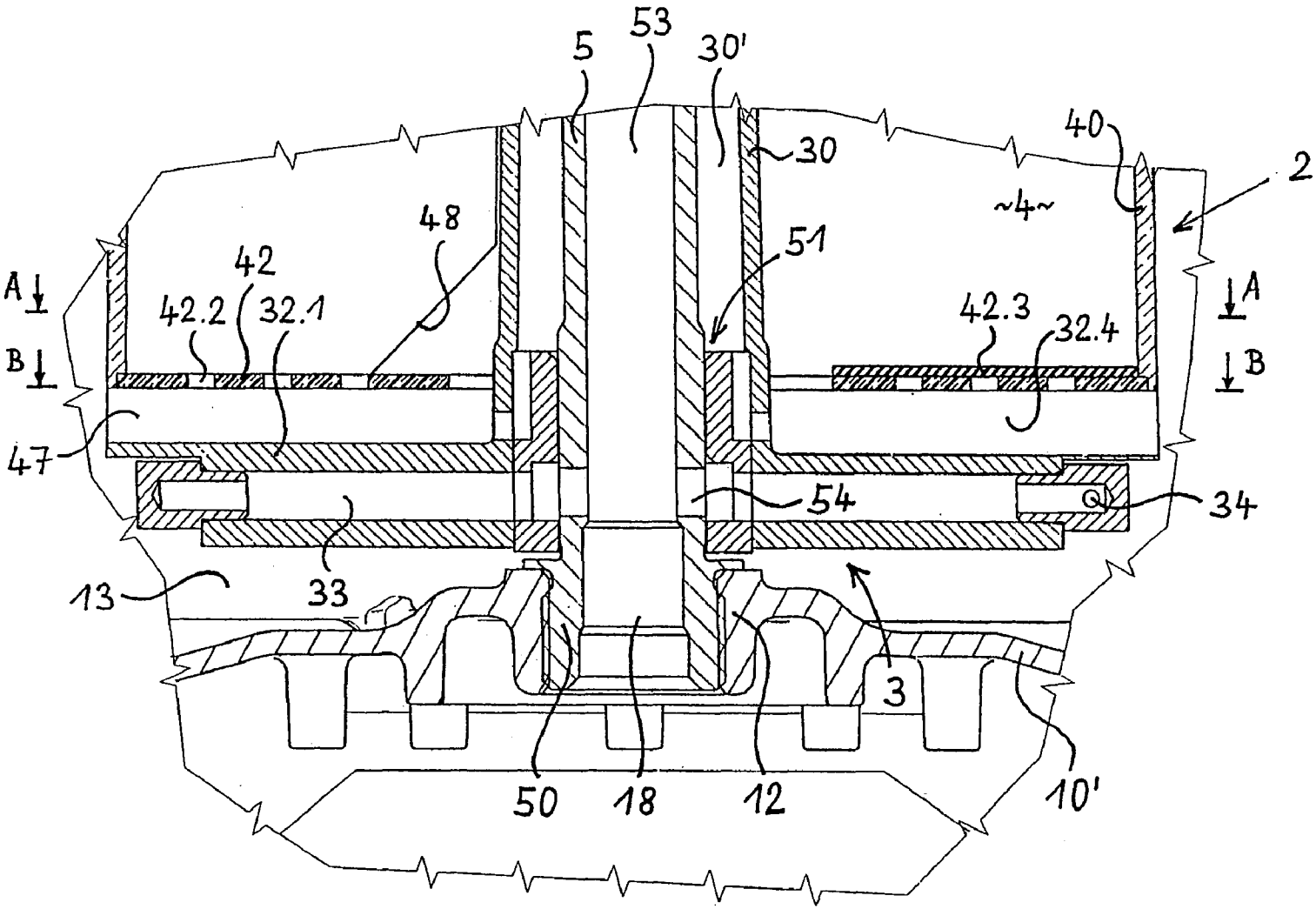
FIG. 30 the lower part of a rotor and of a lower housing part of the centrifuge in another embodiment, in longitudinal section.

In a longitudinal section, FIG. 30 shows the lower part of a centrifuge. On the very bottom of FIG. 30, housing part 10' can be seen with its central axis receiver 12 for axis 5 which is screwed, with its lower threaded end 50, into the axis receiver 12. On axis 5, the rotor 2 is also again rotatably provided by means of two bearings, with only the bottom bearing 51, designed as a friction bearing, being visible in FIG. 30.

Left and right in the upper part of FIG. 30, the lower area of dirt trapping part 4 of the rotor 2 is visible. The special feature is here that the bottom 42 of dirt trapping part 4 is provided with openings 42.2. The openings 42.2 are here designed in the form of bores which are distributed as rims on three different radii concentrically to each other over the circumference of bottom 42.

Underneath the bottom 42, at an axial distance, a shielding disk 32.1 is provided which is one part of the drive part 3 of rotor 2. The interspace between the bottom 42 and the plate 32.1 forms an oil outlet 47 for the cleaned oil.

The drive part 3 furthermore comprises the two branch channels 33, each leading to a drive nozzle 34 for the drive of rotor 2. From the shielding disk 32.1, the tubular body 30 of drive part 3 extends centrally towards the top. The friction bearing 51 is provided between the drive part 3 and axis 5.

The lower end of axis 5 forms the oil inlet 18, after which follows towards the top the hollow section 53 of axis 5. At the level of branch channels 33, a radial channel 54 passing through the wall of axis 5 connects the oil inlet 18 with the branch channels 33. The partial lubricating oil flow moving to the dirt trapping part 4 flows through the hollow section 53 of axis 5 further towards the top and there passes into dirt trapping part 4.

As long as not yet any or only a relatively small amount of dirt particles have deposited in the dirt trapping part 4 radially outside on the inner circumference of the peripheral wall, the cleaned lubricating oil will flow from the interior of dirt trapping part 4 through the radially outermost rim of openings 42.2 towards the bottom into the oil outlet 47 of dirt trapping part 4. That part of the dirt trapping part 4 which is radially inside from the outermost rim of openings 42.2 therefore does not fill with oil; thus, the weight of the dirt trapping part 4 including the oil therein will remain relatively low. This ensures fast acceleration of the rotor 2 upon startup and a high speed at the specified drive power.

When the dirt particle cake depositing on the inner circumference of the peripheral wall 40 becomes so thick that it covers up the outermost rim of openings 42.2, the cleaned lubricating oil will flow off through the radially inwardly next following rim of openings 42.2. Thus, the amount of oil present in the dirt trapping part 4 will be limited—even with an increasingly thicker dirt particle cake.

In the left half of FIG. 30, one of several guide and stiffener walls 48 is still visible within the dirt trapping part 4, said walls each extending in radial direction and providing, on the one hand, for the lubricating oil to be entrained upon acceleration of the rotor 2 and, on the other hand, having the effect of a reinforcement of dirt trapping part 4 so that it can also be made of plastic.

In the right half of FIG. 30, on the upper side of the bottom 42, a material layer 42.3 is additionally provided which is oil-permeable but largely impermeable for dirt particles. This layer 42.3 consist of a fleece or a fabric, for example.

Underneath the bottom 42, ribs 32.4 are provided extending in radial direction and supporting the bottom 42 on the underside, said ribs being a part of drive part 3.

Figure 31A:
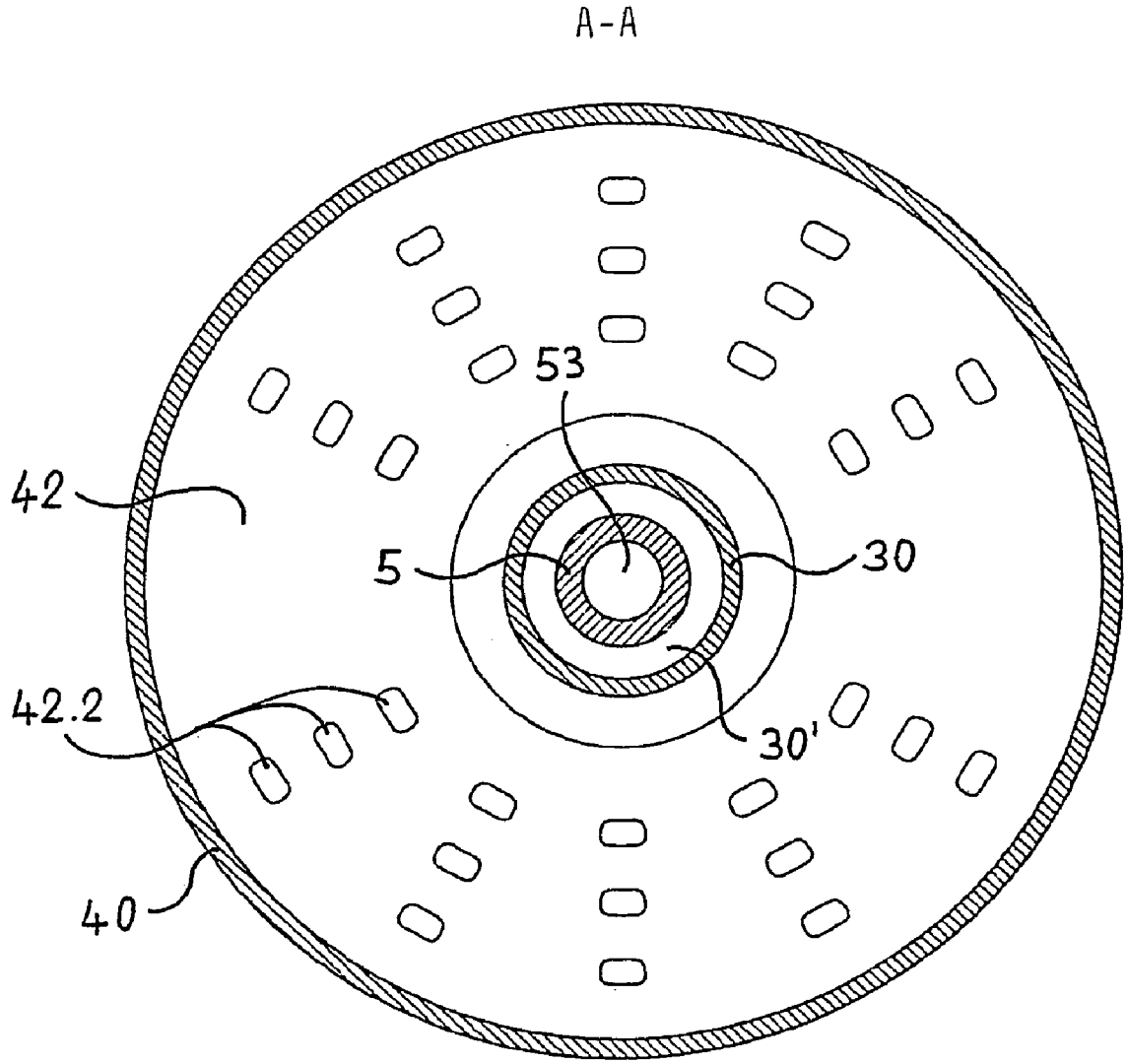
FIG. 31*a* a cross-section according to line A-A in FIG. 30.

FIG. 31*a* shows a section through the centrifuge of FIG. 30 according to the section line A-A in FIG. 30. Radially outermost is the peripheral wall 40 of the dirt trapping part 4. Radially on the inside thereof, bottom 42 can be seen in a top view, with its three rims of openings 42.2. The guide and stiffener walls 48 are not presented in FIG. 31*a*.

In the center of FIG. 31*a*, axis 5 can be seen with the hollow interior 53. Radially outside thereof, the tubular body 30 of drive part 3 is concentrically provided. With axis 5, the tubular body 30 encloses the ring channel 30'.

Figure 31B:
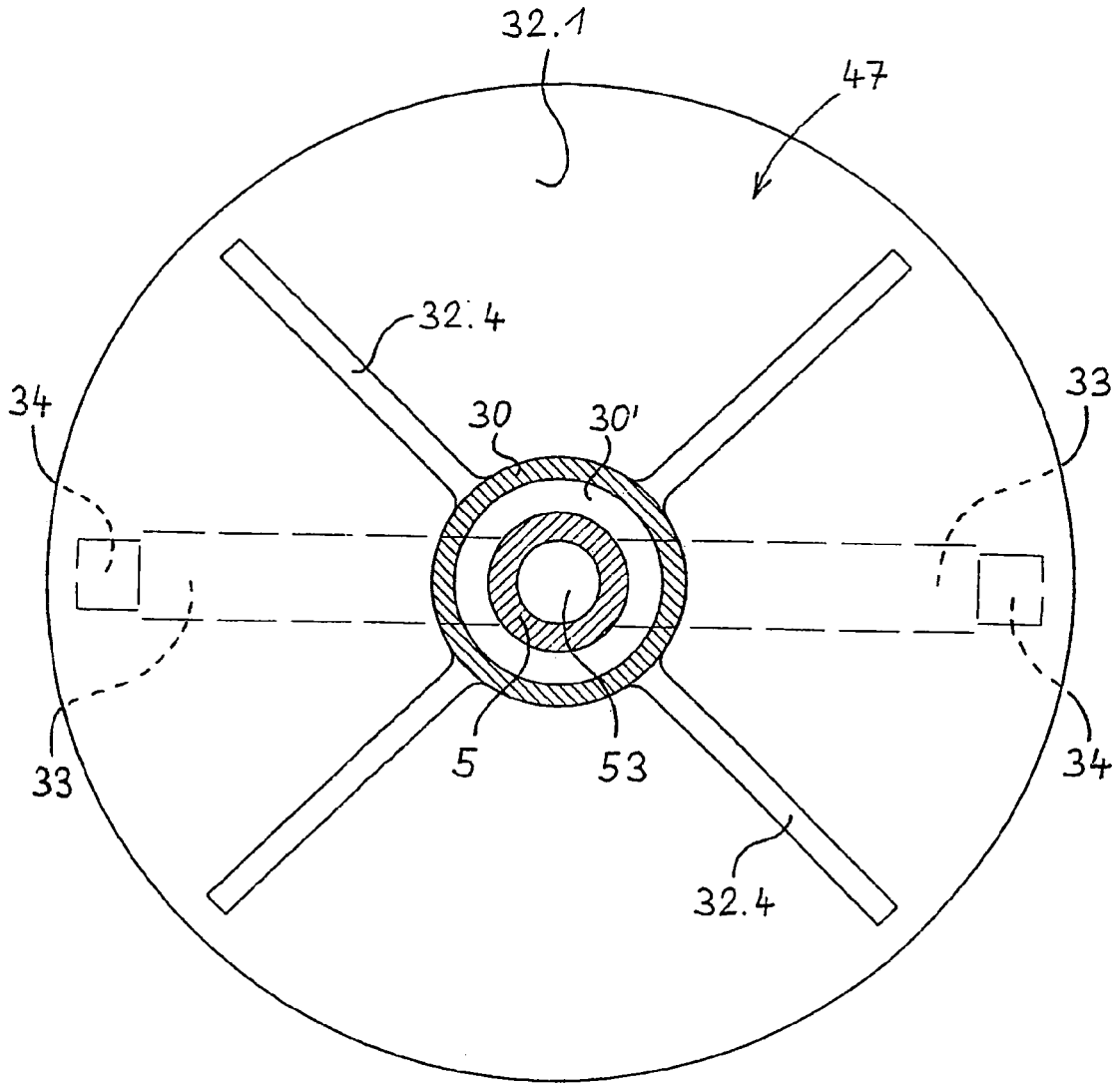
FIG. 31*b* a cross-section according to line B-B in FIG. 30.

FIG. 31*b* shows the centrifuge of FIG. 30 in a cross-section according to the line B-B in FIG. 30. Here, the view is on the upper side of shielding disk 32.1, here with altogether four carrying ribs 32.4 extending in radial direction. Underneath the shielding disk 32.1, branch channels 33 are hidden with their associated respective recoil nozzle 34. In the center of FIG. 31*b*, tubular body 30 and axis 5 are shown in a section. The area between the upper side of shielding disk 32.1 and carrying ribs 32.4 forms the outlet 47 for the cleaned lubricating oil exiting the dirt trapping part 4.

Figure 32:
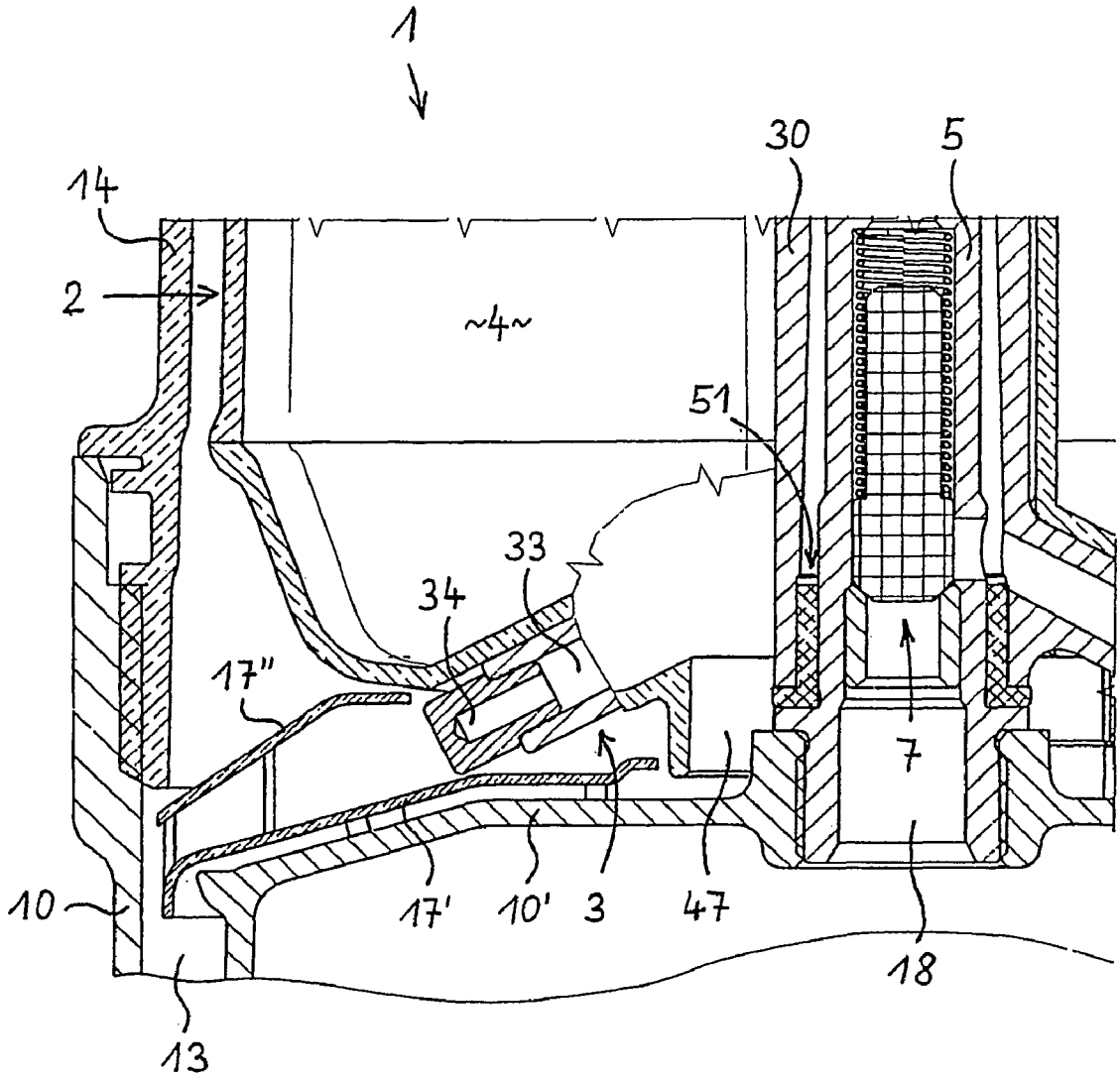
FIG. 32 the left lower area of another centrifuge, in longitudinal section.

FIG. 32 shows an embodiment of centrifuge 1 for which it is characteristic that it has means by which the cleaned lubricating oil flow and the lubricating oil flow exiting from the recoil nozzles 34 are separated from each other and kept away from the outer circumference of rotor 2. To do this, two shielding disks 17' and 17" are provided on the upper side of housing part 10' at an axial distance to it and from each other. One lower shielding disk 17' is provided, at a small axial distance, from the upper side of housing part 10' and radially inside, up close to outlet 47 for the cleaned lubricating oil exiting from dirt trapping part 4. This lubricating oil exiting through the outlet 47 flows through the gap space between the upper side of housing part 10' and the underside of the bottom shielding disk 17' into the pressureless centrifuge area 13.

The lubricating oil flow exiting from the recoil nozzles 34 arrives in a gap space between the upper side of the lower shielding side 17' and the underside of an upper shielding disk 17" and also flows through this into the pressureless area 13. This will achieve that the partial lubricating oil flows from outlet 47 and recoil nozzles 34 have no adverse influence on each other. Moreover, it will be ensured that no exiting lubricating oil in appreciable amounts will get to the outer circumference of rotor 2, more precisely of its dirt trapping part 4, thereby preventing undesirable deceleration of the rotor 2 due to lubricating oil reaching its outer side.

On the right in FIG. 32, still in the central area of centrifuge 1, a minimum pressure valve 7 is visible above the oil inlet 18 which is equivalent to the embodiment according to FIG. 29.

Figure 33:
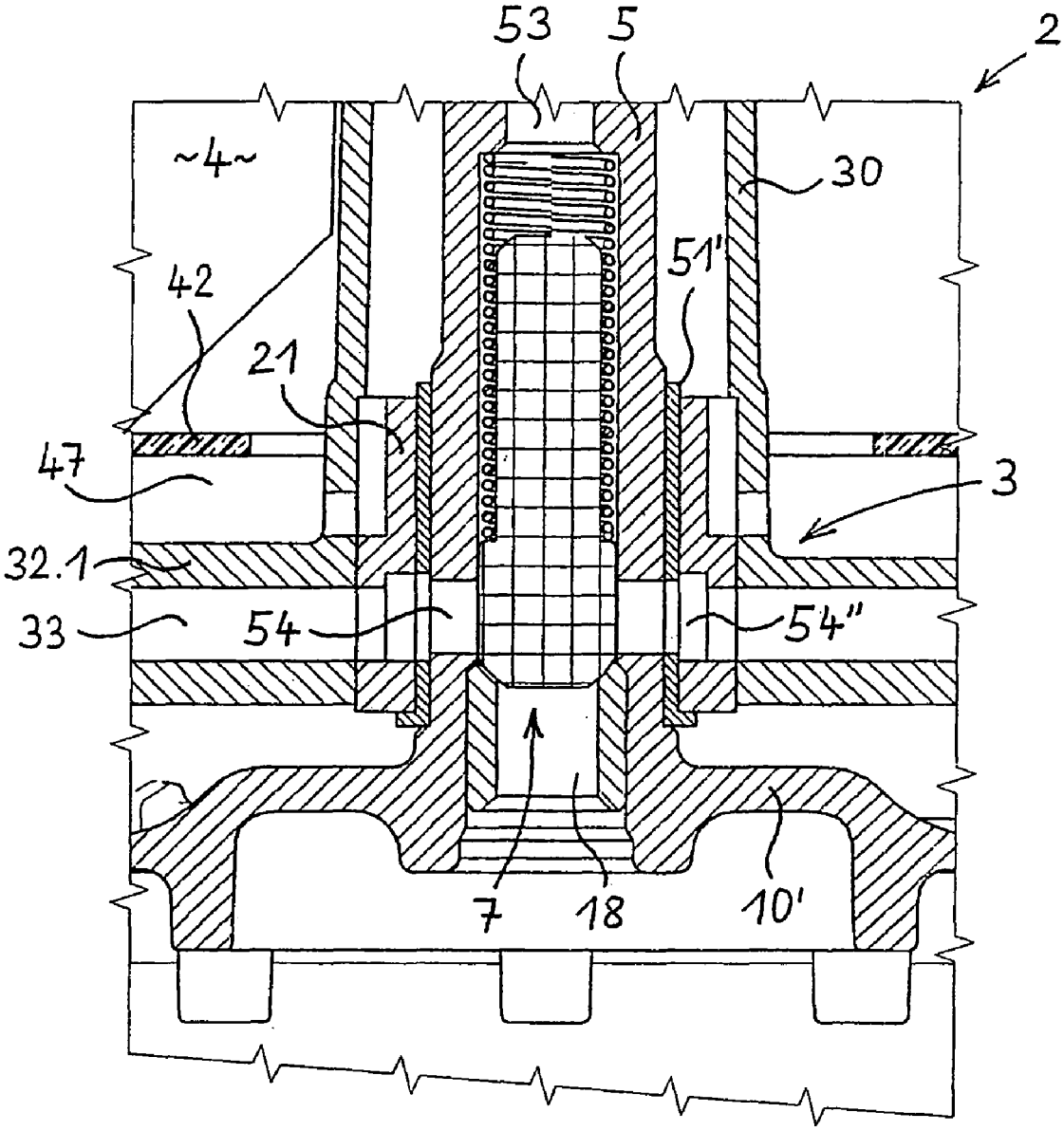
FIG. 33 a segment of another centrifuge in the area of a lower friction bearing, in longitudinal section.

FIG. 33 shows a segment of a centrifuge for which it is characteristic that axis 5 is here designed as one piece with housing part 10' for the bearing of rotor 2. The one-piece component of axis 5 and housing part 10' here preferably consists of a light metal, for reasons of weight. Since light metals, such as aluminum or magnesium, have unfavorable properties in view of a sliding fit in a friction bearing, it is here further provided according to FIG. 33 that—on the outer circumference of the lower part of axis 5—a bearing sleeve 51' is set on, preferably tightly pressed on. To ensure an exactly round outer circumference of this bearing sleeve 51', its outer circumference will be expediently finished by grinding to an exactly cylindrical outer circumference form—after pressing the bearing sleeve 51' onto axis 5.

The bearing bush 21 as part of the rotor 2, here of its drive part 3, sits on the outer circumference of the bearing sleeve 51'.

A minimum pressure valve 7 provided in a hollow section 53 of axis 5 is equivalent to the embodiment already explained by means of FIG. 29. With regard to the other parts and reference numbers in FIG. 33, reference is made to the preceding description of Figures.

Figure 34:
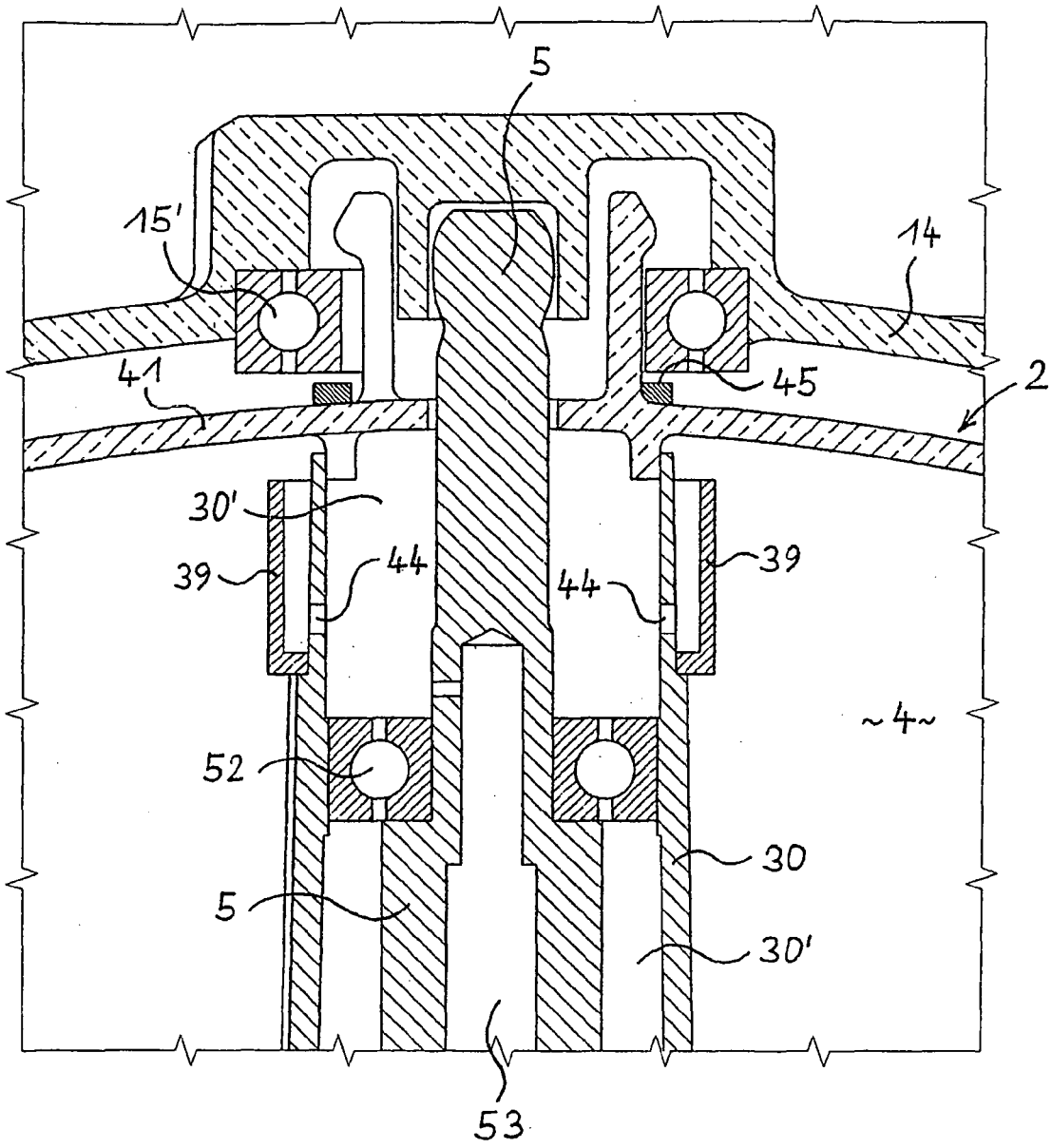
FIG. 34 the central upper area of another centrifuge, in longitudinal section.

In longitudinal section, FIG. 34 shows a segment of the central upper area of a centrifuge. At the very top of FIG. 34, the central area of cover 14 can be seen. Thereunder, a part of rotor 2 can be seen—here a central segment of the upper wall 41 of dirt trapping part 4. In the center of FIG. 34, axis 5 is vertically provided, designed with a hollow interior 53. The axis 5 is surrounded, at a distance, by the tubular body 30 which is part of the drive part 3 of rotor 2 not shown here.

The lubricating oil to be supplied to the dirt trapping part 4 as a partial flow will flow from the bottom through the hollow interior 53 of axis 5 towards the top and, from it, will pass—through a radial bore above the rolling bearing 52—into the upper end area of ring channel 30'. From there, two oil inlets 44 lead into the interior of the dirt trapping part 4.

Radially outside of the oil inlets 44, a collar 39 is set on, here pressed, onto the upper end area of the tubular body 30, said collar being closed axially on the bottom and radially outside and open axially on the top. With the outer circumference of the upper end area of tubular body 30, this collar 39 forms an annular gap which ensures that the lubricating oil flowing in through the inlets 44 will be uniformly distributed in the circumferential direction of the dirt trapping part 4 and enters into the dirt trapping part 4 as far as possible on the top, directly underneath the upper wall 41.

Above the rotor 2, an additional rolling bearing 15' is here provided which is applied centered in the cover 14. On the upper side of upper wall 41 of the dirt trapping part 4, a ring-shaped stop face 45 is formed, for example, in the form of a pasted-on ring. By means of this stop face 45, axial forces generated upon rotation of the rotor 2 in its operation can be discharged to the rolling bearing 15' which ensures a low-friction operation even if axially resulting forces occur. For the rotatable bearing of the rotor 2 as such, this additional bearing 15' will not be required.

Figure 35:
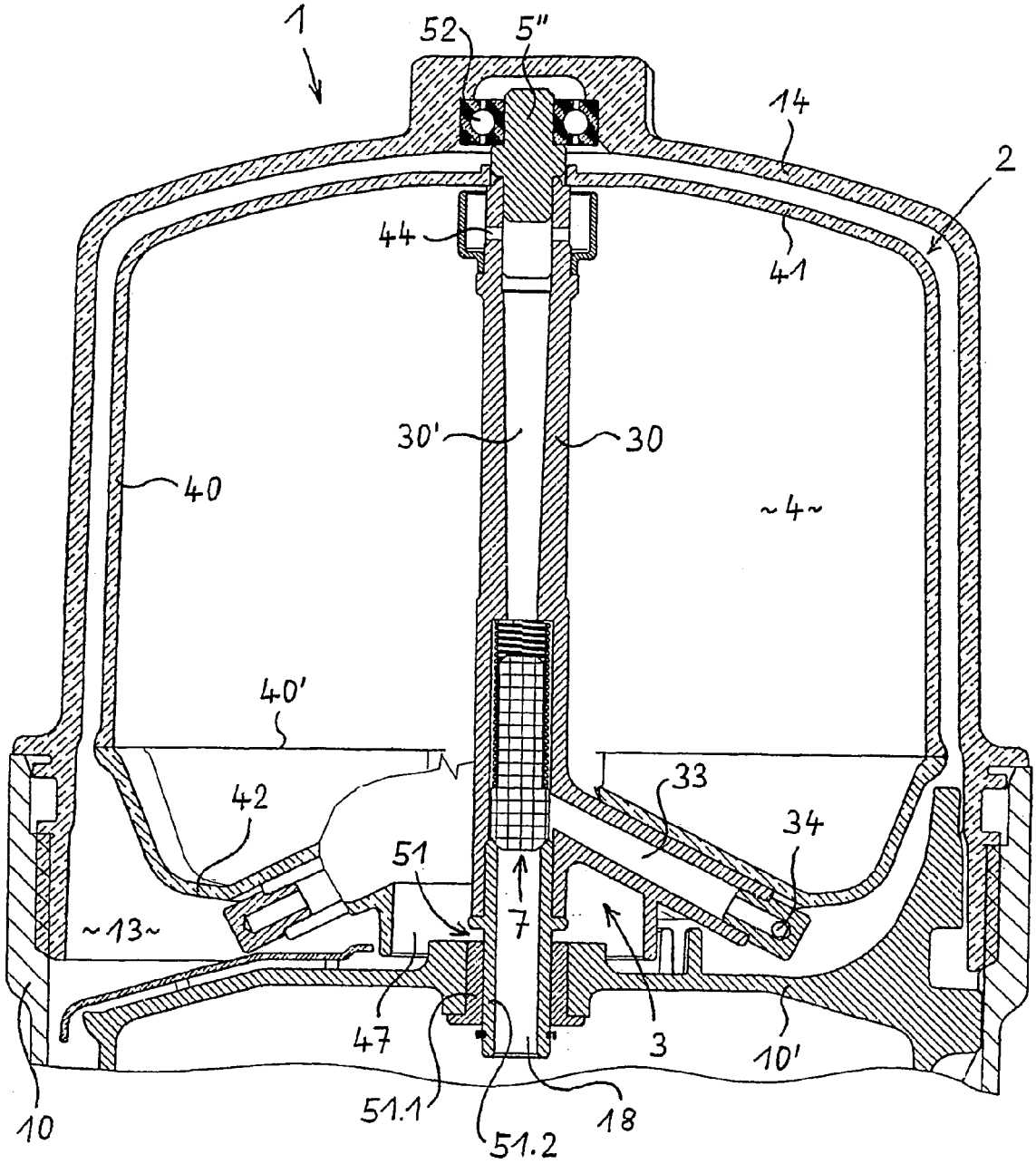
FIG. 35 a complete centrifuge in another embodiment, also in longitudinal section.

FIG. 35 shows an embodiment of centrifuge 1, with the characteristic that no housing-stationary axis will be provided for the bearing of rotor 2 but that the rotor 2 itself includes a shaft by means of which it is rotatably provided on bearings in housing 10 and on the cover 14 of centrifuge 1.

The rotor 2 of the centrifuge comprises here again a drive part 3 and a dirt trapping part 4 detachably connected with it and removable towards the top in axial direction. The drive part 3 comprises a central tubular body 30 from which extend, in the lower area, two arms with one branch channel 33 each towards one associated recoil nozzle 34 each. A channel 30' is formed in the interior of the tubular body 30.

In the lower end area of the tubular body 30, a bearing part 51.2 is inserted, for example pressed in, consisting of a material which provides a good sliding fit together with a bearing bush 51.1 used in the housing part 10. The bearing part 51.2 is of steel, for example, and the bearing bush 51.1 of brass. The remaining drive part 3 preferably consists of a light metal, such as aluminum or magnesium.

At the upper end of the tubular body 30, an insert part is inserted into it, preferably pressed in, which forms an axis stub 5" projecting towards the top over the rotor 2. By means of an upper rolling bearing 52, the rotor 2 is centered on the top in cover 14 by means of the rolling bearing 52.

In the lower area of channel 30' above the bearing part 51.2, a minimum pressure valve 7 is provided which again is equivalent to the embodiment according to FIG. 29. When the minimum pressure valve 7 is displaced towards the top due to an oil pressure present at the oil inlet 18 in the hollow bearing part 51.2, the inflowing lubricating oil will be divided into the two partial flows, on the one hand, in the branch channels 33 to the nozzles 34 and, on the other hand, through channel 30' via the inlet 44 into the dirt trapping part 4.

The lubricating oil cleaned in the dirt trapping part 4 leaves it through the radially inside and downwardly provided oil outlet 47 and arrives, together with the oil flow exiting from the recoil nozzles 34, in the pressureless area 13.

In the operation of centrifuge 1, the lubricating oil pressure present ensures that rotor 2 is moved towards the top in axial direction, until further axial displacement is no longer possible due to a stop on the upper rolling bearing 52. In this position, as shown in FIG. 35, there are no contacting areas in axial direction in the below provided friction bearing 51, thus ensuring smooth running of the friction bearing 51.

Figure 36:
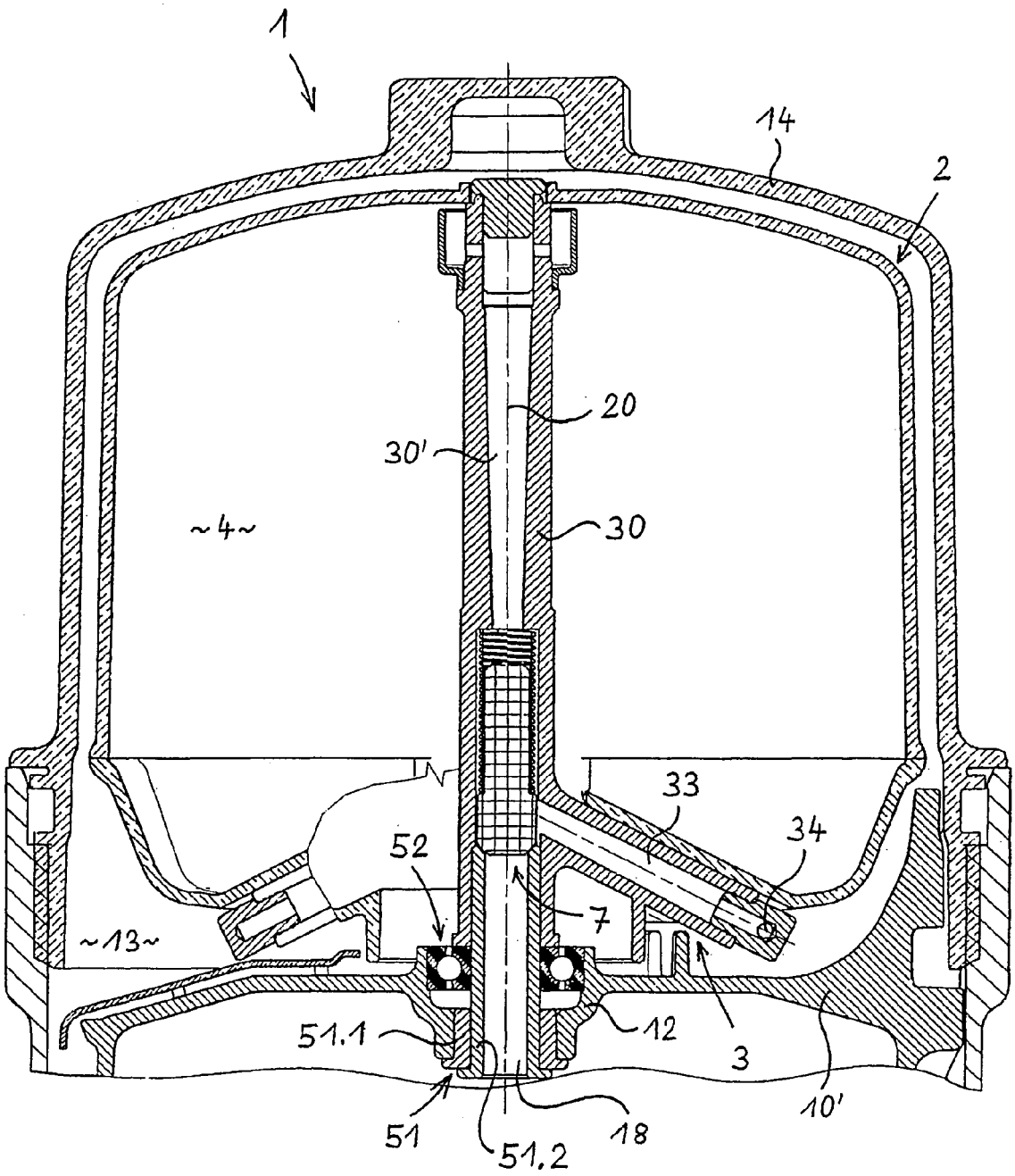
FIG. 36 another complete centrifuge, also in longitudinal section.

FIG. 36 shows again in longitudinal section a modification of the centrifuge 1 of FIG. 35, wherein—in contrast to FIG. 35—the bearing of rotor 2 in FIG. 36 is provided by means of two bearings 51 and 52 which are both arranged in the lower part of drive part 3.

The rotor 2 comprises here again drive part 3 and dirt trapping part 4 which are separable from each other with the cover 14 unscrewed.

The drive part 3 comprises here again a central tubular body 30 with a channel 30' formed in its interior as well as two laterally projecting arms which comprise the two channels 33 to the recoil nozzles 34.

In the lower end of the tubular body 30, a bearing part 51.2 is here again inserted from the bottom, the part being pressed in, for example. This bearing part 51.2 sits in a bearing bush 51.1 which, in turn, is inserted into the central bearing receiver 12 in the housing part 10'.

At a small axial distance above this friction bearing 51, formed by the bearing bush 51.1 and the bearing part 51.2, the rolling bearing 52 is provided as a second bearing. This rolling bearing 52 sits, with its outer circumference, also in the central bearing receiver 12 in housing part 10' and with its inner circumference on the outer circumference of the bearing part 51.2. With this arrangement of the two bearings 51 and 52 and with the extension of the drive part 3 completely through the dirt trapping part 4 towards the top, the rotor is easily rotatable on bearings and at the same time sufficiently secured against stall torques.

At the upper end of rotor 2, its tubular body 30 is closed. There is no further bearing in the upper part of rotor 2.

A minimum pressure valve 7 provided in the interior of the tubular body 30 is equivalent to the embodiment described above on the basis of FIG. 29.

Figure 37:
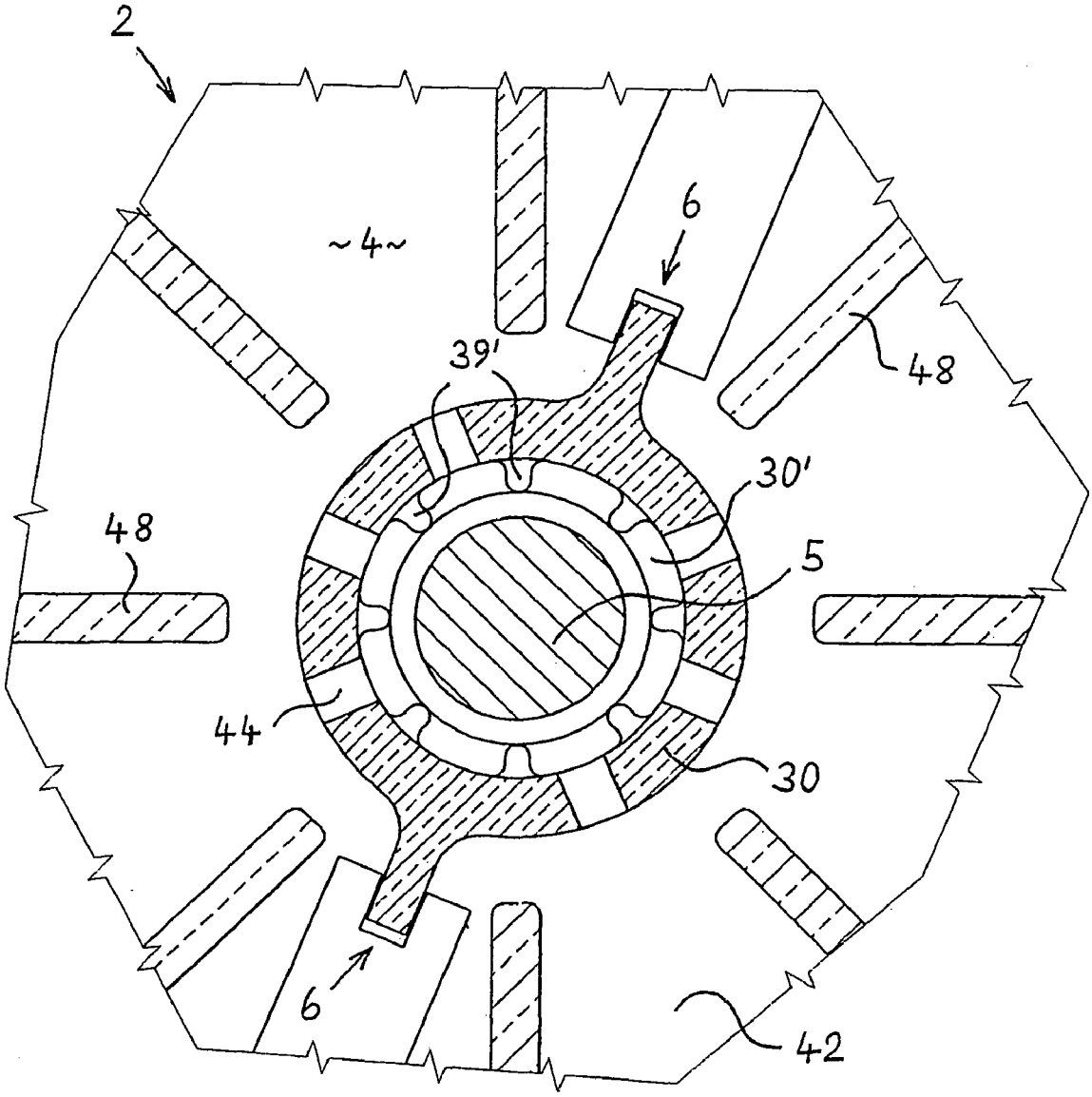
FIG. 37 another centrifuge in a cross-section through its middle, central area.

In a cross-section, FIG. 37 shows one embodiment of a centrifuge for which a central axis 5 for the bearing of rotor 2 is again provided, around which the tubular body 30 of the drive part 3 is concentrically arranged. The cross-section presented in FIG. 37 is effected in an upper central area of rotor 2 at the level of the inlets 44 for the lubricating oil in the interior of dirt trapping part 4.

The center of FIG. 37 is the central axis 5 which is either connected with the housing part 10' or of one piece—as already explained above. Radially outside of axis 5 is the ring channel 30' which, in turn, is limited radially towards the outside by the central tubular body 30 as part of the drive part 3 of rotor 2.

It is characteristic for the embodiment presented in FIG. 37 that integrally molded ribs 39' project from the inner circumference of the tubular body 30 parallel to each other and running in the longitudinal direction of the tubular body 30. These ribs 39' ensure that—upon rotation of the rotor 2 and thus also upon rotation of the tubular body 30—the lubricating oil flowing through the ring channel 30' towards the inlets 44 will be effectively made to rotate which thus simplifies the passage of the lubricating oil from the ring channel 30' into the inlets 44 and renders it more uniform.

Radially outside of tubular body 30, guide and stiffener walls 48 can be seen which are arranged and distributed in overturning direction, with their radially inner end at a distance from the tubular body 30.

Finally, FIG. 37 also shows two torque transmission means 6 facing each other which are used for the transmission of a torque from drive part 3 to dirt trapping part 4 and which are designed such that the torque transmission means 6 are engageable by axially pushing dirt trapping part 4 onto the drive part and disengageable by axial removal of dirt trapping part 4 from the drive part 3. Finally, the bottom 42 of dirt trapping part 4 is still visible in the background of FIG. 37.

Figure 38A:
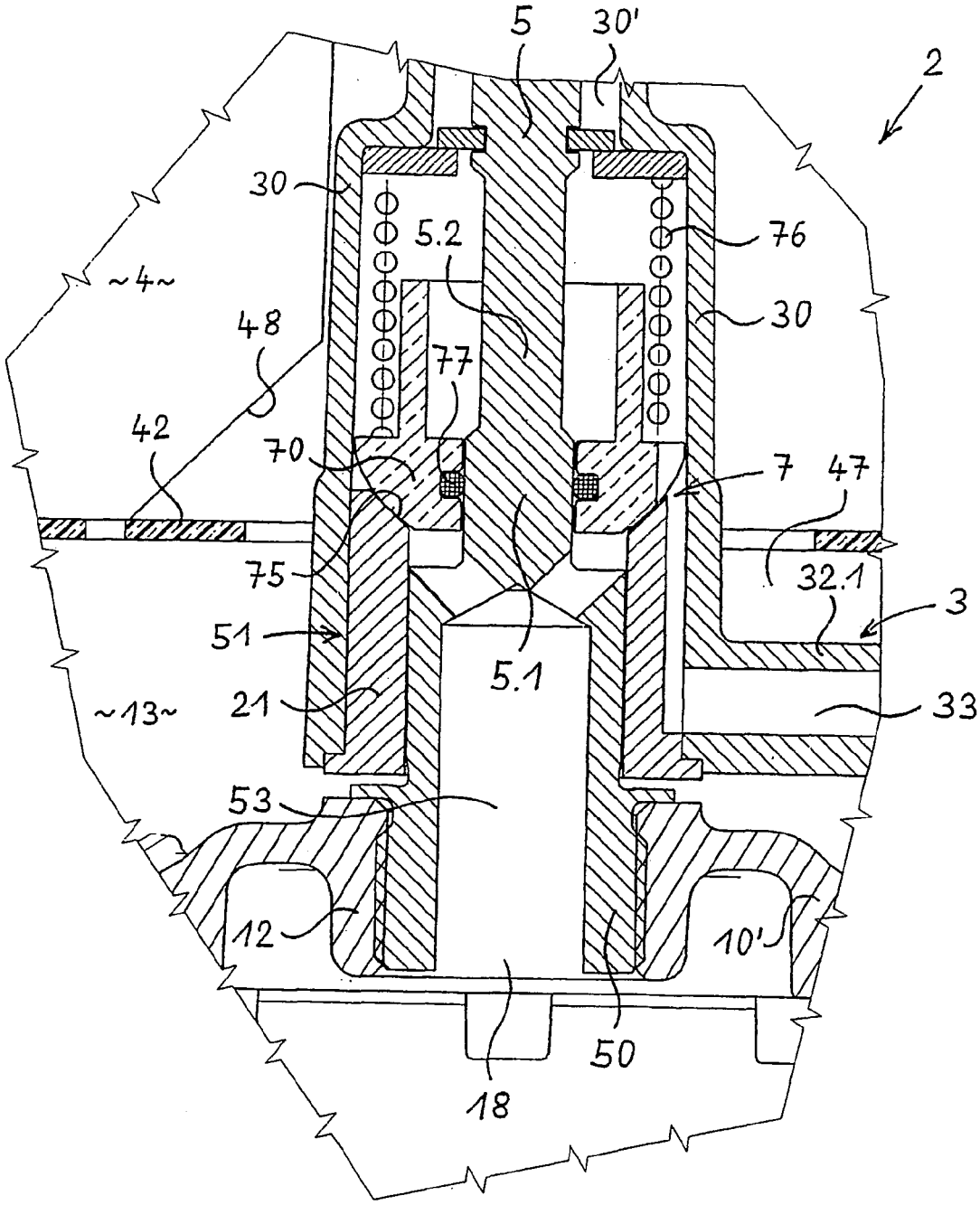
FIG. 38*a* a segment from the central lower area of another centrifuge, with a lower bearing and a closed minimum pressure valve, in longitudinal section.

In a longitudinal section, FIG. 38*a* shows one segment of a centrifuge with a modified minimum pressure valve 7. In its other parts, the centrifuge according to FIG. 38*a* is equivalent to the embodiment explained on the basis of FIG. 30.

The rotor 2 is here again provided in its lower part on a housing-stationary axis 5 by means of a friction bearing 51. The axis 5 is here screwed, with its lower threaded end 50, into the central axis receiver 12 in the housing part 10' under rotor 2.

On the outer circumference of the lower area of axis 5 above the threaded end 50, the bearing bush 21 is sitting which is inserted from the bottom into the central tubular body 30 of drive part 3. The upper side of the bearing bush 21 here forms a valve seat 75 for a valve body 70 of the minimum pressure valve 7. The valve body 70 is hollow in design and axially movable on the axis 5. By means of a valve spring 76 arranged above the valve body 70, the valve body 70 is preloaded in closing direction.

The minimum pressure valve 7 assumes its closed position shown in FIG. 38*a* as long as there is no sufficient oil pressure at the central oil inlet 18 at the lower end of axis 5 with the hollow section 53 there specified. In this closed position, the valve body 70 is in sealing contact with the valve seat 75. At the same time, the valve body 70 is now radially inside on a section 5.1 of axis 5 with a larger outside diameter. In this position, the valve body 70 is also sealed off on its inner circumference by means of a sealing ring 77 there specified against section 5.1 of the axis 5. Thus, it is not possible for lubricating oil to flow from the oil inlet 18 either into the two channels 33 or into the ring channel 30'.

Figure 38B:
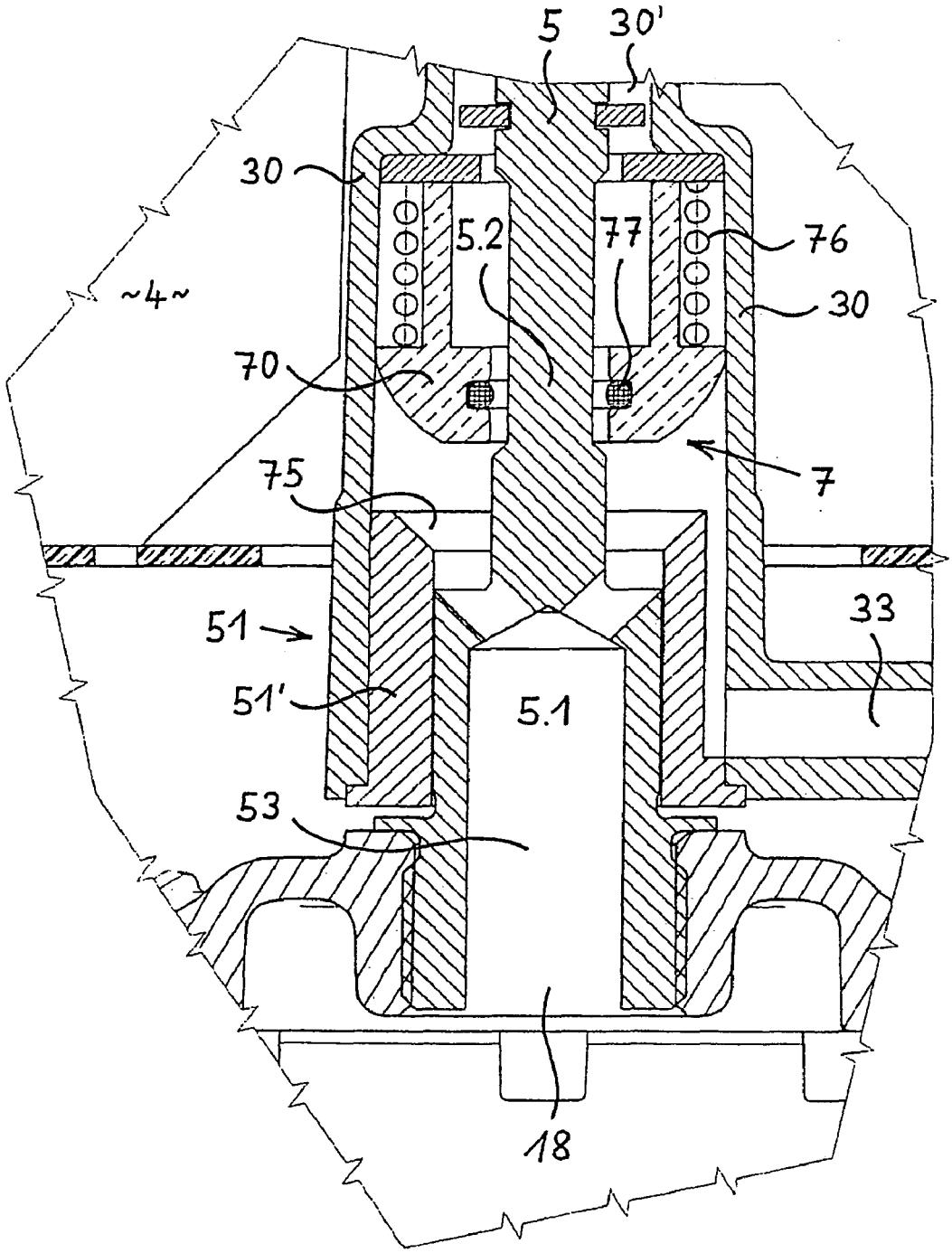
FIG. 38*b* the centrifuge of FIG. 38*a*, now with opened minimum pressure valve.

If the oil pressure on the oil inlet 18 increases above a minimum pressure, the oil pressure pushes the sealing body 70 against the force of spring 76 into its opening position, as presented in FIG. 38*b*. The valve body 70 is now at the level of a section 5.2 of axis 5 which has a smaller outside diameter, and thus an annular gap is formed between the outer circumference of the section 5.2 of axis 5 and the inner circumference of the hollow valve body 70.

In the raised position of the valve body 70 according to FIG. 38*b*, the lubricating oil—coming from the inlet 18—can flow through the hollow section 53 of axis 5 towards the top and will then be separated into two partial lubricating oil flows. The first partial lubricating oil flow first will flow radially towards the outside, then towards the bottom and then again radially outside into the branch channels 33 which lead to the recoil nozzles 34 not visible here. The second partial lubricating oil flow will flow axially towards the top entirely through the hollow interior of valve body 70 into the ring channel 30' and from there into the dirt trapping part 4.

Figure 39:
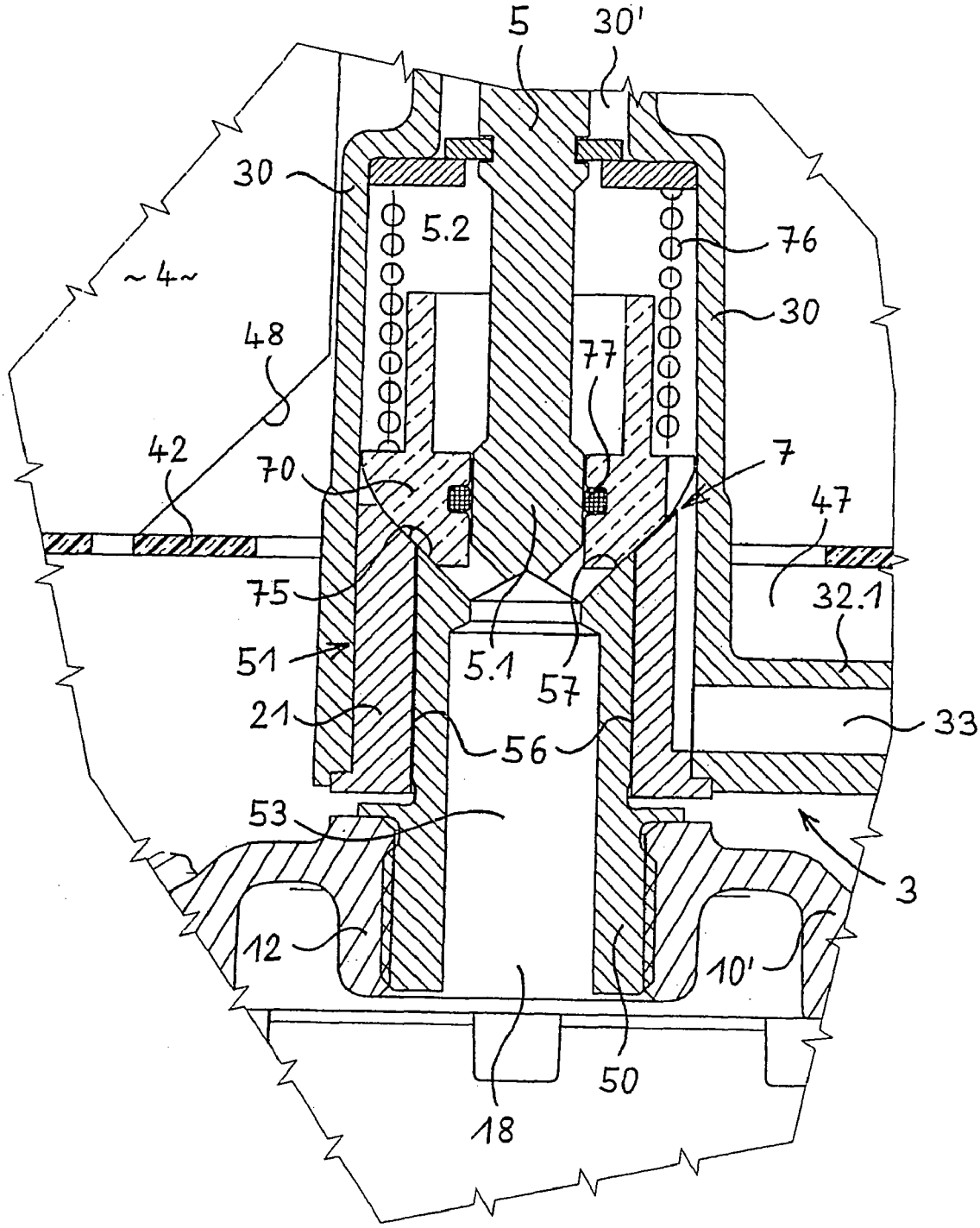
FIG. 39 a modified embodiment of the centrifuge according to FIGS. 38*a* and 38*b*, also in longitudinal section.

FIG. 39 shows a modification of the centrifuge from FIGS. 38*a* and 38*b* with a changed embodiment of the minimum pressure valve 7. With the embodiment according to FIG. 39, the central axis 5 is also screwed with its bottom threaded end 50 into the axis receiver 12 in the center of housing part 10'. On the bottom part of axis 5 above the threaded end 50, the bearing bush 21 is provided here again for the rotatable bearing of rotor 2 by means of the lower friction bearing 51. On the outside of the bearing bush 21, the lower end area of the tubular body 30 of drive part 3 will be provided. Between the outer circumference of the lower area of axis 5 and the inner circumference of bearing bush 21, there is a bearing gap 56 of the friction bearing 51.

In the embodiment presented in FIG. 39, the upper front face of the bearing bush 21 and a radially internally following, upwardly directed area of a step 57 in axis 5 are jointly forming a valve seat 75 for the valve body 70 of the minimum pressure valve 7. For preloading in closing direction, the valve body 70 is pressurized by a valve spring 76 provided above. The embodiment of axis 5—with the lower section 5.1 of a larger outside diameter and the section 5.2. following above of a smaller outside diameter—is equivalent with the embodiment according to FIG. 38.

In the closed position of the minimum pressure valve 7 shown in FIG. 39, the valve body 70 seals the valve seat 75. This prevents a lubricating oil flow from the inlet 18 into the two channels 33 and into the ring channel 30'. Different to the embodiment according to FIGS. 38*a* and 38*b*, the embodiment according to FIG. 39 has the valve body 70 additionally providing for closing of the bearing gap 56 in the lower friction bearing 51. Thus, not even a leakage oil flow will be possible through the bearing gap 56 with a closed minimum pressure valve 7.

When—due to the increasing oil pressure at inlet 18 and in the hollow section 53 of axis 5—the valve body 70 is lifted from its valve seat 75 against the force of spring 76, the flow paths into the two channels 33 and into the ring channel 30' will be released, on the one hand, and the bearing gap 56 will also be opened, on the other hand, for the entry of oil. This will ensure sufficient lubrication of the friction bearing 51 with oil.

When the oil pressure decreases, the valve spring 76 will push the valve body 70 again into its closed position shown in FIG. 39. At the same time, the valve body 70 provides for deceleration of the rotor 2 which prevents an undesirable long after-running period of the rotor 2, e.g. when the associated internal combustion engine is shut off.

With regard to the other individual parts and reference numbers in FIG. 39, reference is made to the preceding description of Figures.

Figure 40:
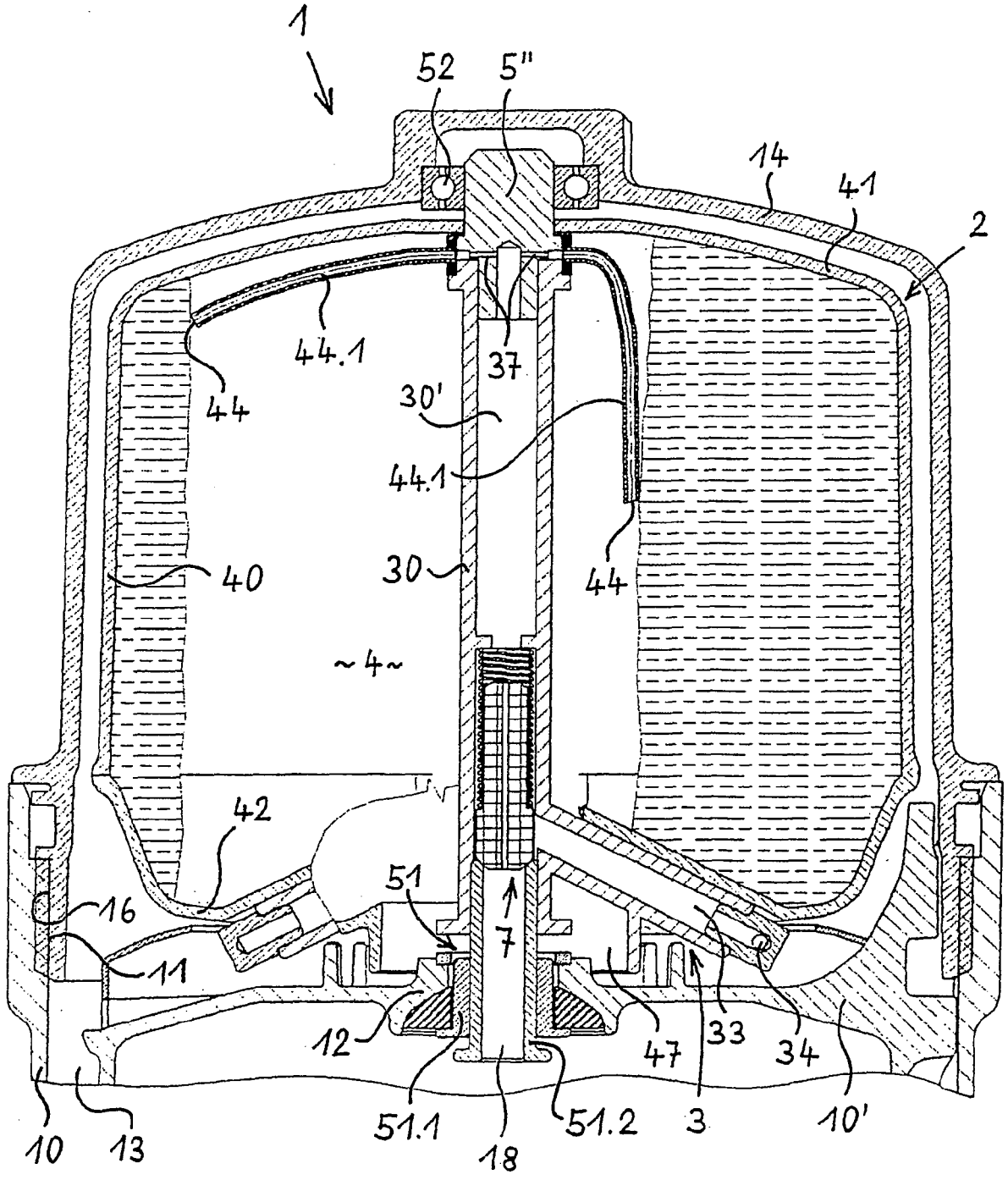
FIG. 40 another complete centrifuge, again in longitudinal section.

FIG. 40 shows an embodiment of the centrifuge 1 which, in most parts, is equivalent to the embodiment of the centrifuge according to the already explained FIG. 35. Different with the centrifuge 1 according to FIG. 40 is the development of the inlet 44 for the lubricating oil to be cleaned in the dirt trapping part 4. Instead of simple openings, two or more flexible hose arms 44.1 are here provided as inlets 44. The hose arms 44.1 are fastened on their radially inner end to the upper end area of the tubular body 30 and are in a flow connection with the channel 30' in the interior of the tubular body 30 through which the lubricating oil to be cleaned is fed.

In the left half of FIG. 40, the dirt trapping part 4 of rotor 2 is shown in a condition in which only a relatively small amount of dirt particles has deposited on the inner surface of the peripheral wall 40. Here, the hose arm 44.1 assumes upon rotation of the rotor 2 the position shown top left in FIG. 40 caused by centrifugal force, where the inlet 44 for the lubricating oil to be cleaned into the interior of the dirt trapping part 4 is relatively far radially outside and directly in front of the inside facing surface of the already deposited dirt particle cake.

In the right half of FIG. 40, the rotor 2 is shown in a condition in which a considerably thicker dirt particle cake has already deposited in the dirt trapping part 4 such as it occurs shortly before the end of the service time of the dirt trapping part 4. Due to the dirt particle cake growing radially from the outside to the inside, the flexible hose arm 44.1 with its free end forming the inlet 44 is moved along in radial direction towards the inside so that it finally assumes the position shown in the right half of FIG. 40. The flexible hose arms 44.1 achieve that the inlet 44 for the lubricating oil to be cleaned into the dirt trapping part 4 is always as far radially outside as the already deposited dirt particle cake still allows.

With regard to the other parts and reference numbers shown in FIG. 40, reference is made to the preceding description of Figures.

Figure 41:
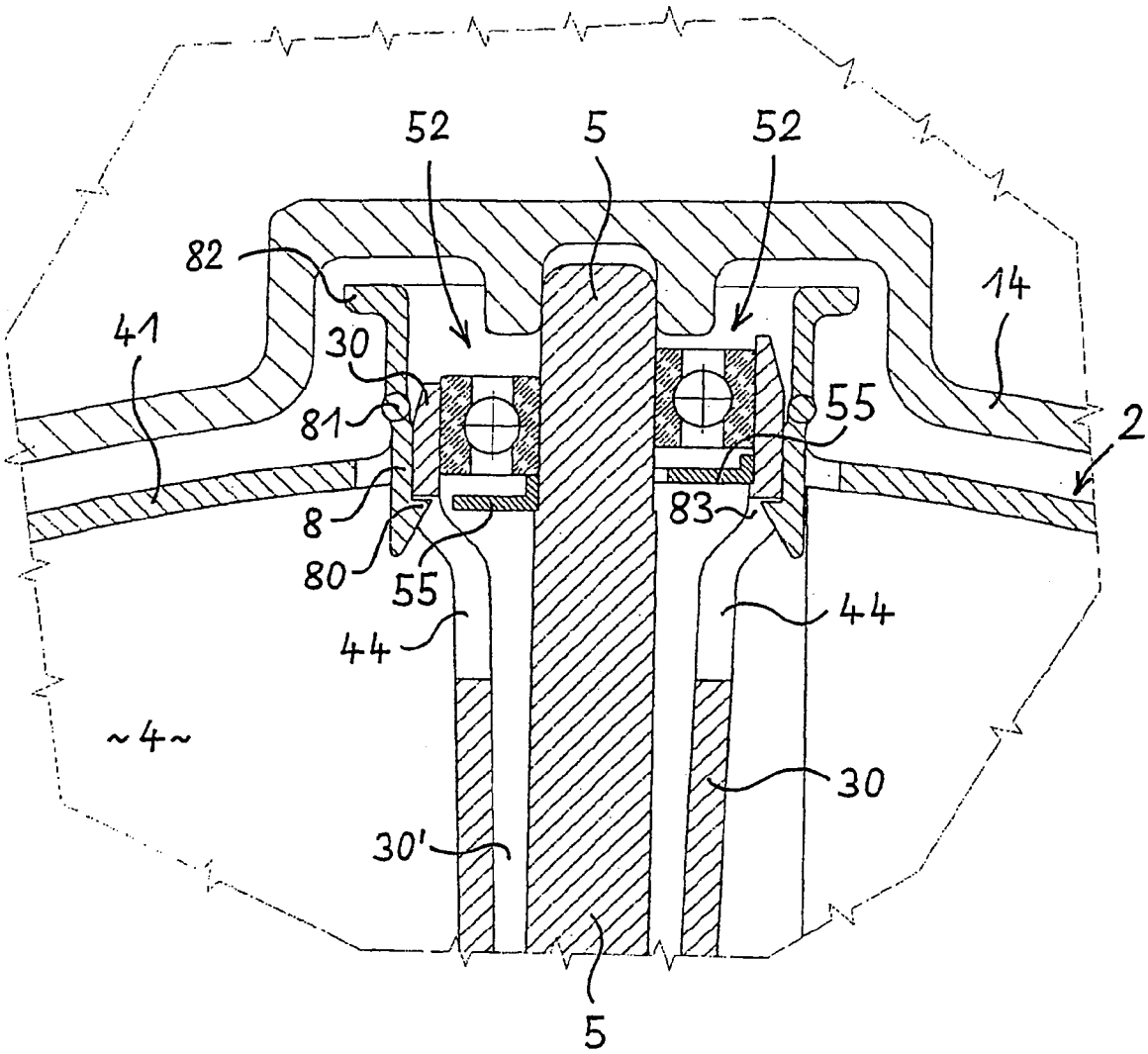
FIG. 41 the central upper area of another centrifuge, in longitudinal section.

FIG. 41 shows a modification of the centrifuge in which the dirt trapping part 4 and the drive part 3 of the rotor 2 are detachably connected with each other by means of adjustable latching tongues 8.

The top of FIG. 41 shows the central area of the cover 14. Thereunder is the upper wall 41 of the dirt trapping part 4. The lower part of FIG. 41 shows axis 5 running from the bottom to the top for the rotatable bearing of rotor 2, said axis being surrounded by the tubular body 30 of the drive part 3 of rotor 2. Through the ring channel 30' between axis 5 and the tubular body 30, the lubricating oil to be cleaned is fed from the bottom to the top and enters through the inlets 44 into the dirt trapping part 4.

Several latching tongues 8, distributed in circumferential direction, are designed of one piece or are here connected with the central area of the upper wall 41 of the dirt trapping part 4. These latching tongues 8 are running in approximately vertical direction in parallel with axis 5 and comprise on their lower end one inside-facing latching nose 80 each. The respectively upper end of the latching tongues 8 forms an activation end 82 which can be activated by exercising a radially inside directed force either by hand or with an auxiliary tool. This activation force results in tilting of the latching tongues 8 about their tilt axis 81 and thus to a tilt of the latching noses 80 in radial direction towards the outside. The latching noses 80 are thereby released from latching recesses 83 which are formed by the upper area of the oil inlets 44 in the tubular body 30. In this condition of the latching tongues 8, the dirt trapping part 4 can be pulled off in axial direction from the drive part 3 with the cover 14 removed.

Between the upper end area of axis 5 and the upper end of the tubular body 30, a rolling bearing is provided as the upper bearing 52 for the rotatable bearing of rotor 2. Directly underneath the bearing 52, the shielding ring 55 is provided which was already explained on the basis of FIG. 22.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A free-jet centrifuge for cleaning the lubricating oil of an internal combustion engine, comprising:

a housing which is closed by a removable cover, a rotor rotatably arranged in the housing and with channels for feeding pressurized lubricating oil to be cleaned and for removing cleaned pressureless lubricating oil, the rotor being of split design with a drive part having at least one recoil nozzle and a dirt trapping part having a dirt collection area, the drive part configured to allow a first partial lubricating oil flow therethrough and the dirt trapping part configured to allow a second partial lubricating oil flow therethrough, the drive part and the dirt trapping part being configured with positive-interaction torque transmission means which are engageable by axially slipping the dirt trapping part onto the drive part and disengageable by axially pulling the dirt trapping part off from the drive part, the dirt trapping part being separable from the drive part for disposal or cleaning, and means located in the centrifuge which, in the operation of the centrifuge, serve to at least restrict the axial mobility of the dirt trapping part relative to the drive part and which are one of ineffective and detachable when the cover is removed, wherein the drive part extends from a bottom towards a top into the dirt trapping part or entirely through it, the drive part comprises all of the parts necessary for a rotatable bearing of the rotor, and the drive part is securely positioned against axial removal with the cover in an open position.

2. A free-jet centrifuge according to claim 1, wherein the drive part comprises a central tubular body forming a lubricating oil channel and at least one nozzle bearing body radially extending outward from the tubular body with at least one oil branch channel leading to the at least one recoil nozzle.

3. A free-jet centrifuge according to claim 2, wherein the nozzle bearing body has the form of a double bottom, in an interspace of which the at least one oil branch channel is formed.

4. A free-jet centrifuge according to claim 2, wherein the nozzle bearing body has the form of a disk in which the at least one oil branch channel is formed.

5. A free-jet centrifuge according to claim 2, wherein the nozzle bearing body has the form of at least two tubular arms with one oil branch channel running through each arm.

6. A free-jet centrifuge according to claim 5, wherein the dirt trapping part on an underside has a contour axially overreaching the arms of the drive part and forming, with these arms, the interacting torque transmission means of the drive part and the dirt trapping part of the rotor.

7. A free-jet centrifuge according to claim 6, wherein the contour of the underside of the dirt trapping part is additionally designed as a latching connection axially engageable and disengageable with the arms of the drive part.

8. A free-jet centrifuge according to claim 6, wherein the partial flow fed to the drive part is larger by volume than the partial flow fed to the dirt trapping part.

9. A free-jet centrifuge according to claim 1, wherein the rotor is positioned on an axis forming one part of the housing, being rigidly or articulatedly attached on a remaining housing part, said axis penetrating the rotor and being detachably supported and centered with its upper end in the cover when in place.

10. A free-jet centrifuge according to claim 9, wherein the supply of the lubricating oil to the centrifuge, for the drive part as well as for the dirt trapping part, is provided axially from the bottom through the axis.

11. A free-jet centrifuge according to claim 9, wherein the supply of lubricating oil to the centrifuge is provided, for the drive part, axially from the bottom through the axis, and for the dirt trapping part, separately thereof axially from the top.

12. A free-jet centrifuge according to claim 9, wherein the drive part is secured against removal from the axis towards the top by means of a safety which is at least one of latched, clamped and screwed on the axis or one of provided and supported on the cover.

13. A free-jet centrifuge according to claim 9, wherein a stop body, detachably connected axially at the top with the axis, projecting above the axis radially towards the outside, has axially on an underside, and the dirt trapping part has axially on an upper side, one stop face each which in their interaction at least restrict the axial mobility of the dirt trapping part relative to the drive part during operation of the centrifuge.

14. A free-jet centrifuge according to claim 13, wherein the drive part is secured against removal from the axis towards the top by means of a safety which is at least one of latched, clamped and screwed on the axis or one of provided and supported on the cover and the safety and the stop body are one of combined to and in one component.

15. A free-jet centrifuge according to claim 1, wherein the rotor is positioned on an axis forming a rigid part of the housing, the axis extending into the rotor and ending with its upper end at a distance to the cover when in place.

16. A free-jet centrifuge according to claim 1, wherein the rotor is arranged on bearings at a bottom and a top by means of one axis stub each, with the axis stubs being parts of one of the rotor and the housing and its cover.

17. A free-jet centrifuge according to claim 1, wherein the dirt trapping part is formed by a hollow body at least partly open at an axial bottom and an axial top, with a radially outer peripheral wall, wherein axially on the bottom, the nozzle bearing body, in the assembled condition of the rotor, forms a bottom delimiting an interior of the rotor at least partly towards the bottom and with the hollow body, axially on the top, being closed by a separate dirt trapping part cover.

18. A free-jet centrifuge according to claim 17, wherein the hollow body forming the dirt trapping part additionally comprises a radially inner tubular wall.

19. A free-jet centrifuge according to claim 17, wherein the hollow body forming the dirt trapping part of the rotor is a one-piece plastic injection molded part.

20. A free-jet centrifuge according to claim 19, wherein the dirt trapping part is free of metal and the plastic forming the dirt trapping part is a recycling plastic, and combustible with low to no pollutant emissions.

21. A free-jet centrifuge according to claim 17, wherein the hollow body forming the dirt trapping part of the rotor is a plastic component of two injection molded parts joined together.

22. A free-jet centrifuge according to claim 1, wherein the dirt trapping part is formed by a cup-shaped hollow body axially open on the top, with a radially outer peripheral wall, with the hollow body, axially on the top, being closed by a separate dirt trapping part cover.

23. A free-jet centrifuge according to claim 1, wherein the dirt trapping part is formed by a bell-shaped hollow body being at least partly open axially on the bottom, with a radially outer peripheral wall, with the nozzle bearing body, axially on the bottom, forming, in an assembled condition of the rotor, a bottom at least partly delimiting an interior of the rotor towards the bottom.

24. A free-jet centrifuge according to claim 1, wherein the dirt trapping part is formed by a can-shaped hollow body closed axially on the bottom and axially on the top, with a radially outer peripheral wall.

25. A free-jet centrifuge according to claim 1, wherein the interacting torque transmission means of the drive part and dirt trapping part of the rotor are arranged in its radially inner, axially upper area.

26. A free-jet centrifuge according to claim 1, wherein the interacting torque transmission means of drive part and dirt trapping part of the rotor are provided in its axially lower area.

27. A free-jet centrifuge according to claim 1, wherein the dirt trapping part comprises in its interior guide and stiffener walls which are arranged substantially radially.

28. A free-jet centrifuge according to claim 27, wherein the radially inner end of the guide and stiffener walls forms a part of the torque transmission means on the side of the dirt trapping part, and the interacting torque transmission means of the drive part and the dirt trapping part of the rotor in its radially interior area, are provided extending over at least one part of the axial length of the tubular body.

29. A free-jet centrifuge according to claim 1, wherein the interacting torque transmission means of the drive part and the dirt trapping part are formed by axially combinable and separable multi-edge arrangements comprising one of contours, indentations, waviness and tongue-and-groove-configurations, with or without an undercut as seen in radial direction.

30. A free-jet centrifuge according to claim 29, wherein the interacting torque transmission means of the drive part and the dirt trapping part are designed in a self-finding manner with at least one of lead-in slopes and lead-in points.

31. A free-jet centrifuge according to claim 1, wherein a seal member is provided in the contact areas between the drive part and the dirt trapping part of the rotor, the seal member comprising at least one of a separately attached seal, a single-piece integrally molded seal and a sealing contour.

32. A free-jet centrifuge according to claim 1, wherein, for the generation of the two partial lubricating oil flows, the lubricating oil flow being fed to the centrifuge is divided in the centrifuge into two volume-adjusted partial flows, fed via two defined throttle points, with one partial flow being feedable under pressure to the drive part and its recoil nozzle and the other partial flow being feedable without pressure to the dirt trapping part via at least one inlet.

33. A free-jet centrifuge according to claim 32, wherein both throttle points are provided in the drive part of the centrifuge.

34. A free-jet centrifuge according to claim 33, wherein, of the two throttle points, the one through which the partial lubricating oil flow is fed to the dirt trapping part is formed by at least, one of a throttle bore and an upper bearing of the drive part with a defined gap measure.

35. A free-jet centrifuge according to claim 32, wherein at least one oil outlet is provided axially on the bottom and radially inside on the rotor, said outlet having a cross-section which is larger than a cross-section of the inlet.

36. A free-jet centrifuge according to claim 35, wherein radially outside from the outlet, at least one of a deflecting rib arrangement and a shielding disk is provided, on at least one of the underside of the rotor and on the upper side of a centrifugal housing area located under the rotor, which forces the pressureless partial lubricating oil flow coming from the outlet to a guided course separated from the rotor and from the oil jet coming out of the recoil nozzle.

37. A free-jet centrifuge according claim 1, wherein the partial lubricating oil flow for the dirt trapping part is supplied into it in at least one of the following manners: axially on the top, radially from the inside to the outside, in the form of a revolving fan jet and in the form of several individual jets distributed in circumferential direction through at least one correspondingly formed inlet.

38. A free-jet centrifuge according to claim 37, wherein at least one built-in part is provided axially on the top in the dirt trapping part for the uniform distribution of the inflowing lubricating oil in circumferential direction of the dirt trapping part.

39. A free-jet centrifuge according to claim 1, wherein the dirt trapping part axially on an upper side and the cover axially on an underside each have a stop face which in their interaction at least restrict an axial mobility of the dirt trapping part relative to the drive part when the cover is in place.

40. A free-jet centrifuge according to claim 1, wherein between an axial upper side of the dirt trapping part and an axial underside of the cover, an additional bearing in the form of a plain axial bearing is provided which at least restricts an axial mobility of the dirt trapping part relative to the drive part with the cover in place, and which takes up forces of the dirt trapping part which are directed axially towards the top.

41. A free-jet centrifuge according to claim 1, wherein the dirt trapping part axially on an upper side and the cover axially on an underside comprise coupling means which are engageable and disengageable with each other which do not contact each other when the cover is placed on and which, when the cover is removed, will engage with and take along the dirt trapping part axially towards the top, by separating it from the drive part.

42. A free-jet centrifuge according to claim 1, wherein the drive part and the dirt trapping part, in view of their parts interacting with the housing, comprise a forming and dimensioning which allow an installation of the drive unit and the dirt trapping part into existing centrifuges, hitherto provided with a conventional rotor.

43. A free-jet centrifuge according to claim 1, wherein a minimum pressure starting valve is arranged in a channel feeding the lubricating oil to the centrifuge, said valve only releasing an oil supply to the centrifuge after a predetermined oil pressure on an inlet side is exceeded.

44. A free-jet centrifuge according to claim 1, wherein it is part of a module comprising at least one additional auxiliary unit of the internal combustion engine, the part being attached at a flange of the internal combustion engine.

45. A free-jet centrifuge according to claim 44, wherein the centrifuge is operated in a bypass flow to an oil filter arranged in the main flow and the bypass flow flowing through the centrifuge comprises a maximum of 10% of the volume flow of the main flow.

46. A free-jet centrifuge according to claim 1, wherein the centrifuge for the rotatable bearing of the rotor comprises a central axis which is hollow at least over one part of its length and forms a section of an oil feed channel; in this section, a valve body of a minimum pressure valve is axially movably provided, the valve body being pre-loaded in closing direction; the valve body protrudes from the axis and a sealing head of the valve body is located outside of the axis; and a valve seat interacting with the sealing head is formed on an axis-carrying centrifuge housing part through which the oil feed channel is running.

47. A free-jet centrifuge according to claim 46, wherein the valve body is composed of several individual parts which are connected with each other, including the sealing head, a stem and a stem guide end piece.

48. A free-jet centrifuge according to claim 46, wherein the valve body is composed of a single piece.

49. A free-jet centrifuge according to claim 46, wherein the drive part comprises a metal, and the dirt trapping part comprises a plastic.

50. A free-jet centrifuge according to claim 1, wherein the drive part comprises a central tubular body which, by forming a ring channel for an oil supply, surrounds at a distance a central axis on which the drive part is rotatably positioned and wherein, in an upper end area of the ring channel between an upper bearing of the drive part and an oil inlet of the dirt trapping part, a shielding ring is provided which is tied one of radially inside to the axis and radially outside to the tubular body.

51. A free-jet centrifuge according to claim 1, wherein the centrifuge comprises a central hollow axis whose hollow interior forms, in a first axial area, a section of an oil feed channel and, in a second axial area, an oil outlet channel; wherein in the hollow interior of the axis, a first valve body, preloaded in closing direction, interacting with a valve seat, of a minimum pressure valve is provided axially movably to a limited extent; wherein an oil passage is formed in the valve body; and wherein a second valve body, preloaded in closing direction, of an overpressure shutdown valve interacts with the oil passage.

52. A free-jet centrifuge according to claim 51, wherein preloading of the first valve body and of the second valve body in their closing direction is effected by a single spring.

53. A free-jet centrifuge according to claim 51, wherein preloading of the first valve body and of the second valve body in their closing direction is effected by their own separate spring.

54. A free-jet centrifuge according to claim 1, wherein the centrifuge comprises a central hollow axis whose hollow interior, in a first axial area, forms a section of the oil feed channel for the drive part and for the dirt trapping part and, in a second axial area, a section of the oil feed channel only for the dirt trapping part; wherein, in the hollow interior of the axis, a valve body, preloaded in closing direction, interacting with a valve seat, of a minimum pressure valve is provided being axially movable to a limited extent; and wherein, in the valve body, an oil passage with a defined cross-section is formed whose orifice on the sealing seat side is located radially outside and downstream of the sealing contour of the valve body interacting with the sealing seat.

55. A free-jet centrifuge according to claim 1, wherein the centrifuge comprises a central hollow axis whose hollow interior, in a first axial area, forms a section of the oil feed channel for the drive part and for the dirt trapping part and, in a second axial area, a section of the oil feed channel only for the dirt trapping part; wherein, in the hollow interior of the axis, a valve body, preloaded in closing direction, interacting with a valve seat, of a minimum pressure valve is provided being axially movable to a limited extent; and wherein, between an outer circumference of the valve body and an inner circumference of the hollow axis, an oil passage with a defined cross-section is formed whose orifice on a sealing seat side is located radially outside and downstream of the sealing contour of the valve body interacting with the sealing seat.

56. A free-jet centrifuge according to claim 1, wherein the bottom of the dirt trapping part is provided with openings distributed in radial and circumferential direction and under the perforated bottom in an axial distance from it and above the nozzles, a closed shielding disk is provided which is part of the drive part, or wherein in the dirt trapping part above a closed bottom thereof, an intermediate bottom is provided which has openings distributed in radial and circumferential direction.

57. A free-jet centrifuge according to claim 56, wherein the bottom or the intermediate bottom provided with the openings is designed as a perforated plate or a screen plate.

58. A free-jet centrifuge according to claim 56, wherein a layer of oil-permeable material is placed onto the bottom or the intermediate bottom, covering up its openings.

59. A free-jet centrifuge according to claim 1, wherein two shielding disks are provided one over the other, radially outside of a clean oil outlet of the dirt trapping part, on an upper side of a centrifuge housing part located under the rotor, with the pressureless partial lubricating oil flow coming from the clean oil outlet flowing off between the lower shielding disk and the centrifuge housing part located thereunder, and with the fast flowing partial lubricating oil flow, exiting from the recoil nozzles of the drive part, being discharged between the lower shielding disk and the upper shielding disk.

60. A free-jet centrifuge according to claim 1, wherein a central axis serving for the rotatable bearing of the rotor is designed as one single piece with a part of the centrifuge housing located under the rotor.

61. A free-jet centrifuge according to claim 1, wherein at least one bearing sleeve is set onto an outside of a central axis serving for the rotatable bearing of the rotor, the sleeve being of a material forming a favorable sliding fit with at least one bearing bush in the rotor.

62. A free-jet centrifuge according to claim 61, wherein the bearing sleeve, after being set down onto the axis, is finished on its outer circumference by grinding.

63. A free-jet centrifuge according to claim 1, wherein the drive part of the rotor is designed with a central tubular body through which the lubricating oil to be cleaned is fed to the dirt trapping part; wherein in an upper end area of the tubular body, at least one opening running in radial direction is provided as an oil inlet to the dirt trapping part; wherein by forming an annular gap space on the outer circumference of the upper end area of the tubular body, a sleeve-form collar is provided which is closed axially on the bottom and radially on the outside and opened axially on the top; and wherein the oil inlet discharges into the lower part of the annular gap space.

64. A free-jet centrifuge according to claim 1, wherein the drive part of the rotor is designed with a central tubular body which forms a shaft for the rotatable bearing of the rotor; the tubular body is provided on bearings on the bottom and the top of housing parts of the centrifuge; a friction bearing is provided as the lower bearing which is formed by a bearing bush inserted in the housing part located under the rotor and a bearing part inserted into the bearing bush provided on the bottom end of the tubular body; and, as an upper bearing, a rolling bearing is provided which is arranged between the upper end of the tubular body and a housing part, especially cover, which is located above the rotor.

65. A free-jet centrifuge according to claim 64, wherein the tubular body forming the shaft for the rotatable bearing of the rotor is provided with axial clearance and the size of a lower front face of the tubular body or of the bearing part is dimensioned subject to the oil pressure prevailing during operation of the centrifuge such that an axial force caused by the oil pressure, acting on the rotor towards the top is essentially equivalent to an axial weight force of the rotor acting towards the bottom.

66. A free-jet centrifuge according to claim 1, wherein the drive part of the rotor is designed with a central tubular body which forms a shaft for the rotatable bearing of the rotor, and the tubular body is run on bearings only on the bottom of a housing part of the centrifuge located under the rotor, by means of two bearings axially spaced from each other.

67. A free-jet centrifuge according to claim 66, wherein the lower bearing is provided as a friction bearing which is formed by a bearing bush inserted into the housing part located under the rotor and by a bearing part provided on a lower end of the tubular body and inserted into the bearing bush; and a rolling bearing is provided as an upper bearing which, seen in radial direction, is arranged between the bearing part of the tubular body and the housing part located under the rotor.

68. A free-jet centrifuge according to claim 1, wherein the centrifuge is designed with a housing-stationary central axis, and the drive part of the rotor with a central tubular body surrounding the axis at a distance; wherein, through a ring channel between axis and tubular body, the lubricating oil to be cleaned is fed to the dirt trapping part; and wherein on the inner circumference of the tubular body, ribs running in axial direction are arranged, extending radially towards the inside into an annular gap space.

69. A free-jet centrifuge according to claim 1, wherein the centrifuge is designed with a housing-stationary central axis, and the drive part of the rotor with a central tubular body surrounding the axis at a distance; wherein the lubricating oil is fed to the centrifuge through a hollow lower section of the central axis; wherein, through a ring channel between axis and tubular body, a partial flow forming the lubricating oil to be cleaned is fed to the dirt trapping part; wherein a friction bearing bush provided at the lower end of the tubular body is run on bearings on the hollow lower section of the central axis and wherein the upwardly directed front face of the bearing bush is designed as a valve seat for a valve body, axially movable in the tubular body, preloaded in closing direction, of a minimum pressure valve.

70. A free-jet centrifuge according to claim 69, wherein the valve body is hollow and carried on the axis; the axis, in its area carrying the valve body, comprises a section of a larger outer diameter and above that a section of a smaller outer diameter, and the valve body on its inner circumference comprises a sealing contour or a seal which seals off against the section of the larger outer diameter and has a radial distance to the section of the smaller outer diameter.

71. A free-jet centrifuge according to claim 1, wherein the centrifuge is designed with a housing-stationary central axis, and the drive part of the rotor with a central tubular body surrounding the axis at a distance; wherein the lubricating oil is fed to the centrifuge through a hollow lower section of the central axis; wherein, through a ring channel between axis and tubular body, a partial flow forming the lubricating oil to be cleaned is fed to the dirt trapping part; wherein a friction bearing bush provided at a lower end of the tubular body is run on bearings on the hollow lower section of the central axis; wherein the axis at the level of the upper end of the bearing bush comprises a radially outwardly projecting step; and wherein the upwardly directed front faces of the bearing bush and of the step are jointly designed as a valve seat for a valve body, axially movable in the tubular body, preloaded in closing direction, of a minimum pressure valve, with the valve body in its closed position sealingly covering a bearing gap between the axis and the bearing bush.

72. A free-jet centrifuge according to claim 1, wherein the means provided or applied in the centrifuge, which, in the operation of the centrifuge, serve to prevent or restrict the axial mobility of the dirt trapping part relative to the drive part and which are detachable when the cover is removed, are formed by latching tongues with latching noses arranged on the dirt trapping part or on the drive part which are interacting with latching recesses provided on the drive part or on the dirt trapping part.

73. A free-jet centrifuge according to claim 72, wherein the latching tongues are provided on the top and radially inside, as well as downwardly directed on the dirt trapping part and the latching recesses are provided on the top and radially inside on the drive part.

74. A free-jet centrifuge according to claim 72, wherein the latching tongues swivel about a swivel axis; the latching tongues are formed with an upwardly directed and protruding activation end; and by swiveling the activation end radially towards the inside, the respectively associated latching tongue swivels with its latching nose radially outwardly and thus is disengageable with its latching recess.

75. A free-jet centrifuge according to claim 1, wherein in an upper area of the dirt trapping part from its center, upon rotation of the rotor in radial direction, outwardly pointing flexible hose arms or articulated tubular arms are provided as an oil inlet.

76. A free-jet centrifuge according to claim 1, wherein in an upper area of the dirt trapping part, from its center, outwardly extending rigid tubular arms are provided, with holes as an oil inlet provided over their length.

* * * * *

UNITED STATES PATENT AND TRADEMARK OFFICE

CERTIFICATE OF CORRECTION

PATENT NO. : 7,713,185 B2
APPLICATION NO. : 10/592930
DATED : May 11, 2010
INVENTOR(S) : Baumann et al.

It is certified that error appears in the above-identified patent and that said Letters Patent is hereby corrected as shown below:

On the face of the patent, insert:

--(30) Foreign Application Priority Data
Mar. 17, 2004 (DE) 20 2004 004 215.0
Jun. 2, 2004 (DE) 20 2004 008 785.5--

Signed and Sealed this

Twenty-fourth Day of August, 2010

David J. Kappos

David J. Kappos
*Director of the United States Patent and Trademark Office*